United States Patent [19]

Sasaki et al.

[11] Patent Number: 5,077,182

[45] Date of Patent: Dec. 31, 1991

[54] SILVER HALIDE COLOR PHOTOGRAPHIC MATERIALS

[75] Inventors: Noboru Sasaki; Keisuke Shiba, both of Ashigara, Japan

[73] Assignee: Fuji Photo Film Co., Ltd., Kanagawa, Japan

[21] Appl. No.: 104,304

[22] Filed: Oct. 5, 1987

[30] Foreign Application Priority Data

Oct. 3, 1986 [JP] Japan ..... 61-234518

[51] Int. Cl.[5] ..... G03C 7/18; G03C 7/32

[52] U.S. Cl. ..... 430/504; 430/362; 430/505; 430/551; 430/957; 430/507

[58] Field of Search ..... 430/505, 504, 506, 554, 430/957, 362, 544

[56] References Cited

U.S. PATENT DOCUMENTS

| | | | |
|---|---|---|---|
| 4,130,427 | 12/1978 | Monbaliu et al. | 430/558 |
| 4,306,015 | 12/1981 | Haylett | 430/505 |
| 4,366,237 | 12/1982 | Ichijima et al. | 430/505 |
| 4,500,634 | 2/1985 | Sakanoue et al. | 430/544 |
| 4,528,263 | 7/1985 | Sugita et al. | 430/544 |
| 4,670,375 | 6/1987 | Michiue et al. | 430/509 |
| 4,705,744 | 11/1987 | Sasaki et al. | 430/505 |

OTHER PUBLICATIONS

Derwest Abstract-JP 233, 741/86, "Silver Halide . . .", Fuji: Photo Film 10/86.

*Primary Examiner*—Richard L. Schilling
*Attorney, Agent, or Firm*—Sughrue, Mion, Zinn Macpeak & Seas

[57] ABSTRACT

Disclosed is a silver halide color photographic material comprising at least one yellow coupler-containing silver halide emulsion layer (BL) spectrally sensitized such that the specific spectral sensitivity range falls within the scope of from 400 nm to 520 nm, at least one magenta coupler-containing silver halide emulsion layer (GL) spectrally sensitized such that the specific spectral sensitivity range falls within the scope of from 470 nm to 620 nm, and at least one cyan coupler-containing silver halide emulsion layer (RL) spectrally sensitized such that the specific spectral sensitivity range falls within the scope of from 540 nm to 700 nm, wherein the center of gravity of the sensitivity wavelength of the GL's spectral sensitivity distribution ($\lambda_G$) falls within the range of from about 520 nm to about 580 nm, the center of gravity of the sensitivity wavelength of the RL's spectral sensitivity distribution ($\lambda_R$) falls within the range of from about 590 nm to about 650 nm, and the center of gravity of the sensitivity wavelength of the BL's spectral sensitivity distribution ($\lambda B$) falls within the range of from about 430 nm to about 480 nm, and that the material satisfies at least one of the following conditions (a), (b), (c), and (d):

(a) the center of gravity of the sensitivity wavelength of the negative interlayer effect relative to the RL ($\lambda_{-}^{max}$) falls within the range of from about 490 nm to about 560 nm;

(b) the center of gravity of the sensitivity wavelength of the negative interlayer effect relative to the GL ($\lambda_{-G}^{max}$) falls within the range of at least one of from about 400 nm to about 500 nm and from about 570 nm to about 670 nm;

(c) the center of gravity of the sensitivity wavelength of the negative interlayer effect relative to the BL ($\lambda_{-B}^{max}$) falls within the range of from about 520 nm to about 590 nm; and (d) the BL contains a cyan coupler or a cyan-coloring DIR-coupler, and the material further satisfies at least one of the conditions (i) through (vii) set forth in the specification.

5 Claims, 2 Drawing Sheets

SILVER HALIDE COLOR PHOTOGRAPHIC MATERIALS

FIELD OF THE INVENTION

The present invention relates to color photographic light-sensitive materials which can form images capable of providing an extremely natural hue for visual impression and also giving high chroma and excellent appearance quality corresponding to the original color as visually impressed, and in particular, relates to color photographic light-sensitive materials which additionally can form very sharp images having excellent graininess and sufficient perspective view.

BACKGROUND OF THE INVENTION

Various improvements have been made in color photographic light-sensitive materials since Kodachrome was first sold in 1935 utilizing Maxwell's principle of color photography and Helmholtz's three primaries. Specific improvements include improvement of the three primary coloring dyes to be used, improvement of the blue-sensitive, green-sensitive, and red-sensitive spectral sensitivities, the elimination of any unfavorable spectral characteristics from three primary coloring dyes by introduction of color-making property thereinto, and the prevention of color-mixing caused between the respective light-sensitive layers by incorporation of an appropriate DIR-compound having a interlayer effect into light-sensitive layers. However, the all-around consideration on the human visual spectral sensitivity characteristics (for example, including the human three primary color stimulative value curve, etc.) was not still given. Accordingly, any concrete means to visually express gradation of objects with high density and high chroma, and to express the difference of hue with delicate variation, could not be practically applied to color photographic light-sensitive materials, hitherto, although the theoretical mechanism of such means has been known.

For example, Japanese Patent Application (OPI) No. 18245/79 (the term "OPI" as used herein refers to a "published unexamined Japanese patent application") describes the incorporation of a DIR-coupler or a DIR-hydroquinone derivative in a blue-sensitive layer, green-sensitive layer, or red-sensitive layer in combination with another color coupler so as to improve the sharpness, color saturation, and graininess of the final images. However, no consideration is given to the details of the spectral characteristic considering human sensitivity on color in OPI No. 118245/79, and thus, the image quality of the color photograph obtained therein is not satisfactory.

U.S. Pat. No. 3,672,898 describes the relative spectral sensitivity distribution of light-sensitive layers having excellent color-renderability, especially high neutral color-renderability, in multilayer color photographic light-sensitive materials exposed to various light sources for picture-taking. However, this U.S. Patent also has no description of giving consideration to the details of human color-sensitive spectral characteristics, spectral absorption characteristics of the respective coloring dyes, masking characteristics in the interlayer between the respective three primary color layers, and self-compensating characteristics by interlayer effect. Accordingly, the color-reproduction quality of the color photographs according to this U.S. Patent is still not totally sufficient.

Japanese Patent Application (OPI) No. 34541/86 and Japanese Patent Application Nos. 42155/85 and 651/86 describe a method wherein an interlayer effect which is negative with respect to the red-sensitive layer is imparted, preferably in the wavelength range of from 500 nm to 560 nm, while the center of gravity of the wavelength (the weight-averaged wavelength) of the defined interlayer effect is on the side of a longer wavelength range than the spectral sensitivity distribution of the green-sensitive layer.

For example, Japanese Patent Application No. 39734/85 describes provision of a silver halide emulsion layer having an intermediate spectral sensitivity distribution between the spectral sensitivity distribution of a red-sensitive layer and that of a green-sensitive layer, and the incorporation of a specific DIR-compound which impart a negative interlayer effect to other layers in the emulsion layer. Despite the incorporation of such compound, the effect is still not totally sufficient.

Furthermore, there still are various other problems to be solved relating to visual spectral sensitivity characteristics of photographic materials, including the spectral characteristics of the respective three color formers incorporated, the spectral sensitivity distributions of the blue-sensitive, green-sensitive, and red-sensitive emulsion layers, and the actual color-mixing in the light-sensitive layers.

In the case of a system where three color formers, such as a cyan-dye-forming coupler, a magenta-dye-forming coupler, and a yellow-dye-forming coupler are used, it is necessary to provide a negative interlayer effect with respect to the respective emulsion layers of the color photographic light-sensitive materials in order to obtain a favorable color-reproducibility, as is apparent from FIG. 1, which shows spectral sensitometric curves for quasi-colorimetric reproduction, and in addition, it is necessary to give an effect capable of forming a cyan image to the blue-sensitive emulsion layer (BL), as noted from the curve (R) in FIG. 1.

The present inventors conducted various experiment in order to satisfy the above noted desirable properties, and succeeded in improving the color-reproducibility and also in obtaining photographs with natural color images. as is disclosed in Japanese Patent Application (OPI) No. 34541/86. Surprisingly, however, it was found that the improvement of the color-reproducibility for the formation of natural color image photographs often causes extreme drawbacks with respect to the graininess and the sharpness of the color images formed. It is of course necessary that the image sharpness and the graininess are well balanced with respect to the excellence of the light-sensitive emulsion layers, viz., the blue-sensitive emulsion layer (BL), green-sensitive emulsion layer (GL), and red-sensitive emulsion layer (RL). In this connection, it has been found that if the graininess and the image sharpness are poor, as mentioned above, the improved effect of the color-reproducibility can not be visually appreciated.

SUMMARY OF THE INVENTION

One object of the present invention is to provide color photographic light-sensitive materials which can form images capable of providing an extremely natural hue for visual impression and also giving high chroma and excellent appearance quality corresponding to the original natural color as visually impressed, by improving the color-reproducibility and also improving the image sharpness and the graininess of the images formed so that these photographic characteristics can be made well-balanced with the respective light-sensitive layers of the material. Other objects of the present invention will be clarified by the description of the present specification, although it is noted that the effects of the present invention and the technical merit thereof are mainly evaluated by the visual senses.

The present inventors extensively experimented, and have found that the above-mentioned objects of the present invention can be achieved by a color photographic light-sensitive material comprising at least one yellow coupler-containing silver halide emulsion layer (BL) spectrally sensitized such that the specific spectral sensitivity range falls within the scope of from 400 nm to 520 nm, at least one magenta coupler-containing silver halide emulsion layer (GL) spectrally sensitized such that the specific spectral sensitivity range falls within the scope of from 470 nm to 620 nm, and at least one cyan coupler-containing silver halide emulsion layer (RL) spectral-sensitized such that the specific spectral sensitivity range falls within the scope of from 540 nm to 700 nm, wherein the center of gravity of the sensitivity wavelength of the GL's spectral sensitivity distribution ($\bar{\lambda}_G$) falls within the range of from about 520 nm to about 580 nm, the center of gravity of the sensitivity wavelength of the RL's spectral sensitivity distribution ($\bar{\lambda}_R$) falls within the range of from about 590 nm to about 650 nm, and the center of gravity of the sensitivity wavelength of the BL's spectral sensitivity distribution ($\bar{\lambda}_B$) falls within the range of from about 430 nm to about 480 nm, and that the material satisfies at least one of the following conditions (a), (b), (c), and (d):

(a) the center of gravity of the sensitivity wavelength of the negative interlayer effect relative to the RL ($\bar{\lambda}_{-R}^{max}$) falls within the range of from about 490 nm to about 560 nm;

(b) the center of gravity of the sensitivity wavelength of the negative interlayer effect relative to the GL ($\bar{\lambda}_{-G}^{max}$) falls within the range of at least one of from about 400 nm to about 500 nm and from about 570 nm to about 670 nm;

(c) the center of gravity of the sensitivity wavelength of the negative interlayer effect relative to the BL ($\bar{\lambda}_{-B}^{max}$) falls within the range of from about 520 nm to about 590 nm; and (d) the BL contains a cyan coupler or a cyan-coloring DIR-coupler, and the material further satisfies at least one of the following requirements (i) through (vii):

(i) at least one of the BL and RL contains a DIR-coupler capable of reacting with the oxidation product of a developing agent during development to release a development inhibitor having a diffusibility of from 0.4 to 0.95 or a precursor thereof;

(ii) at least one of the BL and RL and interlayer contains a compound capable of reacting with the oxidation product of a developing agent during development to release a compound which can react with another oxidation product of the developing agent to release a development inhibitor;

(iii) the GL contains a DIR-coupler capable of releasing a development inhibitor having a diffusibility of 0.4 or less;

(iv) the GL contains a colorless coupler for improving the graininess;

(v) the GL contains a nondiffusible coupler capable of forming a diffusible dye which can smear;

(vi) a yellow filter layer containing a yellow dye; and (vii) the material has one or more emulsions containing tabular silver halide grains having an aspect ratio of 5 or more (i.e., 5/1 or more) or monodispersed multilayer structural silver halide grains.

The precursor in the above-mentioned condition (i) means a compound capable of releasing a development inhibitor by the unimolecular reaction of its own intramolecular electron transfer reaction or nucleophilic substitution reaction, and this is to be differentiated from the compound in the requirement (ii) which can react with another oxidation product of the developing agent to release a development inhibitor.

The "specific spectral sensitivity range" as referred to herein means the wavelength range as sandwiched between the long wavelength side and the short wavelength side which correspond to 10 percent of the sensitivity of the maximum spectral sensitivity range of the spectral sensitivity curve.

DETAILED DESCRIPTION OF THE INVENTION

Figure 1:
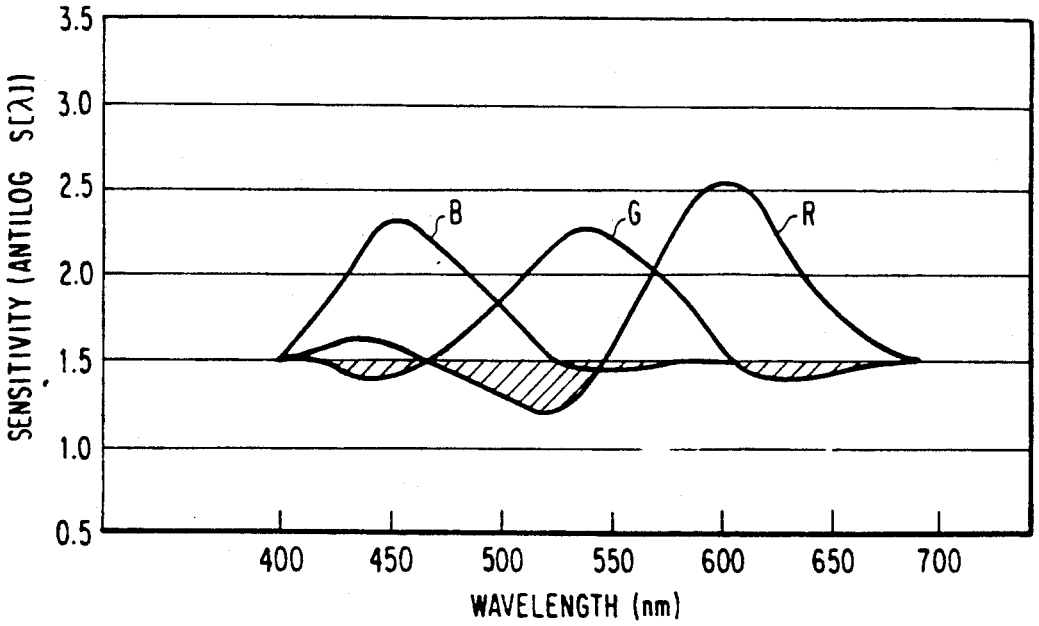
FIG. 1 shows spectral sensitivity curves for quasi-colorimetric reproduction when three kinds of cyan, magenta and yellow dyes are used.

The present invention is explained in further detail hereinafter.

The "center of gravity of the sensitivity wavelength" (i.e., weight-averaged wavelength) of spectral sensitivity distribution as herein referred to is described, for example, in Japanese Patent Application (OPI) No. 541/86. For instance, the center of gravity of the sensitivity wavelength of GL ($\lambda_G$) can be represented by the following formula:

$$\bar{\lambda}_G = \frac{\int_{470}^{600} \lambda \cdot S_G(\lambda)d\lambda}{\int_{470}^{620} S_G(\lambda)d\lambda}$$

in which $S_G(\lambda)$ represents the spectral sensitivity distribution curve of GL.

Likely, $\lambda_R$ and $\lambda_B$ can be represented as follows:

$$\bar{\lambda}_R = \frac{\int_{540}^{700} \lambda \cdot S_R(\lambda)d\lambda}{\int_{540}^{700} S_R(\lambda)d\lambda}$$

$$\bar{\lambda}_B = \frac{\int_{400}^{520} \lambda \cdot S_B(\lambda)d\lambda}{\int_{400}^{520} S_B(\lambda)d\lambda}$$

The center of gravity of the sensitivity wavelength of the negative interlayer effect to be imparted to RL can be defined to be $\bar{\lambda}_{-R}$; and the spectral sensitivity distribution of the negative interlayer effect to be imparted to RL can be defined to be $S_{-R}(\lambda)$.

The same shall apply to the other terms, accordingly.

As mentioned above, the first object of the present invention is to attain a natural color reproducibility which meets human visual sense in color photographic light-sensitive materials. The human visual sense is described in detail in *Handbook of Color Science,* 10th Chap. (by Nippon Color Scientific Society, 5th Ed., 1985, published by Tokyo University Publisher), and Wright's curve to show human spectral chromaticity values of the three colors red, green and blue is known. In addition, *Principles of Color Photography* (written by R. M. Evans, et al., 1953, published by John Wiley & Sons), Chap. 18, describes color reproducibility of color photographic materials. The present inventors have found that the blue-sensitive, green-sensitive, and red-sensitive distribution each have a respective negative sensitivity as shown in the visual colorimetric relative spectral sensitivity distribution using a yellow/magenta/cyan-expressing dye system and that the effect of imparting a slight cyan image to the blue-sensitive range is necessary.

The present inventors extensively investigated means for providing such negative or positive sensitivity, and as a result, have found that it is necessary to satisfy to provide a negative sensitivity or negative interlayer effect as noted below in order to obtain a color reproducibility improved such that images with visually natural colors can be formed.

(a) The center of gravity of the sensitivity wavelength of the negative interlayer effect relative to RL ($\bar{\lambda}_{-R}^{max}$) falls within the range of from about 490 nm to about 560 nm.

(b) The center of gravity of the sensitivity wavelength of the negative interlayer effect relative to GL ($\bar{\lambda}_{-G}^{max}$) falls within the range of at least one of from about 400 to about 500 nm and from about 570 nm to about 670 nm.

(c) The center gravity of the sensitivity wavelength of the negative interlayer effect relative to BL ($\bar{\lambda}_{-B}^{max}$) falls within the range of from about 520 nm to about 590 nm.

Also it is necessary to satisfy the following condition in order to obtain an effect of imparting a slight cyan image to BL.

(d) BL contains a cyan coupler or a cyan-coloring DIR-coupler. (Cyan coupler hereinafter means cyan dye forming coupler of which releasing group has no development inhibiting action or which has no releasing group).

In order to give the above-mentioned negative interlayer effect in the specific wavelength range relative to the respective light-sensitive layers of RL, GL, and BL, an interlayer effect-donor layer containing spectrally sensitized silver halide grains which were separately prepared can be provided, or alternatively, the individual light-sensitive layer itself can have such interlayer effect-donating function. However, it is preferred to provide separate interlayer effect-donor layers to the respective light-sensitive layers (RL, GL, and BL). Specifically, the interlayer effect-donor layer for use in the present invention can be said to be a layer having the above-mentioned determined spectral sensitivity distribution and a function capable of imparting a negative interlayer effect to a determined light-sensitive layer.

The present inventors extensively investigated in order to obtain guiding principles on planning light-sensitive materials so that good color-reproduction can be ensured in color photographic light-sensitive materials having a large interlayer effect by a color-masking or DIR-compound, and as a result, have found that the faithfulness of th color-reproductivity of photographic light-sensitive materials can quantitatively be measured by examining the reproductivity of the spectral light including white light. According to this means, the spectral light including white light, or the spectral light with reduced excitation purity (Pe) is used. This is because if a pure spectral light is used and only one of blue-sensitive, green-sensitive, and red-sensitive layers is sensitized, any interlayer effect would not appear, and additionally, color photographic materials for picture-taking are often used for photographing reflective objects with somewhat turbid colors.

Next, one embodiment for measurement of the faithfulness of color-reproduction will be mentioned below.

Step-1

An equi-energy spectral light with a constant excitation purity as defined in colorimetric system CIE (1931) is applied to a color photographic light-sensitive material to be tested, at regular intervals of 10 nm, from 400 nm to 700 nm. Further, the material is exposed to illuminant C as defined in CIE, at the same time.

Step-2

In the case of a color reversal photographic paper, such is, after exposure as above, directly developed; in the case of a color negative photographic material, such is, after exposure as above, first printed on a color print paper wherein the previously exposed part is finished gray, and then developed.

Step-3

The chromaticity of the positive image thus reproduced is measured with a colorimeter SS Color Computer (manufactured by Suga Electric Co., Japan) and plotted on 1931's $CIE_{xy}$ chromaticity diagram.

Step-4

Figure 2:
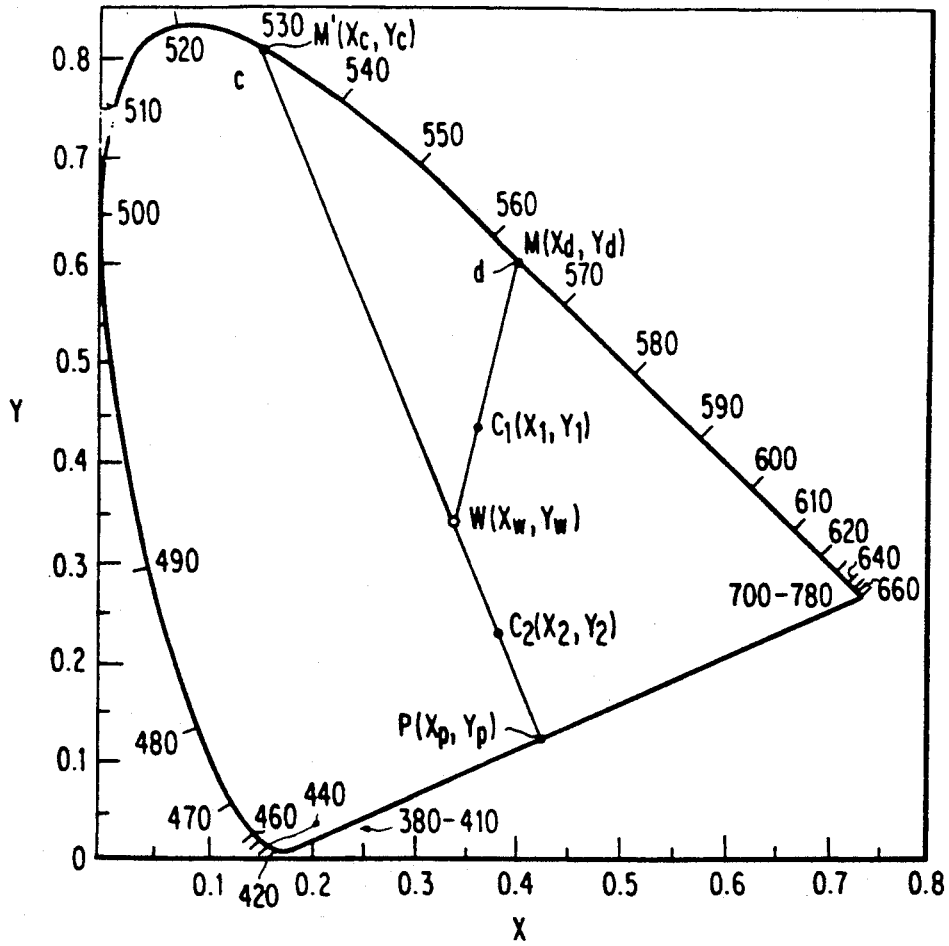
FIG. 2 shows the dominant wavelengths ($\lambda_d$ and $\lambda_c$) of two positive images ($C_1$ and $C_2$) reproduced on a chromaticity diagram.
Figure 3:
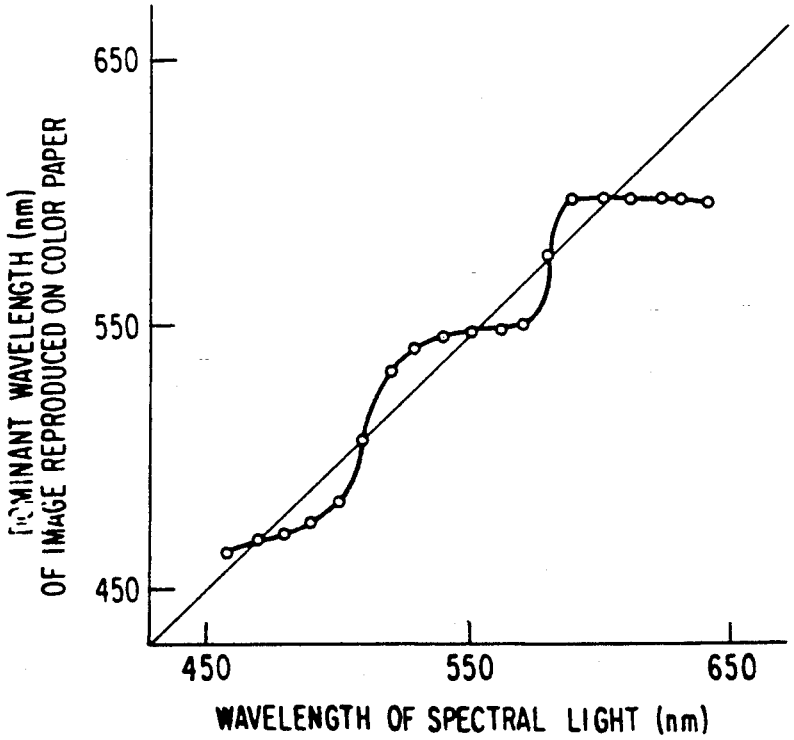
FIG. 3 is a graph showing the relation between the wavelength of the spectral light of the exposure and the dominant wavelength of the image reproduced on color paper as referred to in FIG. 2.

The dominant wavelength of the positive image as reproduced is obtained by plotting on the chromaticity diagram as shown in FIG. 2, and the relation between the spectral light exposure and the wavelength as plotted as shown in FIG. 3.

In the graph of FIG. 3 obtained by the above-mentioned step-1 through step-4, if the wavelength of the spectral light as applied to the photographic light-sensitive material sample to be tested corresponds more closely with the dominant wavelength of the positive image as reproduced on the material sample, or that is, if the relation between the former and the latter may form a straighter line in the graph, it can be said that the color-reproducibility of the material is better.

The present inventors repeatedly and earnestly examined various light-sensitive materials in accordance with the above-mentioned process, and as a result, have found that if a faithful color-reproduction of all spectral lights to cover all the range of a visible light is desired to be attained in the exposure of a color photographic material with a large interlayer effect, the material must satisfy at least one of the above-mentioned conditions (a), (b), (c), and (d).

In the practice of the present invention, an interlayer effect-donor layer is preferably provided in the light-sensitive material in order that the material can satisfy the above-mentioned conditions (a), (b), and/or (c), and conventional reagent for spectral sensitization of silver halides can adequately and selectively be incorporated into the donor layer whereby the determined spectral sensitivity can be imparted to the light-sensitive material. In particular, in the present invention, a compound capable of reacting with the oxidation product of a developing agent as formed by development to release a development inhibitor or a precursor thereof is used as the reagent for providing such interlayer effect. For instance, DIR-couplers (development inhibitor-releasing type couplers), DIR-hydroquinones, as well as couplers capable of releasing DIR-hydroquinones or preoursors thereof, can be used.

In addition, colored couplers and couplers capable of releasing a dye having a determined spectral absorption characteristic can be used for providing the negative interlayer effect of the above-mentioned conditions (a), (b) and (c). Moreover, in the practice of the present invention, the spectral sensitivity distribution of the respective interlayer effect-donor layer can be effected by the use of a sensitizing dye or by means of a filter effect of a filter dye.

Specific examples of the DIR-couplers which can be used in an interlayer effect-donor layer so as to satisfy the above-mentioned conditions (a), (b), (c) and/or (d) to the said layer are compounds as represented by formula (I):

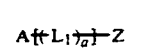

(I)

in which A represents a coupler component (including a colorless coupler or a hydroquinone residual group); Z represents a DI moiety (development inhibiting moiety) of a compound having a development inhibiting action (or a development inhibitor); a represents 0 or 1. When a is 0, Z is directly bonded to A; when a is 1, Z is bonded to A via the linking group $L_1$; and $L_1$ represents a linking group.

As the coupler component (A) in formula (I), coupler components which can react with the oxidation product of a developing agent but do not form any coloring dye, as described for example in U.S. Pat. Nos. 4,052,213, 4,088,491, 3,632,345, and 3,958,993 and Japanese Patent Application (OPI) Nos. 64927/76 and 161237/80, can also be preferably used. The compounds of formula (I), which have the coupler component (A) of this type, can be used in the interlayer effect-donor layer of the materials of the present invention.

Next, the compounds of formula (I) ar explained in further detail hereinafter.

Preferred as the yellow color image-forming coupler residual group (yellow coupler component) for A in formula (I) are pivaloylacetanilide type, benzoylacetanilide type, malondiester type, malondiamine type, dibenzoylmethane type, benzothiazolylacetamido type, malonester-monoamide type, benzothiazolyl-acetate type, benzoxazolylacetamide type, benzoxazolylacetate type, benzimidazolylacetamide type or benzimidazolylacetate type coupler residues; coupler residues derived from hetero ring-substituted acetamides or hetero ring-substituted acetates, as described in U.S. Pat. No. 3,841,880; coupler residual groups derived from acylacetamides as described in U.S. Pat. No. 3,770,446, British Patent 1,459,171, West German Patent (OLS) No. 2,503,099, Japanese Patent Application (OPI) No. 139738/75, and Research Disclosure, RD No. 15737 (May, 1977); or heterocyclic type coupler residual groups as described in U.S. Pat. No. 4,046,574.

As the magenta color image-forming coupler residual group (magenta coupler component) for A, 5-oxo-2-pyrazoline nucleus- or pyrazolo-[1,5-a]benzimidazole nucleus-containing coupler residual group, and cyanoacetophenone type coupler residual groups as well as pyrazolotriazole nucleus-containing group residual groups are preferred.

As the cyan color image-forming coupler residue (cyan coupler component) for A, phenol nucleus- or α-naphthol nucleus-containing coupler residual groups are preferred.

In the practice of the present invention, the compound of the above-mentioned formula (I) is preferably incorporated into the interlayer effect-donor layer. Specifically, it is preferred that the compound of the formula (I) where A is a magenta color-forming coupler component with little cyan coloration is incorporated into the interlayer effect-donor layer for RL so that the value of $\bar{\lambda}_{-R}^{max}$ for RL falls within the range of from about 490 nm to about 560 nm (the above-mentioned requirement (a)); that the compound of the formula (I) where A is a yellow or cyan color-forming coupler component with little magenta coloration is incorporated into the interlayer effect-donor layer for GL so that the value of $\bar{\lambda}_{-G}^{max}$ for GL falls within the range of from about 400 nm to 500 nm and/or from about 570 nm to 570 nm (the above-mentioned requirement (b)); and that the compound of the formula (I) where A is a magenta color-forming coupler component with little yellow coloration is incorporated into the interlayer effect-donor layer for BL so that the value of $\bar{\lambda}_{-B}^{max}$ for BL falls within the range of from about 520 nm to about 590 nm.

As the dominant part of the development inhibitor as represented by Z in the above-mentioned formula (I), there may be mentioned divalent nitrogen-containing heterocyclic groups and nitrogen-containing heterocyclic-thio groups; and the heterocyclic-thio groups can include a tetrazolyl-thio group, a benzthiazolyl-thio group, a benzimidazolyl-thio group, a triazolyl-thio group, an imidazolyl-thio group, etc. Specific examples of these groups are noted below, including illustration of the positions of the substituents $A—(L_1)_a—$ and $—(L_2—Y)_b$.

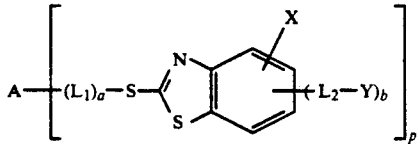

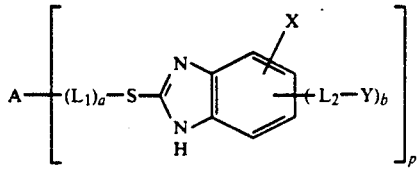

-continued

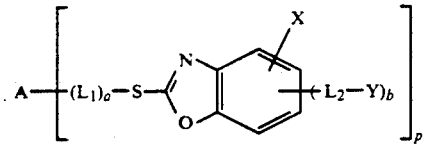

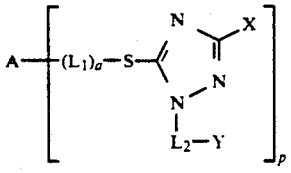

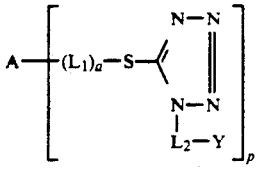

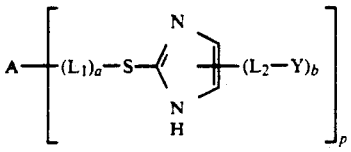

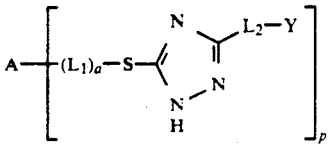

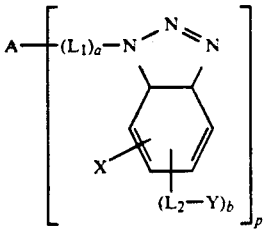

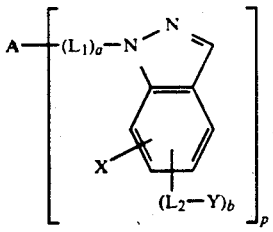

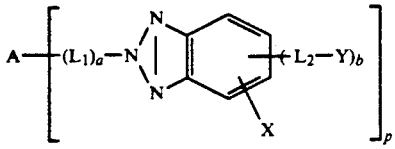

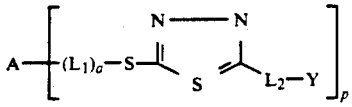

In the above formulae, the substituent X is a part of the group Z in the formula (I), representing a hydrogen atom, a halogen atom, an alkyl group, an alkenyl group, an alkanamido group, an alkenamido group, an alkoxy group, a sulfonamido group, or an aryl group.

Examples of the linking group $L_1$ are noted below, including the substituents A and $Z—(L_2—Y)_b$.

$$A—(—OCH_2—Z—(L_2—Y)_b)_p$$

(Linking group described in U.S. Pat. No. 4,146,396)

$$A—(—SCH_2—Z—(L_2—Y)_b)_p$$

$$A\text{+}SCH_2—Z\text{+}L_2—Y)_b]_p$$

$$A\text{+}O\overset{O}{\overset{\|}{C}}—Z\text{+}L_2—Y)_b]_p$$

(Linking groups described in West German Patent (OLS) No. 2,626,315)

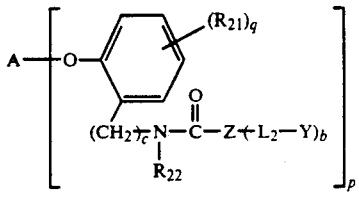

(Linking groups described in West German Patent (OLS) No. 2,855,697; c represents an integer of 0, 1 or 2)

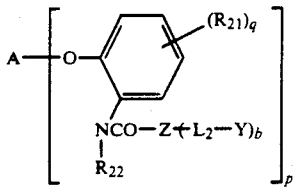

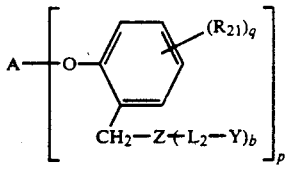

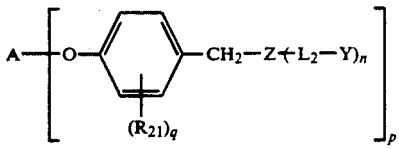

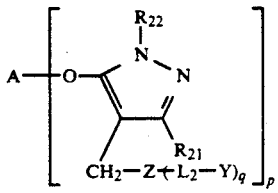

In the above formulae, $R_{21}$ represents a hydrogen atom, a halogen atom, an alkyl group, an alkenyl group, an aralkyl group, an alkoxy group, an alkoxycarbonyl group, an anilino group, an acylamino group, an ureido group, a cyano group, a nitro group, a sulfonamido group, a sulfamoyl group, a carbamoyl group, an aryl group, a carboxyl group, a sulfo group, a cycloalkyl group, an alkanesulfonyl group, an arylsulfonyl group, or an acyl group;

$R^{22}$ represents a hydrogen atom, an alkyl group, an alkenyl group, an aralkyl group, a cycloalkyl group or an aryl group;

p and q each represents 1 or 2; and when q is 2, $R_{21}$ may together form a condensed ring.

The DIR-coupler of this kind (as represented by the formula (I) where a is 1) can react with the oxidation product of a developing agent to release a group which immediately decomposes to release the development inhibitor ($H—Z—(L_2—Y)_b$). Accordingly, the DIR-coupler of this kind has the same effect as the other DIR-coupler not having the group $L_1$ (as represented by formula (I) where a is 0).

In the above-mentioned formulae, the linking group as represented by $L_2$ also includes a chemical bond capable of being cleaved in a developer. Specific examples of such chemical bond are listed in the following Table. These chemical bonds can be cleaved by the action of the nucleophilic reagent contained in a color developer, such as hydroxyl ion or hydroxylamine, whereby the compounds having the chemical bond can display the effect of the present invention.

| Chemical bond in $L_2$ | Reaction for cleaving the bond (Reaction with $OH^-$) |
|---|---|
| —COO— | —COOH— + HO— |
| H<br>—NCOO— | —$NH_2$ + HO— |
| —$SO_2O$—<br>—$OCH_2CH_2SO_2$— | —$SO_3H$ + HO—<br>—OH + $CH_2$=$CHSO_2$— |
| —OC(=O)— | —OH + HO— |
| —NHC(=O)C(=O)— | —$NH_2$ + HO— |

The divalent linking groups as listed in the above Table are, either directly or via an alkylene group and/or a phenylene group, linked with the group Z at one bond and are directly linked with the group Y at the other bond. In the case that the group is linked with the group Z via an alkylene group or a phenylene group, the divalent group may contain an ether bond, an amido bond, a carbonyl group, a thioether bond, a sulfone group, a sulfonamido bond and/or an urea bond.

Preferred examples of the linking group as represented by $L_2$ are mentioned below, where the position of each of the groups Z and Y are also shown.

$—Z—(CH_2)_d—COO—Y$ $—Z—(CH_2)_d—COO—Y$

-continued $—Z—(CH_2)_d—OC(=O)—Y$

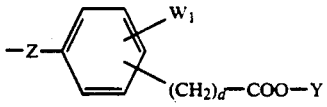

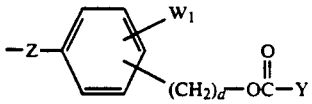

$—Z—(CH_2)_2—NHCOO—Y$ $—Z—(CH_2)_d—OC(=O)NH—Y$ $—Z—NHC(=O)—(CH_2)_dC(=O)—Y$

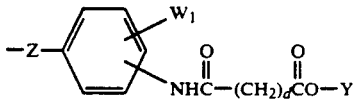

$—Z—(CH_2)_e—COOCH_2CH_2SO_2—Y$

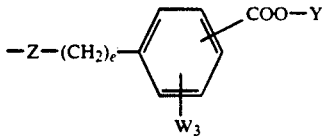

$—Z—NCOO—Y$ ($W_2$)

$—Z—N—COCO—Y$ ($W_2$)

In these formulae, d represents an integer of from 0 to 10, preferably from 0 to 5; $W_1$ is selected from a hydrogen atom, a halogen atom, an alkyl group having from 1 to 10 carbon atoms, preferably from 1 to 5 carbon atoms, an alkanamido group having from 1 to 10 carbon atoms, preferably from 1 to 5 carbon atoms, an alkoxy group having from 1 to 10 carbon atoms, preferably from 1 to 5 carbon atoms, an alkoxycarbonyl group having from 1 to 10 carbon atoms, preferably from 1 to 5 carbon atoms, an aryloxycarbonyl group, an alkanesulfonamido group having from 1 to 10 carbon atoms, preferably from 1 to 5 carbon atoms, an aryl group, a carbamoyl group, an N-alkylcarbamoyl group having from 1 to 10 carbon atoms, preferably from 1 to 5 carbon atoms, a nitro group, a cyano group, an arylsulfonamido group, a sulfamoyl group, an imido group, etc.; $W_2$ represents a hydrogen atom, an alkyl group having from 1 to 6 carbon atoms, an aryl group or an alkenyl group; $W_3$ represents a hydrogen atom, a halogen atom, a nitro group, an alkoxy group having from 1 to 6 carbon atoms or an alkyl group; e represents an integer of from 0 to 6.

The alkyl or alkenyl group as represented by X and Y is specifically a linear, branched or cyclic alkyl or alkenyl group having from 1 to 10 carbon atoms, preferably from 1 to 5 carbon atoms, and the group preferably has substituent(s). The substituent is selected from a halogen atom, a nitro group, an alkoxy group having from 1 to 4 carbon atoms, an aryloxy group having from 6 to 10 carbon atoms, an alkanesulfonyl group having from 1 to 4 carbon atoms, an arylsulfonyl group having from 6 to 10 carbon atoms, an alkanamido group having from 1 to 5 carbon atoms, an anilino group, a benzamido group, a $C_{1-16}$ alkyl-substituted carbamoyl group, a carbamoyl group, a $C_{6-10}$ aryl-substituted carbamoyl group, an alkylsulfonamido group having from 1 to 4 carbon atoms, an arylsulfonamido group having from 6 to 10 carbon atoms, an alkyl-thio group having from 1 to 4 carbon atoms, an aryl-thio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 4 carbon atoms, an alkanoyl group having from 1 to 4 carbon atoms, a benzoyl group, an alkanoyloxy group having from 1 to 4 carbon atoms, a benzoyloxy group, a perfluoroalkyl group having from 1 to 4 carbon atoms, a cyano group, a tetrazolyl group, a hydroxyl group, a carboxyl group, a mercapto group, a sulfo group, an amino group, an alkylsulfamoyl group having from 1 to 4 carbon atoms, an arylsulfamoyl group having from 6 to 10 carbon atoms, a morpholino group, an aryl group having from 6 to 10 carbon atoms, a pyrrolidinyl group, an ureido group, an urethane group, a $C_{1-6}$ alkoxy-substituted carbonyl group, a $C_{6-10}$ aryloxy-substituted carbonyl group, an imidazolidinyl group, an alkylidenamido group having from 1 to 6 carbon atoms, etc.

The alkanamido or alkenamido group as represented by X and Y is a linear, branched, or cyclic alkanamido or alkenamido group having from 1 to 10 carbon atoms, preferably from 1 to 5 carbon atoms, and the group may have substituent(s). The substituent can be selected from the group referred to as the substituents for the alkyl and alkenyl groups in the above.

The alkoxy group as represented by X is a linear, branched or cyclic alkoxy group having from 1 to 10 carbon atoms, preferably from 1 to 5 carbon atoms, and the group may have substituent(s). The substituent can be selected from the group referred to as the substituents for the alkyl and alkenyl groups in the above.

The aryl group as represented by Y includes a phenyl group or a naphthyl group. The group can be substituted, and the substituent for this can be selected from the groups referred to as the substituents for the alkyl and alkenyl groups in the above, and additionally an alkyl group having from 1 to 4 carbon atoms.

The heterocyclic group as represented by Y can be selected from a diazolyl group (e.g., a 2-imidazolyl group, a 4-pyrazolyl group, etc.), a triazolyl group (e.g., a 1,2,4-triazol-3-yl group, etc.), a thiazolyl group (e.g., a 2-benzothiazolyl group, etc.), an oxazolyl group (e.g., a 1,3-oxazol-2-yl group, etc.), a pyrrolyl group, a pyridyl group, a diazinyl group (e.g., a 1,4-diazin-2-yl group, etc.), a triazinyl group (e.g., 1,2,4-triazin-5-yl, etc.), a furyl group, a diazolinyl group (e.g., an imidazolin-2-yl group, etc.), a pyrrolyl group, thienyl group, etc.

Examples of especially preferred compounds ar described in Japanese Patent Application Nos. 113596/85 and 281295/85, etc.

The DIR coupler of the formula (I) is used preferably in an amount of from $1\times10^{-4}$ g to 1 g per $m^2$ of the photo-sensitive layer.

The DIR coupler may be used together with an image-forming coupler preferably in an amount of from $1\times10^{-3}$ g to 1 g per g of the image-forming coupler. The DIR coupler may be used preferably in an amount of from $1\times10^{-4}$ g to 0.5 g per $m^2$ of an interlayer, an antihalation layer, etc.

Specific examples of the couplers of the above-mentioned formula (I) are set forth below, which, however, are not intended to restrict the scope of the present invention.

Cyan Coupler:

C-1

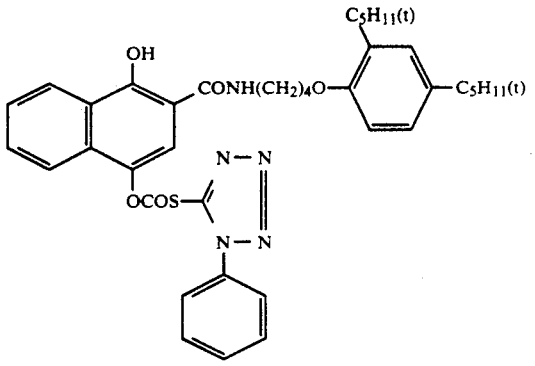

C-2

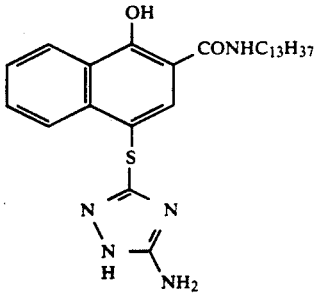

C-3

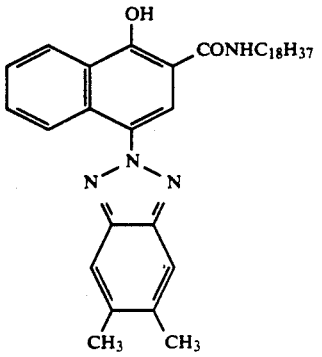

-continued
Cyan Coupler:
C-4
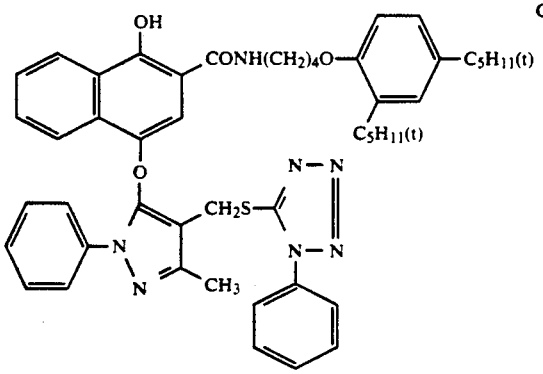
C-5
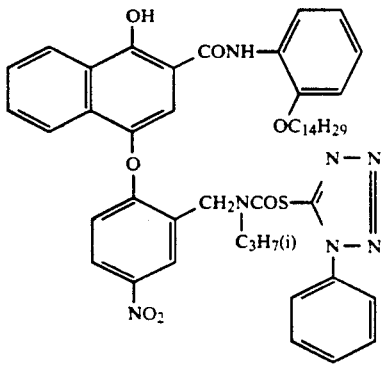
C-6
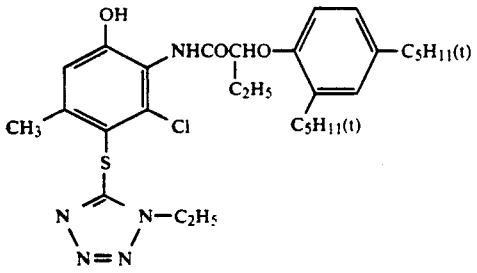
C-7
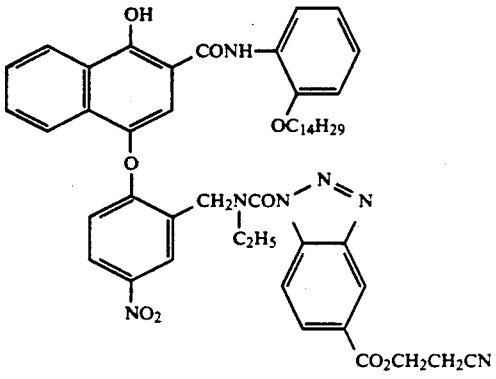
-continued
Cyan Coupler:
C-8
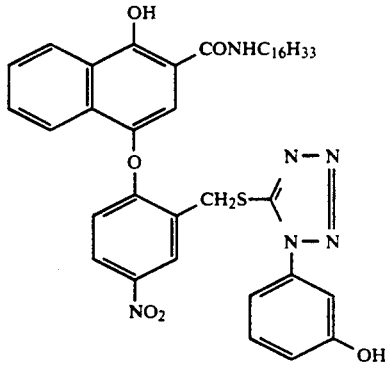
C-9
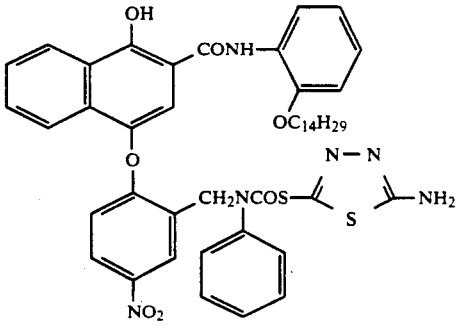
C-10
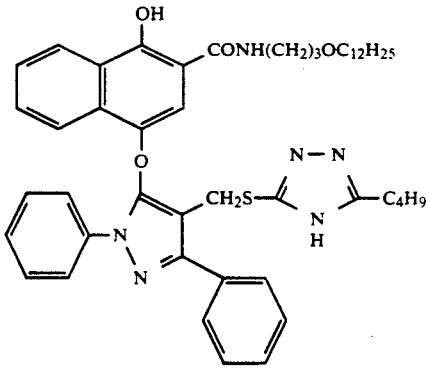
C-11
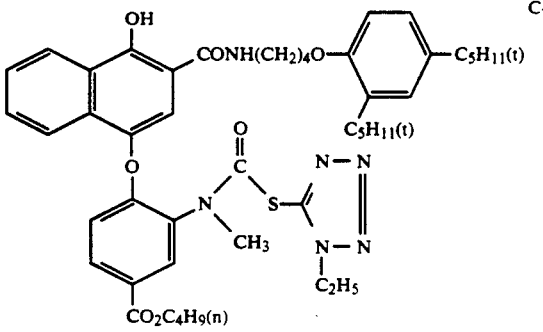

Magenta Coupler:
M-1
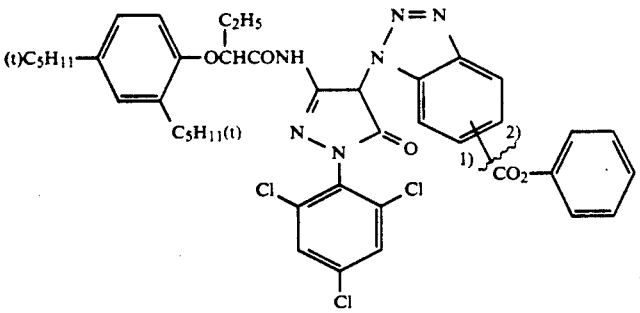
M-2
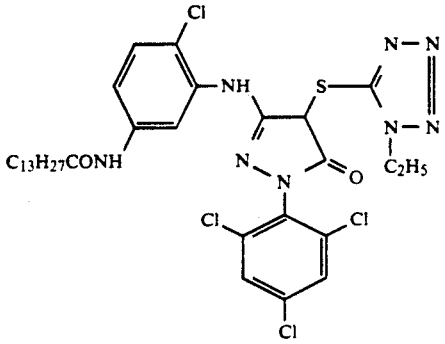
M-3
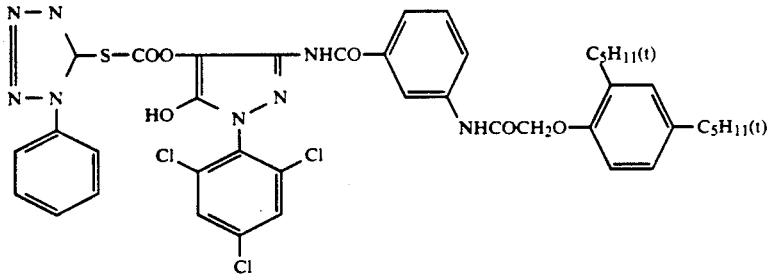
M-4
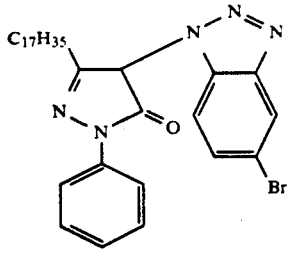
M-5
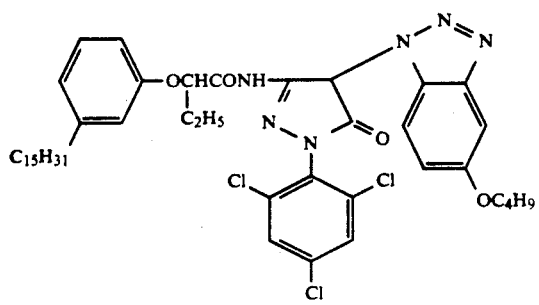

-continued
Magenta Coupler:
M-6
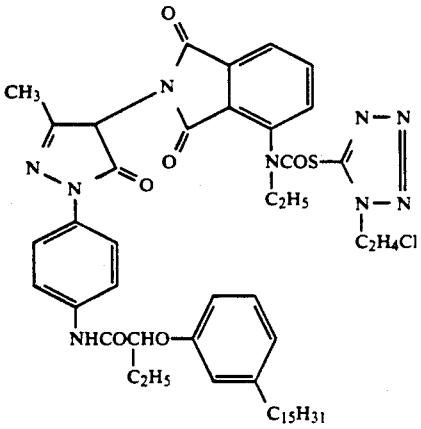
M-7
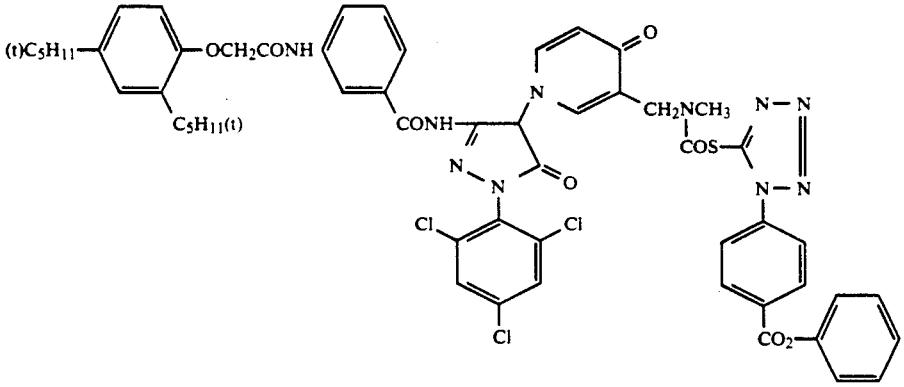
M-8
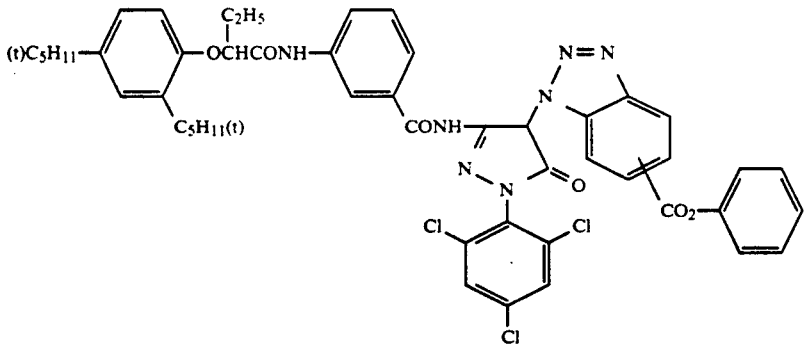
M-9
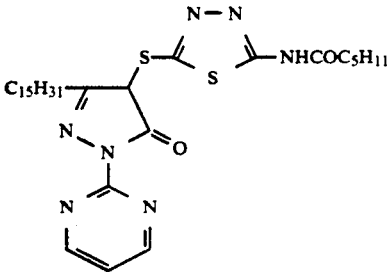

-continued
Magenta Coupler:
M-10
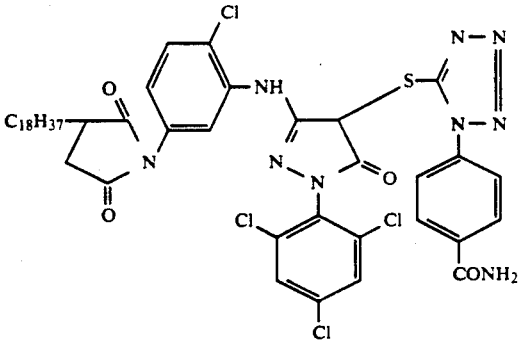
M-11
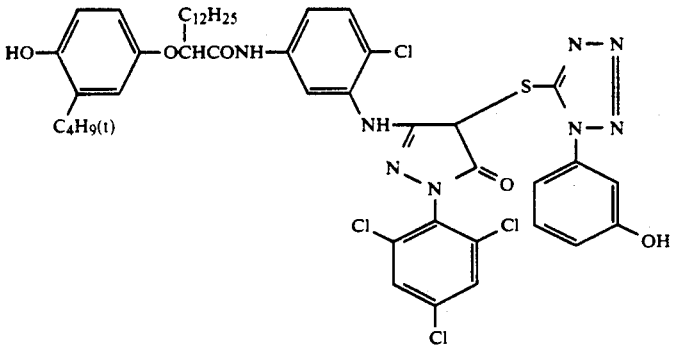
The mark " " in the formula (for example, in M-1) represents that a substituent is substituted at 1) or 2) position.
Yellow Coupler:
Y-1
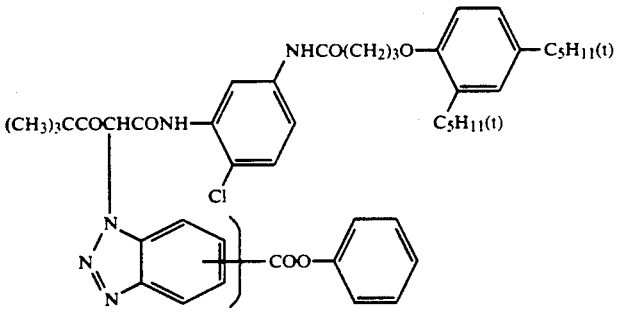
Y-2
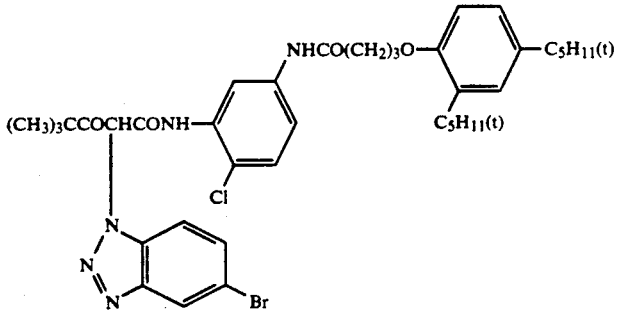

-continued
Y-3
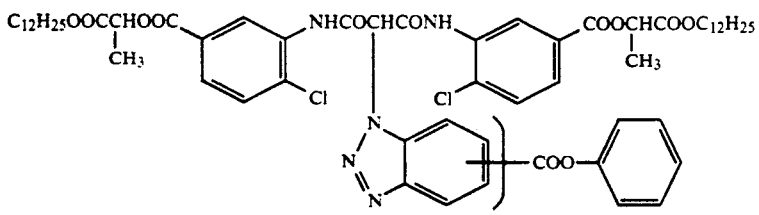
Y-4
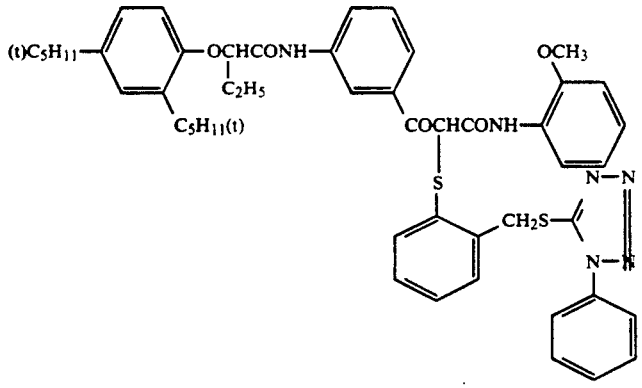
Y-5
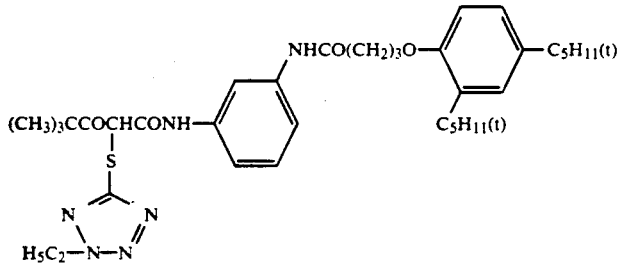
Y-6
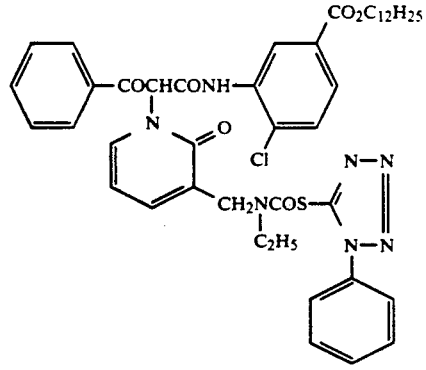
Y-7
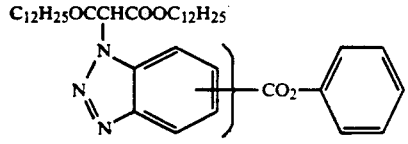

-continued
Y-8
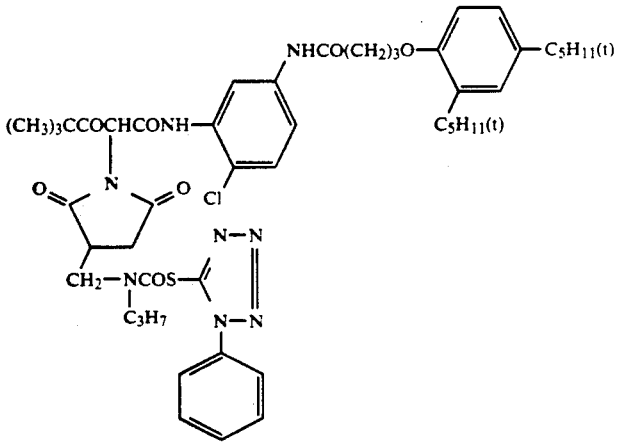
Y-9
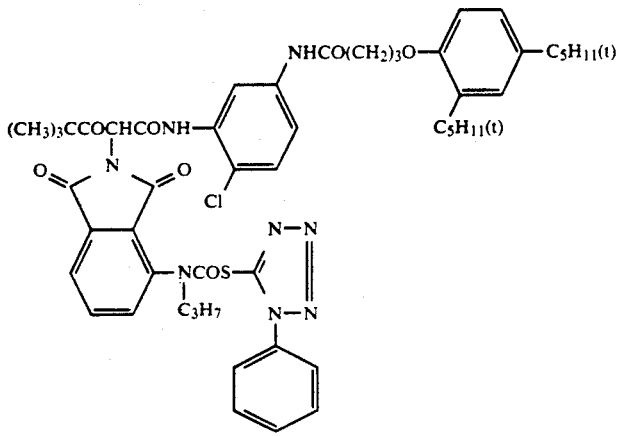
Y-10
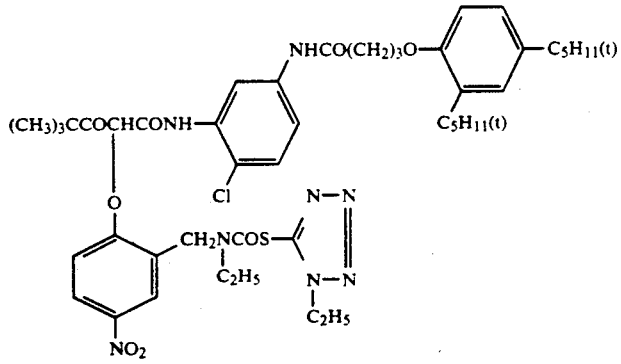
Y-11
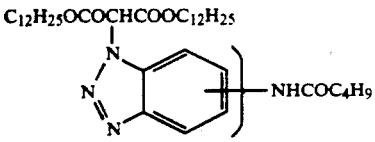
Y-12
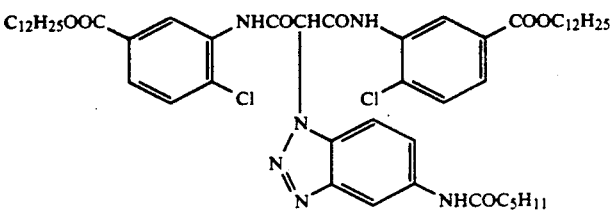

-continued
Y-13
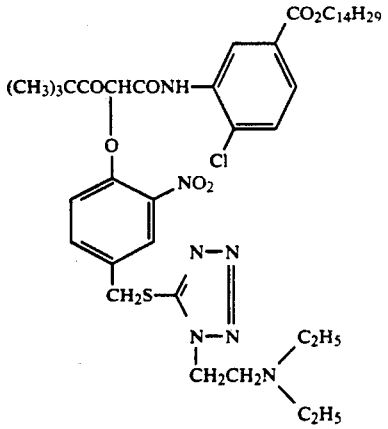
Y-14
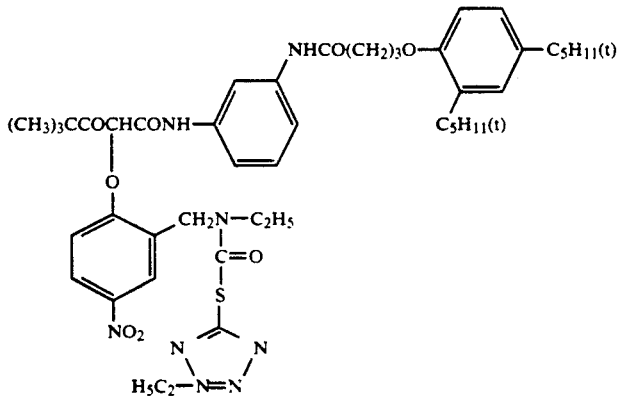
Y-15
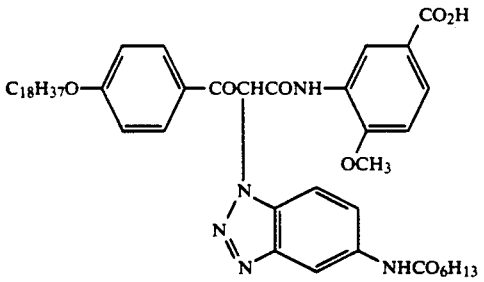
Y-16
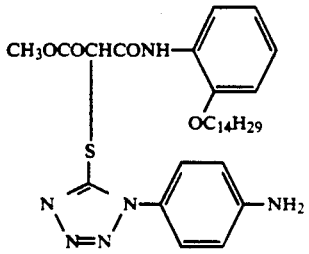

-continued
Y-17
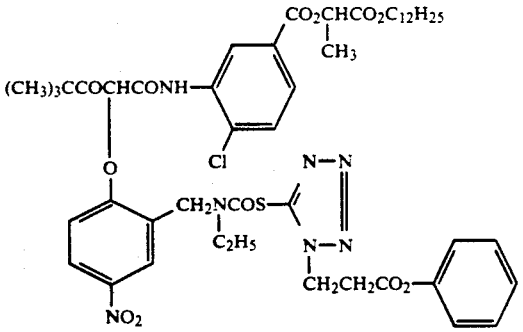
Y-18
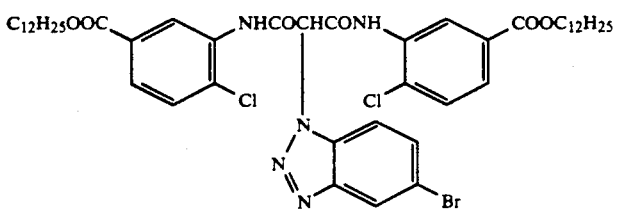
Y-19
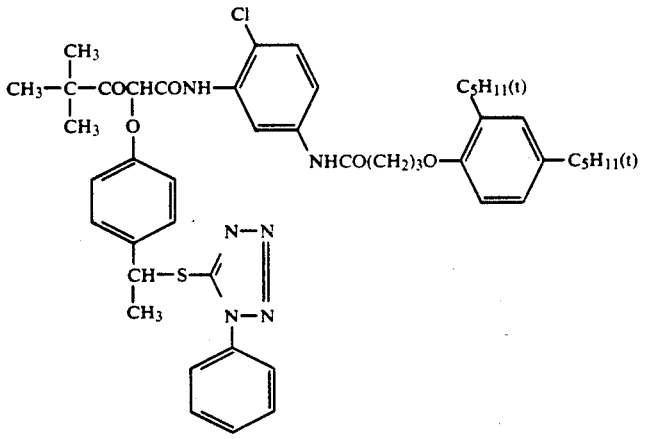
Y-20
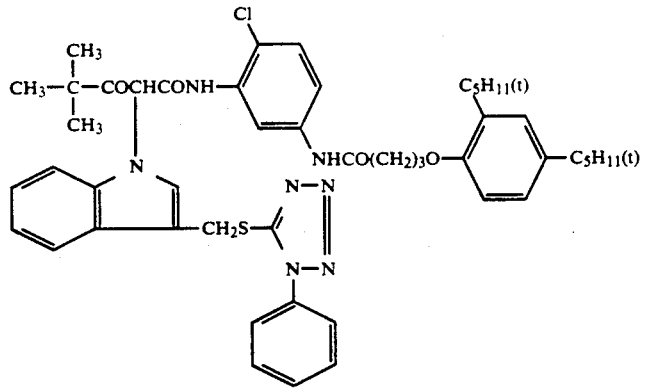

Colorless Coupler:

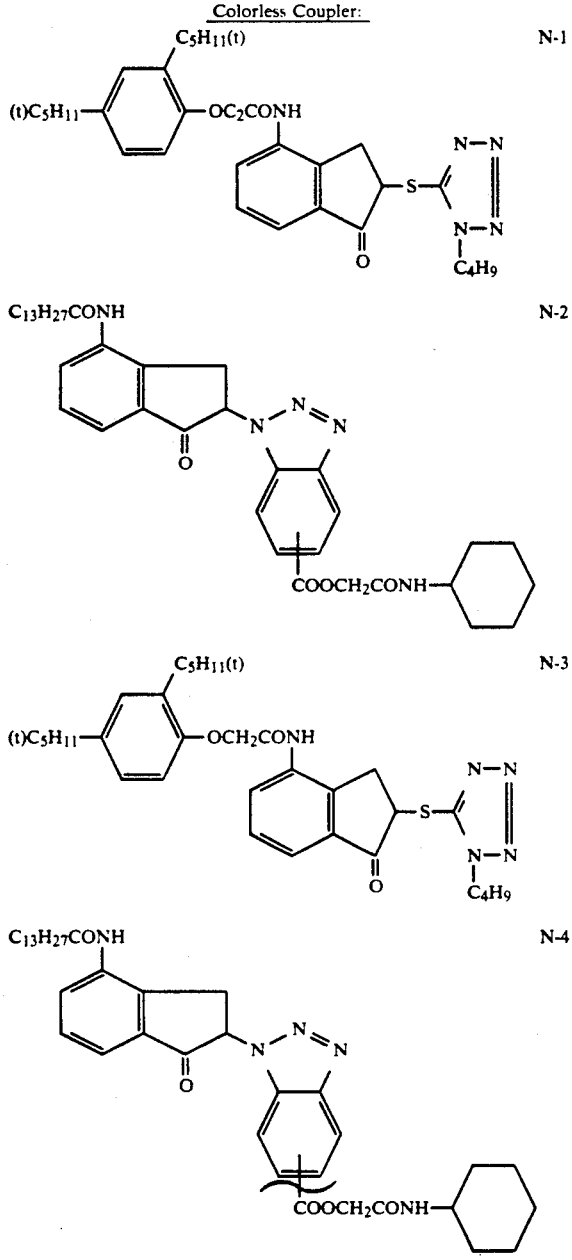

For incorporation of the coupler of the present invention into the interlayer effect-donor layer or light-sensitive layer, a conventional method which is known as an oil-protective method can be used. Preferably, a polymer which is soluble in a water-insoluble organic solvent can be used as a dispersion medium, for example, as described in Japanese Patent Publication No. 30494/73. In particular, when DIR-couplers are used, the interlayer effect with respect to other layers is characteristic of imagewise action.

The provision of the interlayer effect-donor layer is preferably in the side of the surface of the light-sensitive layer to which the interlayer effect is to be imparted and near the said light-sensitive layer. For instance, it is preferred that the interlayer effect-donor layer for RL is provided in the side of the surface of the RL and near to the yellow filter layer in the side of the support. GL can be provided between the interlayer effect-donor layer for GL and RL or in the side of the support from RL. For example, the interlayer effect-donor layer of from 400 nm to 500 nm for GL can be provided in the side of the surface of the GL, or in the side of the surface of the yellow filter layer, or as an upper or lower layer of BL or as a part of BL itself. The interlayer effect-donor layer of from 570 nm to 670 nm for GL can preferably be provided as an upper layer of the GL and in the side of the support from the yellow filter layer. In addition, it is also preferred that the RL of high sensitivity itself is provided as the donor layer. The interlayer effect-donor layer for BL can also be provided as a part of GL itself or adjacent to the yellow filter layer in the side of the support. Also, the RL layer itself can be provided as the donor layer.

In accordance with the position of the interlayer effect-donor layer and that of the corresponding interlayer effect-acceptor layer, the activation speed and the diffusibility of the development inhibitor, which is released from the DIR-compound by the reaction of the compound with the oxidation product of a developing agent during color development, can be adequately selected, and thus the desired effects of the present invention can be attained.

In the interlayer effect-donor layer, the development inhibitor-releasing type compound which preferably has a diffusibility of more than 0.4 is incorporated, as described in Japanese Patent Application No. 7150/83. In the compounds of the formula (I), the diffusibility of the development inhibitor part as represented by Z can be measured by the method as described hereunder. It is preferred that a diffusible DIR-compound having a substituent capable of being hydrolyzed under an alkaline condition on the part of B, since the said DIR compound can be converted into a compound which does not inhibit the development, after released and transfer into the processing solution. The hydrolyzing type DIR-compound of such kind can be bonded to the coupler component (A) directly (a=0) or via a timing group (a=1).

Further, in the present invention, since the cyan sensitivity curve somewhat has a positive sensitivity in the wavelength range of from about 400 nm to about 470 nm, as shown by the colorimetric spectral sensitivity curve in FIG. 1, a cyan coupler or a cyan color-forming DIR-coupler is incorporated in BL so as to compensate the said positive sensitivity, as defined in the above-mentioned condition (d), thereby to give a slight cyan image. The cyan color-forming DIR-coupler for use for this purpose can be properly selected from the above-mentioned DIR-couplers of the formula (I) where A is a cyan coupler component (residual group). The cyan couplers for A can properly be selected from the cyan couplers for RL, which are noted below.

The "slight cyan image" as herein referred to can be determined in the same manner as the above-mentioned method for the measurement of the faithfulness of the color-reproducibility, although this varies, depending upon the spectral absorption characteristics of the yellow, magenta and cyan coloring dyes used, the spectral absorption characteristic of the color coupler used, and especially the spectral sensitivity characteristics of BL and RL and the degree of the color-mixing of the respective layers. For example, when the yellow series image density ($D_B$ exclusive of fog and base density) is 1.0, the cyan image density ($D_R$) is preferably from 0.1 to 0.4.

It has been found most preferable that the above-mentioned conditions (a) and (b) are both satisfied, together with at least one of the conditions (c) and the requirement (d), and that the spectral sensitivity distribution of BL has the maximum sensitivity between 420 nm and 460 nm in the sensitivity range of from 400 nm to 520 nm, the spectral sensitivity distribution of GL has the maximum sensitivity between 530 nm and 550 nm in the sensitivity range of from 470 nm to 600 nm and the spectral sensitivity distribution of RL has the maximum sensitivity between 605 nm and 640 nm in the sensitivity range of from 540 nm to 700 nm.

Next, the diffusibility of the development inhibiting substances as herein referred to will be explained below.

The diffusibility of the development inhibiting substances can be measured by the following method.

In the first place, a multilayer color photographic light-sensitive material (Sample B) is prepared, which has the layers comprising the compositions as shown below on a transparent support.

First Layer: Red-sensitive Silver Halide Emulsion Layer

A gelatin-coating solution comprising a silver iodobromide emulsion (silver iodide: 5 mol %, mean grain size: 0.4 μm) to which the Sensitizing Dye I of the Example 1 had been added in an amount of $6\times10^{-5}$ mol per mol of the silver so as to impart color-sensitivity to the emulsion and the Coupler C-2 in an amount of 0.0015 mol per mol of the silver was coated (dry film thickness: 2 μm).

Coupler C-2

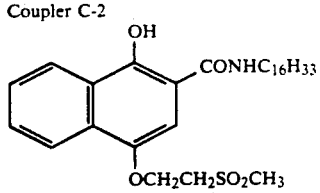

Second Layer

A gelatin layer containing the same silver iodobromide emulsion (with no red-sensitivity) as used in the first layer and polymethyl methacrylate grains (diameter: about 1.5 μm) was formed. (Amount of silver coated: 2 g/m², dry film thickness: 1.5 μm)

Each layer contained a gelatin hardener and a surfactant in addition to the above-mentioned composition.

In the same manner as the preparation of the Sample B, except that the second layer did not contain the silver iodobromide emulsion layer, Sample A was prepared.

The Samples A and B thus obtained were, after wedge-wise exposure, processed in accordance with the steps as shown below, whereupon the development time was 2 minutes and 10 seconds. To the developer was added the development inhibitor as shown below until the color density obtained in the Sample A became reduced to ½. Through the addition of the development inhibitor, the diffusibility of the development inhibitor in the silver halide emulsion film was determined from the value of the decrease of the color density of the Sample B. The results are shown in the following Table 1.

TABLE 1

| Development Inhibitor | Diffusibility of Development Inhibitor: Amount of Developer Added (M) | Reduction of Density (%): Sample A | Reduction of Density (%): Sample B | Diffusibility (=B/A) |
|---|---|---|---|---|
| 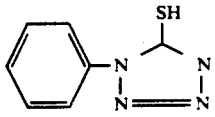 | $0.75\times10^{-4}$ | 50 | 10 | 0.20 |
| 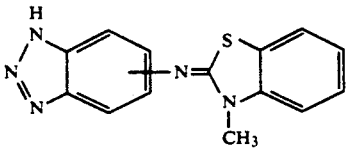 | $0.5\times10^{-4}$ | 50 | 15 | 0.30 |
| 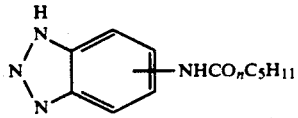 | $2.5\times10^{-4}$ | 50 | 42 | 0.84 |
| 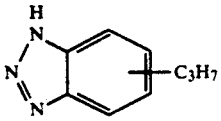 | $1.5\times10^{-4}$ | 55 | 34 | 0.62 |
| 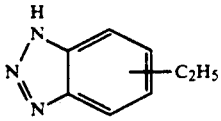 | $2\times10^{-4}$ | 52 | 36 | 0.69 |

TABLE 1-continued

| Development Inhibitor | Diffusibility of Development Inhibitor: Amount of Developer Added (M) | Reduction of Density (%) Sample A | Sample B | Diffusibility (=B/A) |
|---|---|---|---|---|
| 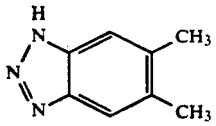 | $2 \times 10^{-4}$ | 50 | 35 | 0.70 |
| 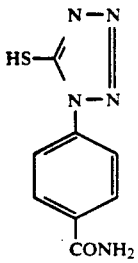 | $2.0 \times 10^{-4}$ | 48 | 21 | 0.44 |
| 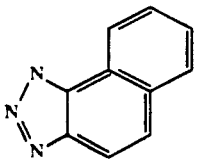 | $3.0 \times 10^{-4}$ | 47 | 41 | 0.88 |

As is clear from Table 1, the development inhibitor having a higher diffusibility is required to be added in a larger amount in order to obtain the same degree of development inhibition. This means that the diffusibility of the development inhibitor in the silver halide film in a light-sensitive material is in inverse proportion to the inhibitability of the same development inhibitor.

The development process applied at 38° C. to the Samples comprised the following steps.

| | |
|---|---|
| 1. Color Development | 3 min 15 sec |
| 2. Bleaching | 6 min 30 sec |
| 3. Rinsing | 3 min 15 sec |
| 4. Fixation | 6 min 30 sec |
| 5. Rinsing | 3 min 15 sec |
| 6. Stabilization | 3 min 15 sec |

The compositions of the processing solutions used in the respective steps are as follows:

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 liter |
| Bleaching Agent: | |
| Ammonium Bromide | 160.0 g |
| Aqueous Ammonia (28 wt %) | 25.0 ml |
| Sodium Ethylenediamine-tetraacetate Iron Salt | 130 g |
| Glacial Acetic Acid | 14 ml |
| Water to make | 1 liter |
| Fixing Solution: | |
| Sodium Tetrapolyphosphate | 2.0 g |
| Sodium Sulfite | 4 0 g |
| Ammonium Thiosulfate (70 wt %) | 175.0 ml |

-continued

| | |
|---|---|
| Sodium Bisulfite | 4.6 g |
| Water to make | 1 liter |
| Stabilizer Solution: | |
| Formalin (37 wt % formaldehyde solution) | 8.0 ml |
| Water to make | 1 liter |

As the silver halide emulsions for the above-mentioned negative interlayer effect-donor layers and the light-sensitive layers which will be explained hereinafter, any silver halide including silver bromide, silver iodobromide, silver iodochlorobromide, silver chlorobromide and silver chloride can be used. Preferred silver halides are silver iodobromides or silver iodochlorobromides containing silver iodide in an amount of about 30 mol % or less. Especially preferred silver halides are silver iodobromides containing silver iodide in an amount of from about 2 mol % to about 25 mol %.

The silver halide grains may be fine grains having a grain size of about 0.1 μm or less or may be large-size grains having a grain size (diameter of protect area) of up to about 10 μm; and the silver halide emulsions may be monodispersed emulsions having a narrow distribution or may be polydispersed emulsions having a broad distribution.

The silver halide photographic emulsions for use in the present invention can be prepared by means of known methods, for example, in accordance with the methods described in *Research Disclosure*, RD No. 17643 (December, 1978), pp. 22-23, "I. Emulsion Preparation and Types", and ibid., No. 18716 (November, 1979), page 648.

The silver halide photographic emulsions for use in the present invention can be prepared using the methods described, for example, in P. Glafkides, *Chimie et Physique Photographique* (published by Paul Montel, 1967): G. F. Duffin, *Photographic Emulsion Chemistry*

(published by Focal Press, 1966); V. L. Zelikman et al., *Making and Coating Photographic Emulsion* (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver balide grains in the existence of excess silver ions can be employed. As one system of the double jet method type, a so-called controlled double jet method of keeping a constant pAg in a liquid phase of forming silver halide grains can also be employed. According to the method, a silver halide emulsion containing silver halide grains having a regular crystal form and almost uniform grain sizes can be obtained.

Two or more kinds of silver halide emulsions which were separately formed can be blended.

The silver halide emulsion comprising the above-mentioned regular grains can be obtained by controlling the pAg and pH during the formation of the grains. The detail is described, for example, in *Photographic Science and Engineering*, Vol. 6, pp. 159-165 (1962); *Journal of Photographic Science*, Vol. 12, pp. 242-251 (1964); U.S. Pat. No. 3,655,394 and British Patent 1,413,748.

The silver halide grains in the photographic emulsions for use in the present invention may have a regular crystal form such as cubic, octahedral, tetradecahedral, etc., or an irregular crystal form such as spherical, or may have a crystal form with crystal defect such as twin plane, or further may be a composite form of these crystal forms.

As a monodispersed emulsion, typical emulsion contains silver halide grains having a mean grain diameter of about 0.1 μm or more, at least 95% by weight of the silver halide grains having a grain size falling within the scope of the mean grain diameter ±40%. In the present invention, such an emulsion can be used that contains silver halide grains having a mean grain diameter of from about 0.25 μm to about 2 μm, at least about 95% by weight or by number of the silver halide grains having a grain size falling within the scope of the mean grain diameter ±20%. The method for preparing the said emulsion is described, for example, in U.S. Pat. Nos. 3,574,628 and 3,655,394 and British Patent 1,413,748. In addition, monodispersed emulsions as described, for example, in Japanese Patent Application (OPI) Nos. 8600/73, 39027/76, 83097/76, 137133/78, 48521/79, 99419/79, 37635/83, 49938/83, etc., can also be preferably used in the present invention.

Also, tabular silver halide grains having an aspect ratio of about 5 or more (i.e., 5/1 or more) can be used in the present invention. The tabular grains can easily be prepared using the methods as described, for example, in Gutoff, *Photographic Science and Engineering*, Vol. 14, pp. 248-257 (1970); U.S. Pat. Nos. 4,434,226, 4,414,310, 4,433,048 and 4,439,520, British Patent 2,122,157, etc. The use of the tabular grains is advantageous in the improvement of the efficiency of the color sensitization by the use of sensitizing dyes, the improvement of the graininess, and the elevation of the sharpness, which is described in detail, for example, in the above-mentioned U.S. Pat. No. 4,434,226, etc.

The crystal structure of the silver halide grains may be uniform, or the grains may differ in the halogen composition between the inside and the surface layer thereof, or the grains may have a multiphase structure. These emulsion grains are illustrated, for example, in British Patent 1,027,146, U.S. Pat. Nos. 3,505,068 and 4,444,877, Japanese Patent Application (OPI) No. 14335/85, etc. In addition, the grains may have a function structure comprising different silver halide compositions as conjugated by epitaxial junction, or the grains may have other compounds than silver halides, for example, silver rhodanide, lead oxide, etc., as conjugated. These emulsion grains are illustrated, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, Japanese Patent Application (OPI) No. 162540/84, etc.

Further, a mixture comprising grains of various crystal forms can also be used in the present invention.

The emulsions to be used in the present invention are generally those which have been physically ripened, chemically ripened, and/or spectrally sensitized. Additives which may be used in the steps of physical-ripening, chemical-ripening and spectral-sensitization are described, e.g., in *Research Disclosure*, RD Nos. 17643 (December, 1978) and 18716 (November, 1979), and the relevant parts therein are also listed in the following Table.

| No. | Kind of Additives | RD 17643 | RD 18716 |
|---|---|---|---|
| 1. | Chemical Sensitizer | p. 23 | p. 648, right-column |
| 2. | Sensitivity Enhancement | | " |
| 3. | Spectral Sensitizer Supersensitizer | pp. 23-24 | from p. 648, right-column to p. 649, right-column |
| 4. | Whitener | p. 24 | |
| 5. | Anti-foggant Stabilizer | pp. 24-25 | p. 649, right-column |
| 6. | Light-absorbent Filter Dye Ultraviolet-absorbent | pp. 25-26 | from p. 649, right-column to p. 650, left-column |
| 7. | Stain-inhibitor | p. 25, right-column | p. 650, left to right-column |
| 8. | Color Image Stabilizer | p. 25 | |
| 9. | Hardener | p. 26 | p. 651, left-column |
| 10. | Binder | p. 26 | " |
| 11. | Plasticizer Lubricant | p. 27 | p. 650, right-column |
| 12. | Coating Assistant Surfactant | pp. 26-27 | " |
| 13. | Antistatic Agent | p. 27 | " |

For the spectral sensitization of the wavelength range of each of BL, GL, and RL and the interlayer effect-donor layers which are preferably provided so as to satisfy the above-mentioned requirements (a) to (c) of the present invention, methine dyes can be used adequately in combination. The dyes used for the purpose include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. For these dyes can be applied various nuclei which are usually utilized for cyanine dyes as basic heterocyclic nuclei. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. Each of these nuclei may be substituted on the carbon atom of the dye.

For the merocyanine dyes or complex merocyanine dyes can be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

The above-described sensitizing dyes can be used solely or as a combination thereof. A combination of sensitizing dyes is frequently used for the purpose of super color sensitization.

Also, super color sensitizing agents can also be used. In addition, the compensation by the filter effect of a dye can be applied to the wavelength distribution of the spectral sensitization of the interlayer effect-donor layers for use in the present invention. For instance, the sensitizing dyes described in Japanese Patent Application (OPI) No. 34541/86 and Japanese Patent Application No. 651/86 can be selectively used for the spectral sensitization in the wavelength range of from about 490 nm to about 560 nm or from about 520 nm to about 570 nm. Also, the sensitizing dyes described in U.S. Pat. No. 3,672,898 can be selectively used for the spectral sensitization in the wavelength range of from about 400 nm to about 500 nm. Further, the sensitizing dyes described in U.S. Pat. No. 3,672,898, Japanese Patent Publication Nos. 25653/73 and 44368/80, etc., can be selectively used for the spectral sensitization in the wavelength range of from about 570 nm to about 670 nm.

In the practice of the present invention, the interlayer effect-donor layers can be provided by using the above-noted silver halide emulsions, methods of spectral-sensitization, DIR-compounds, and dyes as described.

In the above explanation, although the preferred embodiments of the present invention where the above-mentioned requirements (a), (b) and (c) are satisfied by the provision of the interlayer effect-donor layers, apart from the emulsion layers (BL, GL, RL) are concretely illustrated, the emulsion layers (BL, GL, RL) themselves can also be made to satisfy these conditions.

The above-described sensitizing dyes are used preferably in an amount of from $1\times10^{-6}$ to $5\times10^{-3}$ mol, more preferably from $1\times10^{-5}$ to $1\times10^{-4}$ mol per mol of silver halide.

Next, the silver halide emulsion layers (BL, GL, RL) of the light-sensitive materials of the present invention will be explained in detail hereunder.

The emulsion layers of the present invention can contain, in general, various couplers which will be mentioned below, in addition to the above-mentioned DIR-couplers. For example, the couplers which can be incorporated into the emulsion layers of the present invention include image-forming couplers, weakly diffusible dye-forming couplers (e.g., the couplers described in U.S. Pat. Nos. 4,522,915 and 4,420,556, etc.), development inhibitor- or antifoggant-releasing couplers (e.g., the couplers described in U.S. Pat. Nos. 4,390,618 and 4,518,682, etc.), colored couplers (e.g., the couplers described in U.S. Pat. Nos. 4,004,929, 4,138,258 and 4,070,191, etc.), competing couplers (e.g., the couplers described in U.S. Pat. No. 4,130,427, etc.), multi-equivalent couplers (e.g., the couplers described in U.S. Pat. Nos. 4,283,472, 4,338,393, 4,310,618, etc.), DIR-redox compound-releasing couplers (e.g., the couplers described in Japanese Patent Application (OPI) No. 185950/85), couplers capable of releasing a dye which can re-color after having been released (e.g., the couplers described in European Patent- Laid-Open Application No. 173,302), and various kinds of polymer couplers (e.g., the couplers described in U.S. Pat. Nos. 3,767,412, 3,623,871, 4,367,282, and 4,474,870, etc.).

The dyes to be formed from the couplers can be any of yellow, magenta and cyan colors. For instance, the yellow couplers include acylacetamide type couplers and malondiamide type couplers; the magenta couplers include 5-pyrazolone type couplers, pyrazolonimidazole type couplers and pyrazolotriazole type couplers; and the cyan couplers include phenol type couplers and naphthol type couplers. These may be 4-equivalent couplers or 2-equivalent couplers. In addition, these may be couplers which do not substantially form any dye, and examples of such couplers are the couplers described in U.S. Pat. Nos. 3,958,993, 3,961,959, 4,315,070, 4,183,752 and 4,171,223, etc.

The couplers of the present invention are used preferably in an amount of from $1\times10^{-3}$ g to 10 g, more preferably from $1\times10^{-2}$ g to 1 g per $m^2$ of each silver halide emulsion layer, or preferably from $1\times10^{-2}$ to 10 equivalent per mol of silver halide in each silver halide emulsion layer. The couplers may be incorporated in an interlayer, an antihalation layer, a protective layer, etc., preferably in an amount of from $1\times10^{-2}$ g to 1 g per $m^2$ of each layer.

The couplers which can preferably be used in the present invention are those- of the following formulae (Cp-1), (Cp-2), (Cp-3), (Cp-4), (Cp-5), (Cp-6), (Cp-7), and (Cp-8):

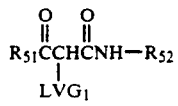

(Cp-1)

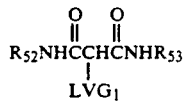

(Cp-2)

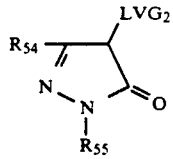

(Cp-3)

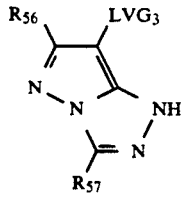

(Cp-4)

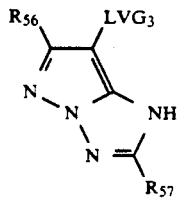

(Cp-5)

-continued

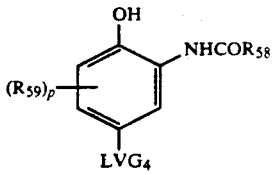

($C_p$-6)

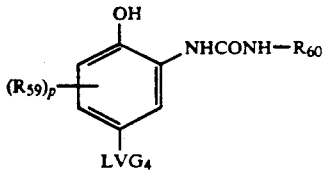

($C_p$-7)

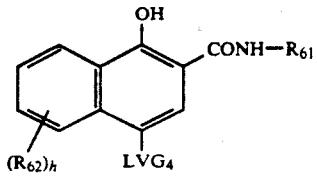

($C_p$-8)

$R_{51}$ through $R_{62}$, $LVG_1$ through $LVG_4$, p and h are explained below.

In the above formulae, when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $LVG_1$, $LVG_2$, $LVG_3$ or $LVG_4$ contains a non-diffusive group, the group is selected so as to have from 8 to 40 carbon atoms, preferably from 12 to 32 carbon atoms, in all, and in other cases, the total number of the carbon atoms in each of the groups of the said symbols is preferably 15 or less. If the couplers are bis-type, telomer-type, or polymer-type couplers, any of the above-mentioned substituent groups can represent a divalent group to link the repeating unit or the like. In these cases, the above-mentioned scope of the number of the carbon atoms of the substituent groups shall not apply.

In the following explanation, $R_{41}$ represents an aliphatic group, an aromatic group or a heterocyclic group; $R_{42}$ represents an aromatic group or a heterocyclic group; and $R_{43}$, $R_{44}$, and $R_{45}$ each represents a hydrogen atom, an aliphatic group, an aromatic group, or a heterocyclic group.

$R_{51}$ has the same meaning as $R_{41}$. $R_{52}$ amd $R_{53}$ each have the same meaning as $R_{42}$.

$R_{54}$ has the same meaning as $R_{41}$ or represents $R_{41}CON(R_{43})$—, $R_{41}N(R_{43})$—, $R_{41}SO_2N(R_{43})$—, $R_{41}S$—, $R_{43}O$—, $R_{45}NCO(R_{43})$—$N(R_{44})$—, $R_{41}OOC$—, $R_{44}NCO(R_{43})$— or N≡C—.

$R_{55}$ has the same meaning as $R_{41}$. $R_{56}$ and $R_{57}$ each has the same meaning as or each represents $R_{41}S$—, $R_{43}O$—, $R_{41}CON(R_{43})$—, $R_{41}N(R_{43})$—, $R_{41}OCON(R_{43})$—, $R_{43}NCO(R_{44})$—$N(R_{45})$— or $R_{41}SO_2N(R_{43})$—.

-continued $R_{58}$ has the same meaning as $R_{41}$. $R_{59}$ has the same meaning as $R_{41}$ or represents $R_{41}CON(R_{43})$—, $R_{41}$—$OCON(R_{43})$—, $R_{41}SO_2N(R_{43})$—, $R_{43}NCO(R_{44})$—$N(R_{45})$—, $R_{43}NSO_2N(R_{44})(R_{45})$—, $R_{41}O$—, $R_{41}S$—, a halogen atom or $R_{41}N(R_{43})$—.

p represents an integer of 0 to 3 If p represents a plural number, the plural $R_{59}$'s may be a same substituent or different substituents. Also, $R_{59}$ may be a divalent group to be bonded together to form a cyclic structure. Examples of the divalent group for forming the cyclic structure include

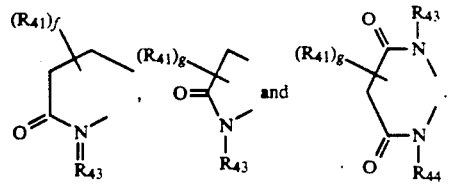

In these groups, f represents an integer of from 0 to 4; g represents an integer of from 0 to 2. $R_{60}$ has the same meaning as $R_{41}$. $R_{61}$ has the same meaning as $R_{41}$. $R_{62}$ has the same meaning as $R_{41}$ or represents $R_{41}CONH$—, $R_{41}OCONH$—, $R_{41}SO_2NH$—, $R_{43}NCO(R_{44})$—$N(R_{45})$—, $R_{43}NSO_2(R_{44})$—$N(R_{45})$—, $R_{43}O$—, $R_{41}S$—, a halogen atom or $R_{41}N(R_{43})$—.

h represents an integer of from 0 to 4. Plural $R_{62}$'s, if any, may be same or different.

In the above substituents, the aliphatic group means a saturated or unsaturated, linear or cyclic, straight or branched, or substituted or unsubstituted aliphatic hydrocarbon group having from 1 to 40, preferably from 1 to 22, carbon atoms. Specific examples of such group are a methyl group, an ethyl group, a propyl group, an isopropyl group, a butyl group, a (t)-butyl group, an (i)-butyl group, a (t)-amyl group, a hexyl group, a cyclohexyl group, a 2-ethylhexyl group, an octyl group, a 1,1,3,3-tetramethylbutyl group, a decyl group, a dodecyl group, a hexadecyl group or an octadecyl group.

The aromatic group is preferably a substituted or unsubstituted phenyl or substituted or unsubstituted naphthyl group having from 6 to 20 carbon atoms.

The heterocyclic group is preferably a 3-membered to 8-membered, substituted or unsubstituted heterocyclic group having from 1 to 20, preferably from 1 to 7, carbon atoms and one or more hetero-atoms selected from nitrogen atom, oxygen atom and sulfur atom. Specific examples of the heterocyclic group are a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group or a 1-pyrazolyl group.

The above-mentioned aliphatic hydrocarbon groups, aromatic groups and heterocyclic groups can be substituted by substituent(s), and typical substituent groups are a halogen atom, $R_{47}O$—, $R_{46}S$—,

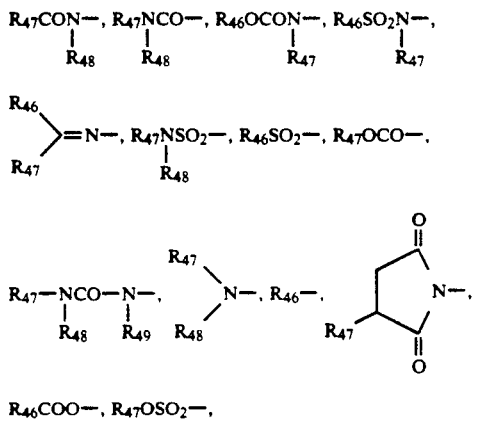

a cyano group, or a nitro group. In these substituents, $R_{46}$ represents an aliphatic group, an aromatic group or a heterocyclic group; $R_{47}$, $R_{48}$, and $R_{49}$ each represents an aliphatic group, an aromatic group, a heterocyclic group or a hydrogen atom. The aliphatic group, aromatic group and heterocyclic group have the same meanings as mentioned above.

Next, the preferred ranges of $R_{51}$ through $R_{62}$, p and h will be mentioned below.

$R_{51}$ is preferably an aliphatic group or an aromatic group. $R_{52}$, $R_{53}$, and $R_{55}$ each is preferably an aromatic group. $R_{54}$ is preferably $R_{41}CONH$— or

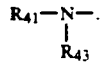

$R_{56}$ and $R_{57}$ each is preferably an aliphatic group, $R_{41}O$—, or $R_{41}S$—. $R_{58}$ is preferably an aliphatic group or an aromatic group. In the formula (Cp-6), $R_{59}$ is preferably a chlorine atom, an aliphatic group or p is preferably 1 or 2. $R_{60}$ is preferably an aromatic group. In the formula (Cp-7), $R_{59}$ is preferably $R_{41}CONH$—. In the formula (Cp-7), h is preferably 1. $R_{61}$ is preferably an aliphatic group or an aromatic group. In the formula (Cp-8), h is preferably 0 or 1. $R_{62}$ is preferably $R_{41}O$-CONH—, $R_{41}CONH$— or $R_{41}SO_2NH$—, and the position of the substituent is preferably on the 5-position of the naphthol ring.

Next, specific examples of $R_{51}$ through $R_{62}$ are set forth below.

$R_{51}$ is typically a (t)-butyl group, a 4-methoxyphenyl group, a phenyl group, a 3-{2-(2,4-di-t-amylphenoxy)-butanamido}phenyl group, a 4-octadecyloxyphenyl group or a methyl group. $R_{52}$ and $B_{53}$ each is typically a 2-chloro-5-dodecyloxycarbonylphenyl group, a 2-chloro-5-hexadecylsulfonamidophenyl group, a 2-chloro-5-tetradecanamidophenyl group, a 2-chloro-5-{4-(2,4-di-t-amylphenoxy)butanamido}phenyl group, a 2-chloro-5-{2-(2,4-di-t-amylphenoxy)butanamido}phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(l-dodecyloxycarbonylethoxycarbonyl)-phenyl group, a 2-chlorophenyl group or a 2-ethoxyphenyl group. $R_{54}$ is typically a 3-{2-(2,4-di-amylphenoxy)butanamido}benzamido group, a 3-[4-(2,4-di-t-amylphenoxy)-butanamido)benzamido group, a 2-chloro-5-tetradecanamidoanilino group, a 5-(2,4-di-t-amylphenoxyacetamido)benzamido group, a 2-chloro-5-dodecenylsuccinimidoanilino group, a 2-chloro-5-{2-(3-t-butyl-4-hydroxyphenoxy)tetradecanamido}anilino group, 2,2-dimethylpropanimido group, a 2-(3-pentadecylphenoxy)butanamido group, a pyrrolidino group or an N,N-dibutylamino group. $R_{55}$ is typically a 2,4,6-trichlorophenyl group, a 2-chlorophenyl group, a 2,5-dichlorophenyl group, a 2,3-di-chlorophenyl group, a 2,6-dichloro-4-methoxyphenyl group, a 4-{2-(2,4-di-t-amylphenoxy)butanamido}phenyl group or a 2,6-dichloro-4-methanesulfonylph-enyl group. $R_{56}$ is typically a methyl group, an ethyl group, an isopropyl group, a methoxy group, an ethoxy group, a methylthio group, an ethylthio group, a 3-phenylureido group, a 3-butylureido group or a 3-(2,4-di-t-amylphenoxy)propyl group. $R_{57}$ is typically a 3-(2,4-di-t-amylphenoxy)-propyl group, a 3-[4-{2-[4-(4-hydroxyphenylsulfonyl)-phenoxy]tetradecanamido}-phenyl]propyl group, a methoxy group, an ethoxy group, a methylthio group, an ethylthio group, a methyl group, a 1-methyl-2-[2-octyloxy-5-{2-octyloxy-5-(1,1,3,3-tetramethylbutyl)-phenylsulfonamido}-phenylsulfonamido]ethyl group, a 3-{4-(4-dodecyloxyphenylsulfonamido)phenyl}propyl group, a 1,1-dimethyl-2-{2-octyloxy-5-(1,1,3,3-tetramethylbutyl)phenylsulfonamido}ethyl group or a dodecylthio group. $R_{58}$ is typically a 2-chlorophenyl group, a pentafluorophenyl group, a heptafluoropropyl group, a 1-(2,4-di-t-amylphenoxy)propyl group, a 3-(2,4-di-t-amylphenoxy)propyl group, a 2,4-di-t-amylmethyl group or a furyl group, $R_{59}$ is typically a chlorine atom, a methyl group, an ethyl group, a propyl group, a butyl group, an isopropyl group, a 2-(2,4-di-t-amylphenoxy)-butanamido group, a 2-(2,4-di-t-amylphenoxy)hexanamido group, a 2-(2,4-di-t-octylphenoxy)octanamido group, a 2-(2-chlorophenoxy)tetradecanamido group, a 2,2-dimethylpropanamido group, a 2-{4-(4-hydroxyphenylsulfonyl)phenoxy}tetradecanamido group or a 2 l -{2-(2,4-di-t-amylphenoxyacetamido)phenoxy}butanamido group. $R_{60}$ is typically a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, or a 3-methoxycarbonylphenyl group. $R_{61}$ is typically a dodecyl group, a hexadecyl group, a cyclohexyl group, a butyl group, a 3-(2,4-di-t-amylphenoxy)propyl group, a 4-(2,4-di-t-amylphenoxy)butyl group, a 3-dodecyloxypropyl group, a 2-tetradecyloxyphenyl group, a t-butyl group, a 2-(2-hexyldecyloxy)phenyl group, a 2-methoxy-5-dodecyloxycarbonylphenyl group, a 2-butoxyphenyl group or a 1-naphthyl group. $R_{62}$ is typically an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, or an acetamido group.

Next, $LVG_1$ through $LVG_4$ are explained below.

$LVG_1$, $LVG_2$, $LVG_3$ and $LVG_4$ each represents a coupling-releasable group or hydrogen atom. Preferred examples of the groups are set forth below.

$LVG_1$ is preferably $R_{65}O$—, an imido group as bonded to the coupling position through the nitrogen atom (e.g., a 2,4-dioxo-1,3-imidazolidin-3-yl group, a 2,4-dioxo-1,3-oxazolidin-3-yl group, a 3,5-dioxo-1,2,4-triazolidin-4-yl group, a succinimido group, a phthalimido group, or a 2,4-dioxo-1,3-imidazolidin-l-yl group, etc.), an unsaturated nitrogen-containing heterocyclic group bonded to the coupling position through the nitrogen atom (e.g., a 1-imidazolyl group, a 1-pyrazolyl group, a 1,2,4-triazol-2 (or 4)group, a benzotriazol-1-yl group, a 3-pyrazolin-5-on-2-yl group, etc.), or $R_{66}S$—.

Preferred examples of $LVG_2$ are $R_{66}S$—, an unsaturated nitrogen-containing heterocyclic group bonded to the coupling position through the nitrogen atom (e.g., a 1-pyrazolyl group, a 1-imidazolyl group, a 1,2,4-triazol-2- (or 4)-yl group, a benzotriazol-1-yl group, a benzimidazolyl group or a benzindazolyl group, etc.), $R_{65}O$—, $R_{65}N{=}N$—, or a hydrogen atom.

Preferred examples of $LVG_3$ are a halogen atom, $R_{66}S$—, an unsaturated nitrogen-containing heterocyclic group as bonded to the coupling position through the nitrogen atom (e.g, a 1-pyrazolyl group, a 1-imidazolyl group or a benzotriazole-1-yl group, etc.), or a hydrogen atom.

Preferred examples of $LVG_4$ are a halogen atom, $R_{66}O$—, or a hydrogen atom.

In these groups, $R_{65}$ represents an aromatic group or a heterocyclic group; $R_{66}$ represents an aliphatic group, an aromatic group or a heterocyclic group. The aromatic group, heterocyclic group and aliphatic group have the same meanings as mentioned for $R_{41}$.

When $LVG_1$, $LVG_2$ and $LVG_3$ each represents the above-mentioned heterocyclic group, the group can have substituent(s) on the substitutable position(s). Specific examples of the substituents include the substituents which are hereinbefore referred to as the substituents for the group $R_{41}$.

Next, specific examples of $LVG_1$, $LVG_2$, $LVG_3$ and $LVG_4$ will be mentioned below.

$LVG_1$ is typically a 1-benzyl-5-ethoxy-2,4-dioxo-1,3-imidazolidin-3-yl group, a 1-methyl-5-hexyloxy-2,4-dioxo-1,3-imidazolidin-3-yl, a 1-phenyl-5-benzyl-2,4-dioxo-1,3,5-triazolidin-3-yl group, a 5,5-dimethyl-2,4-dioxo-1,3-oxazolidin-3-yl group, a 1-pyrazolyl group, a 4,5-bis(methoxycarbonyl)imidazol-1-yl group, a 2-phenylcarbamoyl-1,3-imidazolyl-1-yl group, a 4-phenylcarbamoyl-1,3-imidazolyl-1-yl group, a 6-methyl-xanthin-1-yl group, a 4-(4-hydroxyphenylsulfonyl)-phenoxy group, a 4-isopro-poxyphenoxy group, a 4-cyanophenoxy group, a 2-chloro-4-(2-chloro-4-hydroxyphenylsulfonyl)phenoxy group, a 5-phenoxycarbonyl-1-benzotriazolyl group, a 4-carboxyphenoxy group or a 4-(4-benzyloxyphenylsulfonyl)phenoxy group. $LVG_2$ is typically a hydrogen atom, a 1-pyrazolyl group, a 3-chloro-5-methyl-1,2,4-triazol-2-yl group, a 5-phenoxycarbonyl-l-benzotriazolyl group, a 2-butoxy-5-(1,1,3,3-tetramethylbutyl)phenylthio group, a 4-chloro-1-pyrazolyl group, a 4-{3-(2-decyl-4-methylphenoxyacetoxy)propyl}pyrazol-1-yl group, a dodecyloxycarbonylmethylthio group, a 1-phenyltetrazolyl-5-thio group, or a 4-dodecylsulfamoylphenoxy group. $LVG_3$ is typically a chlorine atom, a hydrogen atom, a 4-methylphenoxy group, a 4-cyanophenoxy group, a 2-butoxy-5-(1,1,3,3-tetramethylbutyl)-phenylthio group, a 1-pyrazolyl group, or a 2-(2-phenoxyethoxy)-5-(1,1,3,3-tetramethylbutyl)phenylthio group. $LVG_4$ is typically a chlorine atom, a hydrogen atom, a 4-methoxyphenoxy group, a 4-(1,1,3,3-tetramethylbutyl)phenoxy group, a 2-carboxyethylthio group, a 2-(2-carboxyethylthio)ethoxy group, a 1-phenyltetrazolyl-5-thio group, a 1-ethyltetrazol-yl-5-thio group, a 3-carboxypropoxy group, a 5-phenoxycarbonylbenzotriazole-1-methoxy group, a 2,3-dihydroxy-4-(1-phenyltetrazolyl-5-thio)-5-propylcarbamoylphenoxy group, a 2-(1-carboxytridecylthio)ethoxy group, a 2-(2-methoxyethylcarbamoyl)ethoxy group, or a 2-{4-(8-acetamido-1-hydroxy-3,6-disulfonaphthyl-2-azo)phenoxy}ethoxy disodium salt group.

The couplers for use in the present invention may be polymers. Specifically, the couplers may be polymers having a repeating unit of formula (III), which can be derived from monomers of formula (II), or may be copolymers additionally containing one or more non-coloring comonomer components which do not have an ability of coupling with the oxidation product of an aromatic primary amine developing agent and which have at least one ethylene group. In the preparation of these polymers and copolymers, two or more kinds of the monomers of the formula (II) can be polymerized together.

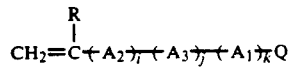

(II)

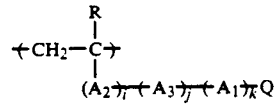

(III)

In the formulae; R represents a hydrogen atom, a lower alkyl group having from 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —NH— or —O—; $A_2$ represents —CONH— or —COO—; $A_3$ represents an unsubstituted or substituted alkylene group having from 1 to 10 carbon atoms, an unsubstituted or substituted aralkylene group or an unsubstituted or substituted arylene group, and alkylene moiety may be either linear or branched. (The alkylene group includes a methylene group, a methylmethylene group, a dimethylmethylene group, a dimethylene group, a trimethylene group, a tetramethylene group, a pentamethylene group, a hexamethylene group, and a decylmethylene group; the aralkylene group includes a benzylidene group; and the arylene group includes a phenylene group and naphthylene group.)

Q represents a compound residual group or a coupler residual group of the formula (I), and this can be bonded at any position of the substituents as previously mentioned hereinbefore.

i, j and k each represents 0 or 1, provided that all of these i, j, and k are 0.

As the substituents on the alkylene group, aralkylene group and arylene group for $A_3$, there may be mentioned, for example, an aryl group (e.g., a phenyl group), a nitro group, a hydroxyl group, a cyano group, a sulfo group, an alkoxy group (e.g., a methoxy group), an aryloxy group (e.g., a phenoxy group), an acyloxy group (e.g., an acetoxy group), an acylamino group (e.g., an acetylamino group), a sulfonamido group (e.g., a methanesulfonamido group), a sulfamoyl group (e.g., a methylsulfamoyl group), a halogen atom (e.g., a fluorine atom, a chlorine atom, a bromine atom, etc.), a carboxyl group, a carbamoyl group (e.g., a methylcarbamoyl group), an alkoxycarbonyl group (e.g., a methoxycarbonyl group, etc.), a sulfonyl group (e.g., a methylsulfonyl group), etc. If the group of $A_3$ has two or more of these substituents, they may be same or different.

Next, as the non-coloring ethylenic monomers which do not couple with the oxidation product of an aromatic primary amine developing agent, there may be mentioned, for example, acrylic acid, α-chloroacrylic acid, α-alkylacrylic acids and esters and amides derived from these acrylic acids, as well as methylenebis-acrylamide, vinyl esters, acrylonitrile, aromatic vinyl compounds, maleic acid derivatives and vinylpyridines. Two or more kinds of the said non-coloring ethylenic unsaturated monomers can be used together for the preparation of the polymer couplers of the present invention.

Next, the conditions (i) through (vii) of the present invention for the improvement of the graininess and the image sharpness of GL, RL, and BL to which the interlayer effect is to be imparted, which are other characteristic features of the present invention, are explained in further detail hereinafter.

As mentioned in the above, after the color-reproducibility has been remarkably improved because of the satisfaction of at least one of conditions (a) through (d), the problems of the color image sharpness and the graininess of GL, RL, and BL, especially the image sharpness of RL and the color image graininess of GL and RL, often becomes noticeable.

The present inventors have found that the combination of the use of the above-mentioned DIR-coupler in the interlayer effect-donor layer and the use of a DIR-coupler capable of releasing a hardly diffusible development inhibitor, or specifically, the incorporation of a DIR-coupler capable of releasing a development inhibitor having a diffusibility of 0.4 or less in GL, which is condition (iii) of the present invention, results in an extreme improvement of the graininess of GL, and further have found that the additional incorporation of a DIR-coupler or a timing-coupler capable of releasing a development inhibitor having a relatively large diffusibility of from 0.4 to 0.95 or a precursor thereof into BL and/or RL, which is the condition (i) of the present invention, further results in the improvement of the graininess and sharpness of the emulsion layers.

The DIR-coupler capable of releasing a development inhibitor having a diffusible degree of 0.4 or less, which is to be used for the above-mentioned condition (iii), and the DIR-coupler capable of releasing a development inhibitor having a diffusible degree of from 0.4 to 0.95, which is to be used for the requirement (i), are specified by the method for the measurement of the diffusible degree as mentioned in the above.

Next, according to the condition (ii) of the present invention, a compound capable of reacting with the oxidation product of a developing agent during development to release a compound which can react with another oxidation product of the developing agent to release a development inhibitor is incorporated into at least one of BL and RL and interlayers, whereby the sharpness and the graininess can be improved.

The compounds of this kind are described, for example, in Japanese Patent Application (OPI)Nos. 123944/85, and 233741/86 and Japanese Patent Application No. 168938/86 own prior Japanese Patent Application filed on July 17, 1986. In particular, the compounds as described in the last Japanese Patent Application are especially preferred.

These compounds can be represented, for example, by formula (IV):

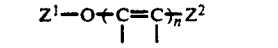

(IV)

in which n represents an integer of from 1 to 4, preferably 1 or 2; $Z^1$ and $Z^2$ independently represent —OH, $—NH_2$, $—NHR^1$, $—NR^2R^3$ or $—NHSO_2R_4$; $R^1$ represents an alkyl group; $R^2$ and $R^3$ each represents an alkyl group, or $R^2$ and $R^3$ together form an atomic group for forming a nitrogen-containing heterocyclic ring; $R^4$ represents an alkyl group or an aryl group; and when n is 1,

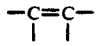

may be a part of a benzene ring or naphthalene ring struture.

The alkyl group for $R^1$, $R^2$, $R^3$, and $R^4$ may be substituted, and examples of the substituents are a halogen atom and an alkoxy group. The alkyl group includes a linear or branched alkyl group, preferably having from 1 to 5 carbon atoms. The aryl group for $R^4$ may be substituted, including, for example, a phenyl group, an alkoxy-substituted phenyl group, an alkyl-substituted phenyl group, etc. $R^2$ and $R^3$ may together form a nitrogen-containing heterocyclic group, which includes, for example, a morpholino group, a piperidino group or, a piperadino group, etc. Preferred compounds are hydroquinone series compounds, catechol series compounds, o-aminophenol series compounds, and p-aminophenol series compounds.

The compound represented by the formula (IV) is used solely or together with image-forming couplers preferably in an amount of from $1\times10^{-3}$ g to 1 g, more preferably from $1\times10^{-2}$ g to $1\times10^{-1}$ g per $m^2$ of each layer. The ratio of the compound of formula (IV) to-the image-forming coupler used in a photosensitive layer is preferably from $1\times10^{-3}$ to 1 by weight.

Specific examples of the compounds are set forth below, which, however, are not intended to restrict the scope of the present invention.

(1)
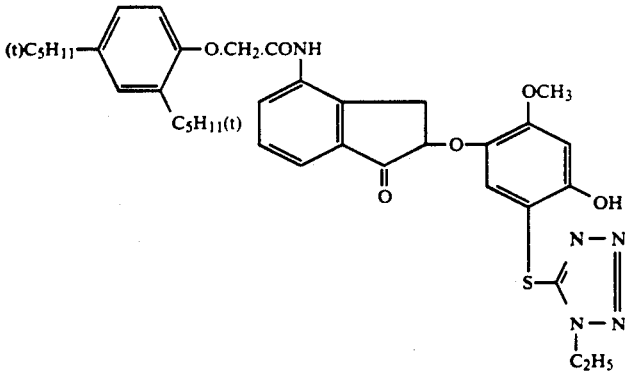
(2)
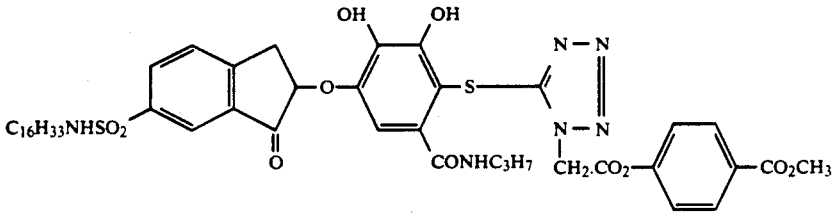
(3)
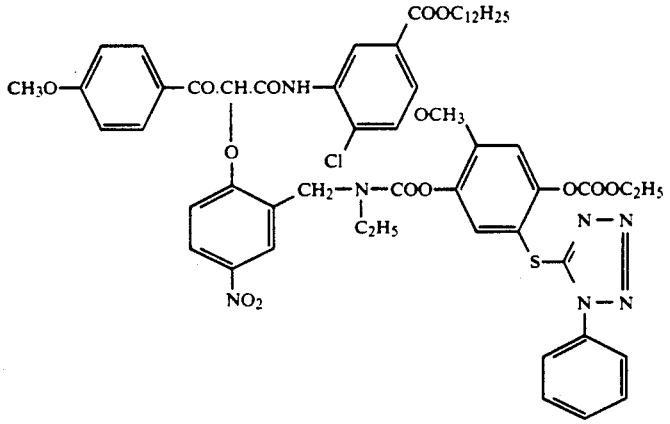
(4)
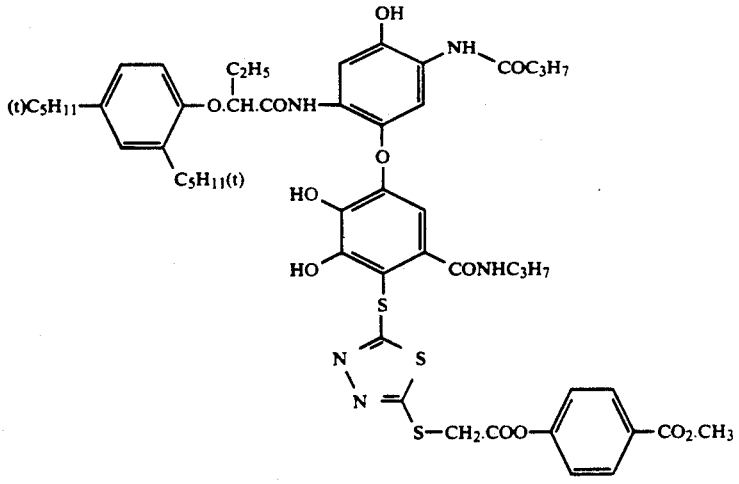

-continued (5)

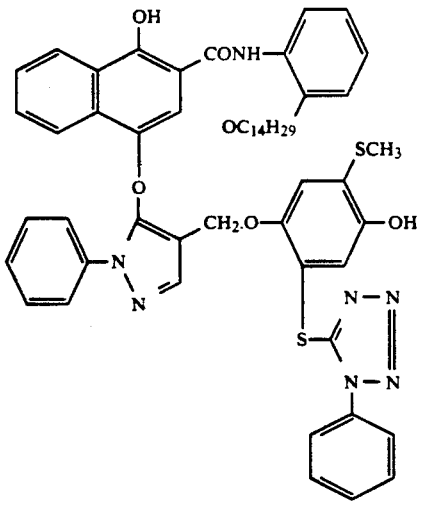

In accordance with condition (iv) of the present invention, a colorless competing-coupler is incorporated in GL together with the image-forming coupler, whereby the graininess is improved. In particular, the incorporation of the said colorless coupler into GL together with the above-mentioned DIR-coupler which can release a development inhibitor having a diffusibility of 0.4 or less is advantageous, as the graininess is improved further because of the synergestic effect of the DIR-coupler for improving the graininess and the colorless competing coupler for improving the smoothness of the color image profile formed.

The colorless competing couplers for use in the present invention are described, for example, in Japanese Patent Application (OPI) No. 43746/S6 and U.S. Pat. No. 4,130,427.

As the colorless competing couplers, those of formulae (V), (VI), and (VII) are preferred.

Formula (V) is represented by

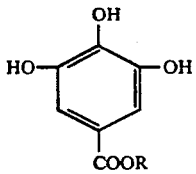

(V)

in which R represents a linear or branched alkyl group having from 1 to 18 carbon atoms. The compounds of formula (V) are alkyl gallates. Specific examples of these compounds are as follows:

| | |
|---|---|
| A1: | Methyl Gallate |
| A2: | Ethyl Gallate |
| A3: | n-Propyl Gallate |
| A4: | Isopropyl Gallate |
| A5: | n-Butyl Gallate |
| A6: | Isoamyl Gallate |
| A7: | d-Amyl Gallate |
| A8: | n-Hexyl Gallate |
| A9: | n-Heptyl Gallate |
| A10: | n-Octyl Gallate |
| A11: | n-Nonyl Gallate |
| A12: | n-Decyl Gallate |
| A13: | n-Undecyl Gallate |
| A14: | n-Dodecyl Gallate |
| A15: | n-Tetradecyl Gallate |
| A16: | n-Hexadecyl Gallate |

-continued

| | |
|---|---|
| A17: | n-Octadecyl Gallate |

Formula (VI) is represented by

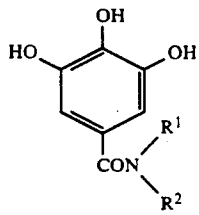

(VI)

in which $R^1$ and $R^2$ each represents a hydrogen atom, a substituted or unsubstituted aliphatic group, a substituted or unsubstituted aromatic group, or a substituted or unsubstituted heterocyclic group, or $R^1$ and $R^2$ may together form a ring, provided that both $R^1$ and $R^2$ must not be hydrogen atoms at the same time.

In formula (VI), the aliphatic group for $R^1$ and $R^2$ includes a linear or branched alkyl group, a linear or branched alkenyl group, a cycloalkyl group or a linear or branched alkynyl group.

The linear or branched alkyl group has from 1 to 30 carbon atoms, preferably from 1 to 20 carbon atoms and includes, for example, a methyl group, an ethyl group, a propyl group, a n-butyl group, a sec-butyl group, a t-butyl group, an n-hexyl group, a 2-ethylhexyl group, an n-octyl group, a t-octyl group, an n-dodecyl group, an n-hexadecyl group, an n-octadecyl group, an isostearyl group or an eicosyl group.

The linear or branched alkenyl group has from 2 to 30 carbon atoms, preferably from 3 to 20 carbon atoms, and includes, for example, an allyl group, a butenyl group, a phenyl group, an octenyl group, a dodecenyl group or an oleyl group.

The cycloalkyl group is a 3-membered to 12-membered group, preferably a 5-membered to 7-membered group, and includes, for example, a cyclopropyl, a cyclopentyl group, a cyclohexyl group, a cycloheptyl group, and a cyclododecyl group.

The linear or branched alkynyl group has from 3 to 30 carbon atoms, preferably from 3 to 22 carbon atoms, and includes, for example, a propargyl group or a butynyl group.

The aromatic group for $R^1$ and $R^2$ includes a phenyl group or a naphthyl group.

The heterocyclic group for $R^1$ and $R^2$ includes a thiazolyl group, an oxazolyl group, an imidazolyl group, a furyl group, a thienyl group, a tetrahydrofuryl group, a piperidyl group, a thiadiazolyl group, an oxadiazolyl group, a benzothiazolyl group, a benzoxazolyl group, a benzimidazolyl group, etc.

$R^1$ and $R^2$ may together form a ring, which is 3-membered to 12-membered, preferably 5-membered to 12-membered, and examples of the ring-constitutional moiety are an ethylene, a tetramethylene, a pentamethylene, hexamethylene, a dodecamethylene, etc.

The above-mentioned groups may further have pertinent substituent(s), and examples of the substituents are an bonyl group, an aryloxycarbonyl group, a halogen atom, a carboxyl group, a sulfo group, a cyano group, an alkyl group, an alkenyl group, an aryl group, an alkylamino group, an arylamino group, a carbamoyl group, an alkylcarbamoyl group, an arylcarbamoyl group, an acyl group, a sulfonyl group, an acyloxy group, an acylamino group, etc.

The compound represented by the formula (V) or (VI) is used preferably in an amount of from $1\times10^{-3}$ g to 1 g per $m^2$ of each silver halide emulsion layer and may be used in an interlayer, an antihalation layer or a protective layer preferably in an amount of from $1\times10^{-3}$ g to 1 g per $m^2$ of each layer.

specific examples of the compounds of formula (VI) are set forth below.

B-1

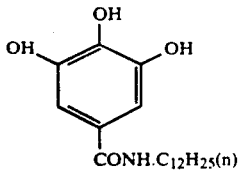

B-2

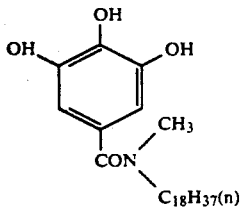

B-3

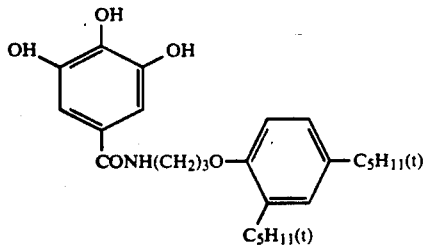

B-4

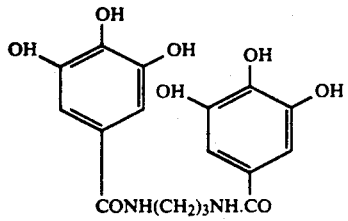

-continued

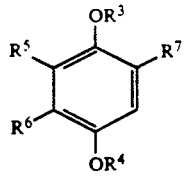

(VII)

in which $R^3$ and $R^4$, which may be the same or different, each represents a hydrogen atom or a group capable of being hydrolyzed with alkali; $R^5$, $R^6$, and $R^7$ each represents a hydrogen atom, a sulfo group, a carboxyl group, a sulfoalkyl group, a carboxyalkyl group or an alkyl group, provided that at least one of these $R^5$, $R^6$, and $R^7$ groups is selected from a sulfo group, a carboxyl group, a sulfoalkyl group, and a carboxyalkyl group, and that at least one of them must be an alkyl group.

In formula (VII), examples of the group which can be hydrolyzed with an alkali, for $R^3$ and $R^4$, are an acetyl group, a trichloroacetyl group, an ethoxycarbonyl group, a benzoyl group, etc. Regarding $R^5$, $R^6$, and $R^7$, the sulfoalkyl group includes a 1,1-dimethyl-2-sulfoethyl group; the carboxyalkyl group includes a 5-carboxypentyl group; the alkyl group includes a methyl group, an ethyl group, a t-octyl group, an n-octyl group, a sec-dodecyl group, an n-pentadecyl group, a sec-octadecyl group, etc.

In formula (VII), $R^3$ and $R^4$ are preferably a hydrogen atom; and $R^5$, $R^6$, and $R^7$ are preferably a sulfo group or an alkyl group. In particular, it is more preferred that $R^7$ is a sulfo group or a carboxyl group, one of $R^5$ and $R^6$ is an alkyl group and the other of them is a hydrogen atom.

It is most preferred that $R^5$ is a hydrogen atom, $R^6$ is an alkyl group, and $R^7$ is a sulfo group.

The compounds of formula (VII) can be synthesized by or in accordance with the methods described in British Patent 891,158, U.S. Pat. No. 2,701,197, etc.

The compound represented by the formula (VII) is used preferably in an amount of from $1\times10^{-3}$ g to 1 g per $m^2$ of a layer containing other couplers, couplers represented by the formula (V)or (VI) and/or colorless coupler, or of an antihalation layer, an interlayer or a protective layer.

Specific examples of such compounds are set forth below.

Q-1

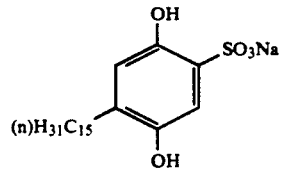

Q-2

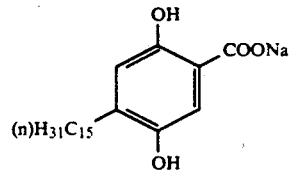

-continued

Q-3

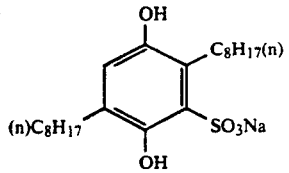

The colorless couplers for use in the present invention are couplers which can couple with the oxidation product of a color developing agent, but which do not form any color dyes in the layers of light-sensitive materials, because (1) the coupler remains as a leuco-form, (2) a color dye which was - once formed from the coupler is decomposed during development or in a post-processing bath and then becomes to a colorless compound, or (3) the color dye formed from the coupler, which is soluble in water, is dissolved out in the processing solution.

The colorless couplers are known and are illustrated, for example, in the literature described below. Specifically, couplers of pyrazolones, benzoyl-acetic acid esters, benzoyl acetic acid anilides and acetacetic acid anilides where the hydrogen atom of the active methylene is substituted by a substituted alkyl or a substituted allyl, as described in British Patent 914,145; pyrazolone couplers where the 4-position of the pyrazolone is substituted by a methyl group, an ethyl group or a cyanoethyl group, as described in British Patent 1,284,649; and 5-pyrazolone couplers where the 4-position is substituted by an alkyl group, a substituted alkyl group, an aryl group or a substituted aryl group, the 3-position is substituted by a substituted acylamido group and the coupling activity has been improved, as described in Japanese Patent Application (OPI) No. 83031/75, belong to the above-mentioned type (1).

Examples of the couplers which belong to the above-mentioned type (2) are non-cyclic ketone-type colorless DIR-couplers as described in Japanese Patent Publication No. 22514/71 and cyclic ketone-type colorless DIR-couplers as described in Japanese Patent Publication No. 16141/76; and examples of the couplers which belong to the above-mentioned 15 type (3) include couplers as described in U.S. Pat. No. 2,742,832.

The above-described colorless coupler may be incorporated solely or together with an image-forming coupler in a photo-sensitive layer, an interlayer (including light-filter layer), an antihalation layer, etc, preferably in an amount of from $1\times10^{-4}$ g to 10 g, more preferably $1\times10^{-3}$ g to 1 g per $m^2$ of each layer. Preferably, the colorless coupler may be used together with at least one compound represented by the formulae (IV) to (VII).

Polymeric couplers for use in the present invention can be prepared by emulsion-polymerization in the form of a latex, or emulsifying and dispersing polymers obtained by solution-polymerization in the form of a linear polymer and in an aqueous medium for use in the present invention In accordance with the condition (v) of the present invention, a nondiffusion coupler capable of forming a diffusible dye which can adequately smear (hereinafter referred to as "weakly diffusible dye-forming coupler") is incorporated into th GL together with the image-forming coupler, whereby the graininess can be improved. As these couplers, the magenta couplers described in U.S. Pat. No. 4,366,237, British Patent 2,125,570, and Japanese Patent Application No. 165846/84 are preferred. Although similar weakly diffusible cyan dye- or yellow dye-forming couplers can be incorporated in RL or BL whereby the graininess of RL or BL is also improved, the magenta couplers are especially preferably used in the present invention, as the effect is extremely remarkable.

Next, specific examples of the wearkly diffusible dye-forming couplers for use in the present invention are set forth below. For GL, wearkly diffusible dye-forming magenta couplers are especially preferably used, among the examples illustrated. Specifically, magenta couplers having the above-mentioned formula (Cp-3), (Cp-4), or (Cp-5) where a ballast group is inserted into $LVG_2$ or $LVG_3$ so that the color dye to be formed is made wearkly diffusible and slightly spreadable can be used.

In particular, couplers of the following formulae (VIII) to (XIV), which are described in Japanese Patent Application (OPI) NO. 43746/86, are preferred.

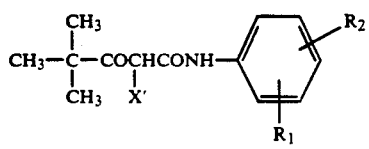

(VIII)

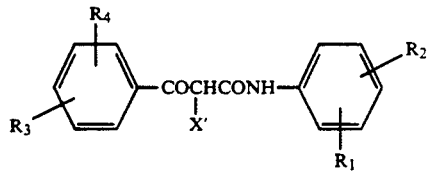

(XI)

In the above formulae, $R_1$, $R_2$, $R_3$, and $R_4$ each represents a hydrogen atom, a halogen atom, an alkyl group (e.g., a methyl group, an ethyl group, a propyl group, a hydroxyethyl group, etc.), an alkoxy group (e.g., a methoxy group, an ethoxy group, a methoxyethoxy group, etc.), an aryloxy group, an acylamino group, a sulfonamido group, a benzenesulfonamido group, a carbamoyl group, a sulfamoyl group, an alkylthio group, an alkylsulfonyl group, an alkoxycarbonyl group, an ureido group, a cyano group, a carboxyl group, a hydroxyl group or a sulfo group, provided that the total of the number of the carbon atoms in the groups $R_1$, $R_2$, $R_3$ and $R_4$ is 10 or less; X' represents a so-called ballast group having from S to 32 carbon atoms, and X' is a releasable group.

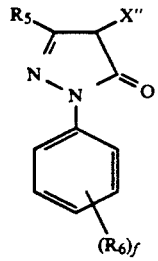

[X]

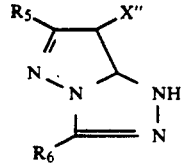

[XI]

-continued

[XII]

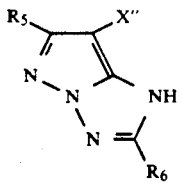

In these formulae, R represents an acylamino group, an acyl group, or an ureido group; $R_6$ and $R_7$ each represents a halogen atom, an alkyl group (e.g., a methyl group, an ethyl group, a butyl group, etc.), an alkoxy group, an acylamino group, an alkoxycarbonyl group, an N-alkylcarbamoyl group (e.g., an N-methylcarbamoyl group), an ureido group, a cyano group, an aryl group, an N,N-dialkylsulfamoyl group, a nitro group, a hydroxyl group, a carboxyl group or an aryloxy group; f represents an integer of from 0 to 4, and when f is 2 or more, plural $R_6$'s may be same or different; X'' represents a releasable group, which has a ballast group as represented by the formula

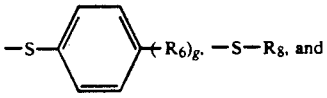

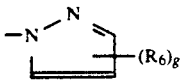

in which g represents an integer of from 0 to 4.

In formula (X), the total of the number of the carbon atoms of $R_5$ and $(R_6)_f$ is 10 or less. In formulae (XI) and (XII), the total of the number of the carbon atoms of $R_5$ and $R_6$ is 10 or less. $R_8$ represents a substituted or unsubstituted alkyl, aralkyl, alkenyl, or cyclic alkyl group.

(XIII)

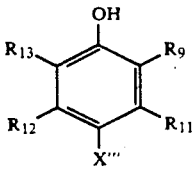

(XIV)

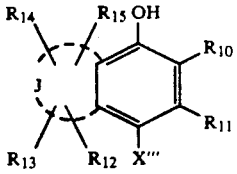

In the formulae, $R_9$, $R_{10}$, $R_{11}$, $R_{12}$, $R_3$, $R_{14}$, $R_{15}$, X''' and J have the same meanings as those described in EP 96873. Preferably, $R_9$ represents a hydrogen atom, an aliphatic group having up to 10 carbon atoms (e.g., a methyl group, an isopropyl group, an amyl group, a cyclohexyl group, etc.), an alkoxy group having up to 10 carbon atoms, an allyloxy group, an acylamido group, a sulfonamido group or an ureido group. $R_{10}$ represents a hydrogen atom, an aliphatic group having up to 12 carbon atoms or a carbamoyl group; $R_{11}$, $R_{12}$, $R_{13}$, $R_{14}$ and $R_{15}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group. X''' represents a releasable group having from 8 to 32 carbon atoms, which is bonded to the coupling position through —O—, —S—, or —N=N—.

The diffusible dye-forming couplers used in the present invention are used preferably in an amount of from $1\times10^{-3}$ g to 10 g, more preferably from $1\times10^{-2}$ g to 1 g per $m^2$ of each silver halide emulsion layer, or preferably from $1\times10^{-2}$ to 10 equivalent per mol of silver halide in each silver halide emulsion layer. The couplers may be incorporated in an interlayer, an antihalation layer, a protective layer, etc., preferably in an amount of from $1\times10^{-2}$ g to 1 g per $m^2$ g each layer.

Specific examples of such couplers are set forth below.

(1)

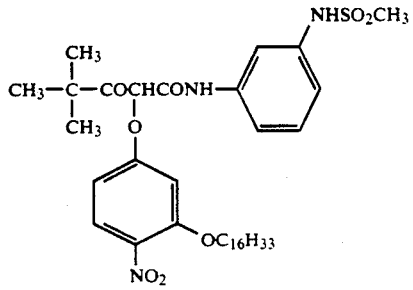

(2)

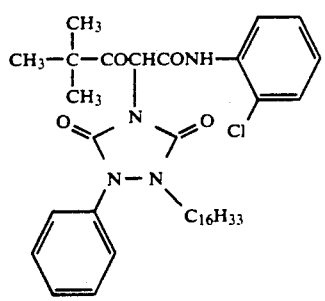

(3)

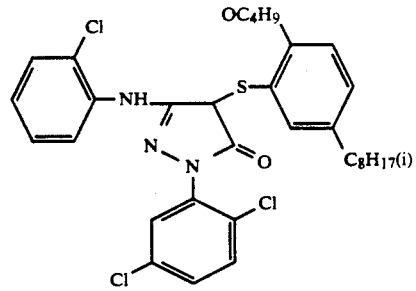

(4)

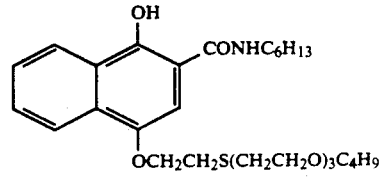

-continued

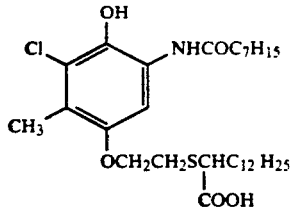

(5)

In accordance with the condition (vi) of the present invention, a yellow dye, examples of which are described below, is incorporated into the yellow filter layer so as to reduce the amount of the yellow silver colloid in the layer or to replace the same by the yellow dye, whereby the graininess of the adjacent light-sensitive layer can be improved. The reason is believed to be due to coarsening of the adjacent color image by the physical development. Further, as the action of the colloidal silver for desensitizing the silver halide grains in the adjacent layer is reduced, the grains can be made fine so much whereby the graininess can be improved.

Examples of the yellow dyes for use in the present invention include compounds having the formula

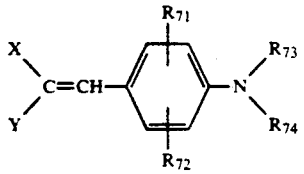

[XV]

in which $R_{71}$ and $R_{72}$ (which may be the same or different) each represents a hydrogen atom, a halogen atom, an alkyl group, an alkoxy group, a hydroxyl group, a carboxyl group, a substituted amino group, a carbamoyl group, a sulfamoyl group, a nitro group or an alkoxycarbonyl group; $R_{73}$ and $R_{74}$ may be same or different and each is a hydrogen atom, a substituted or unsubstituted alkyl group, a substituted or unsubstituted alkenyl group, a substituted or unsubstituted aryl group, an acyl group or a sulfonyl group, or $R_{73}$ and $R_{74}$ together form a 5-membered or 6-membered ring; X and Y (which may be same or different) each represents an electron-attractive group.

The compound represented by the formula (XV) is used preferably in an amount of from $1\times10^{-2}$ g to 1 g, more preferably from $1\times10^{-2}$ g to 0.5 g per $m^2$ of coating layer, or in an amount of a blue-filter density to be 4.0 or less, according to a method of Status M-density measurement (Macbeth Company). The compound of formula (XV) may be used together with a colloidal silver.

Specific examples of the above-mentioned yellow dyes ar set forth below.

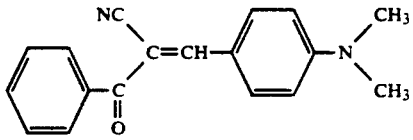

Y1

-continued

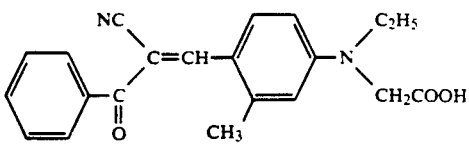

Y2

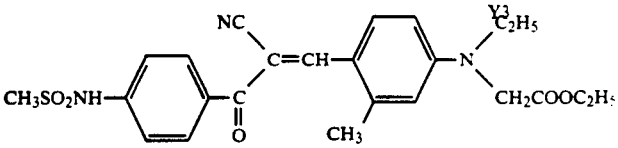

Y3

In accordance with condition (vii) of the present invention, the light-sensitive layers which accept the interlayer effect from the above-mentioned interlayer effect-donor layers, such as GL, RL, and BL, contain tabular silver halide grains having an aspect ratio of 5 or more or monodispersed multilayer structural silver halide grains in order to improve the graininess and the sharpness. In particular, silver halide grains having a mean grain size of 0.35 μm or less or of 0.55 μm or more are used. The effect for improving the light-transparency of multilayered light-sensitive layers has been known, which, however, have been found to extremely easily and characteristically accept the interlayer effect. In addition, it has also been found that not only the interlayer effect but also the graininess can further be improved.

In one preferred embodiment of the present invention, a 2-equivalent magenta coupler is used as the magenta image-forming coupler in the emulsion layer, especially in GL; in the above-mentioned color photographic light-sensitive materials.

Especially in the case of magenta color couplers, 2-equivalent magenta- couplers have a high efficiency of silver halide utilization in view of the theoretical silver equivalent standard than 4-equivalent magenta couplers, and therefore, a determined magenta color density can be obtained from the 2-equivalent magenta coupler even though the amount of the silver halide in the light-sensitive layer is small. Accordingly, the use of such 2-equivalent magenta couplers is advantageous in that the acceptance of the interlayer effect from the individual interlayer effect-donor layer is extremely easy and effective. In addition, the effect of the DIR-coupler, which is to be used in accordance with the requirements (i) to (iii) of the present invention, especially for the improvement of the graininess, as well as the edge effect of images, which would appear in the GL itself, can efficiently be effected, whereby the image sharpness can be significantly improved. Further, because of the use of the specifically defined silver halide grains, according to the condition (vii) of the present invention, the amount of the silver halide to be used in the light-sensitive layer may well be small, and therefore, the improvement is remarkable.

The 2-equivalent magenta couplers for use in the present invention are preferably compounds of the aforementioned formulae (Cp-3),(Cp-4), and (Cp-5) where $LVG_2$ and $LVG_3$ each represents a coupling-releasable group. Specific examples of the compounds are set forth below.

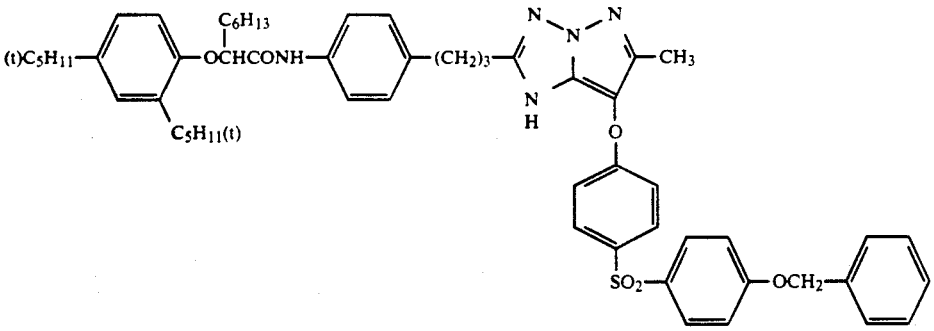
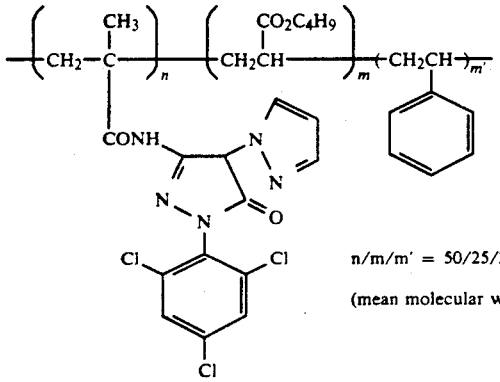
n/m/m' = 50/25/25 (% by weight)
(mean molecular weight: about 20,000)
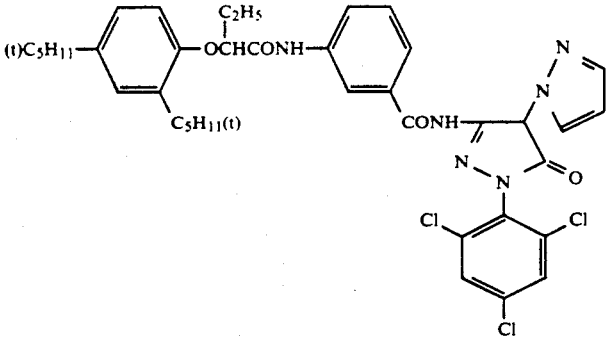
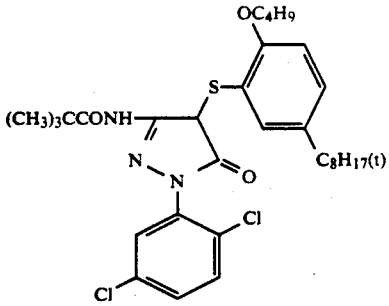
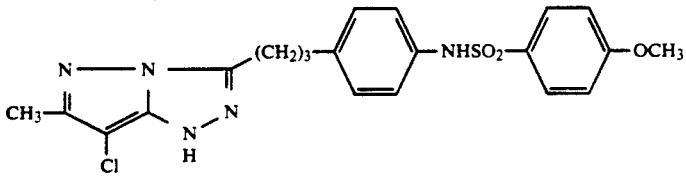

-continued
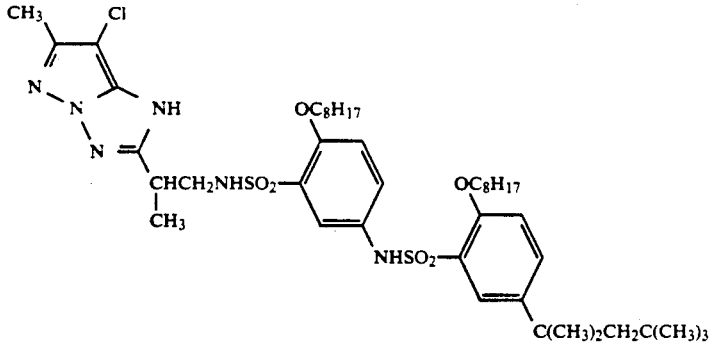
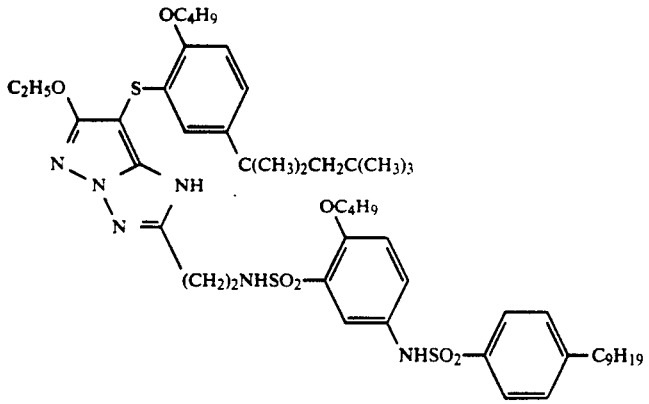
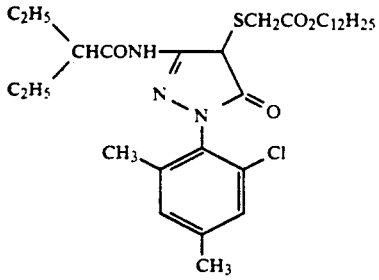
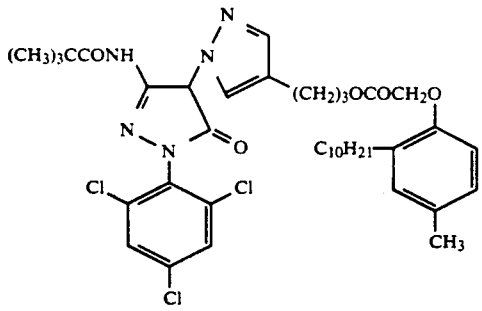
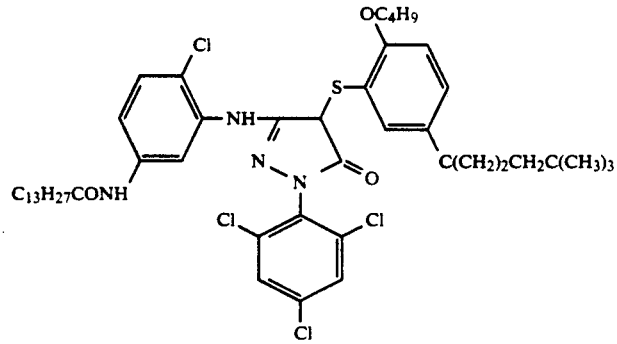

-continued
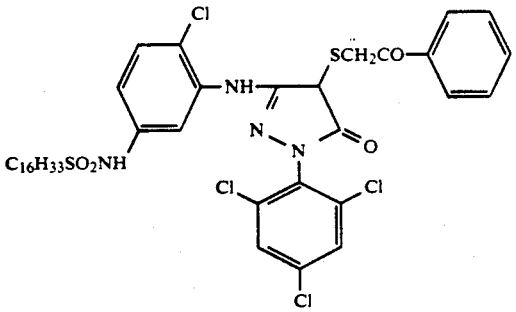
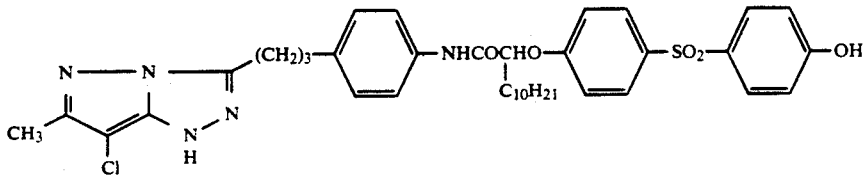
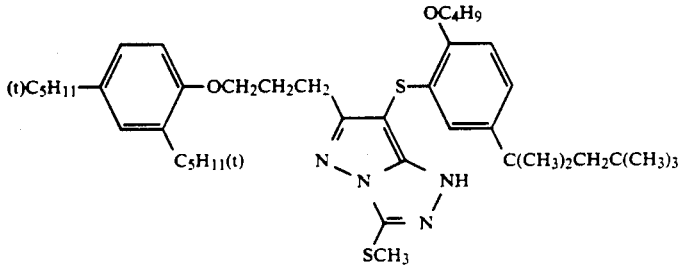
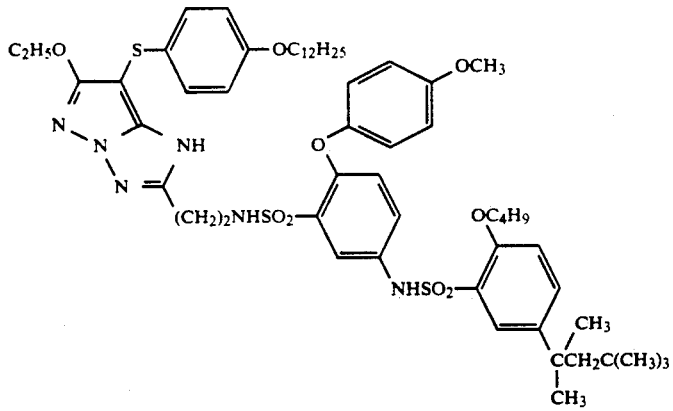
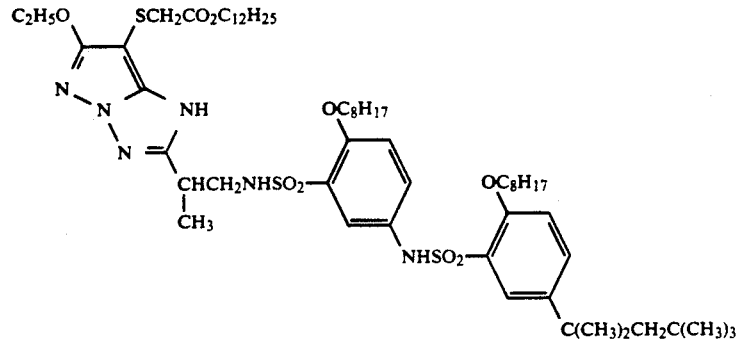

-continued

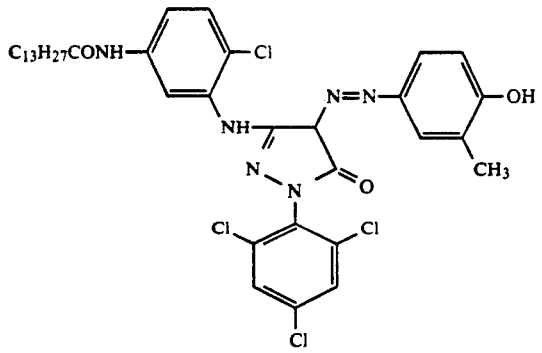

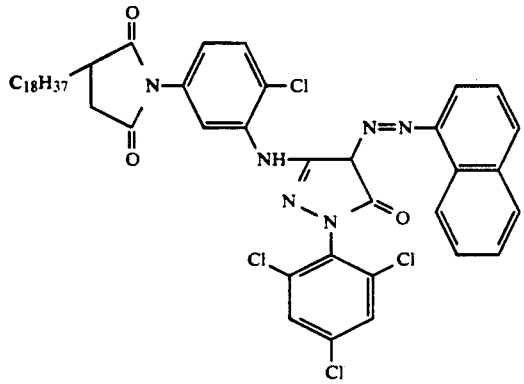

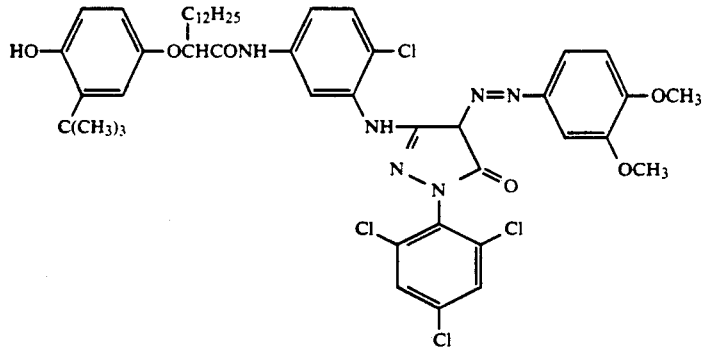

The color developer to be used for the development of the photographic light-sensitive materials of the present invention is preferably an alkaline aqueous solution consisting essentially of an aromatic primary amine series color developing agent. As the color developing agent, although aminophenol series compounds are useful, p-phenylenediamine series compounds are preferably used. Specific examples of the compounds are 3-methyl-4-amino-N,N-diethyl-aniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides and p-toluenesulfonates thereof. These diamines are more stable in the form of their salts than in their free forms, and so the former are preferably used.

The color developer generally contains a pH buffer such as an alkali metal carbonate, borate or phosphate, and a development inhibitor or an anti-foggant such as a bromide, an iodide, a benzimidazole, a benzothiazole or a mercapto compound. In addition, the color developer may optionally contain a preservative such as a hydroxylamine, a dialkylhydroxylamine derivative or a sulfite; an organic solvent such as a triethanolamine or a diethylene glycol; a development accelerator such as a benzyl alcohol, a polyethylene glycol, a quaternary ammonium salt or an amine; a dye-forming coupler; a competing coupler; a nucleating agent such as a sodium borohydride; a development assistant such as a 1-phenyl-3-pyrazolidone; a tackifier; a chelating agent such as an aminopolycarboxylic acid, an aminopolyphosphonic acid, an alkylphosphonic acid or a phosphonocarboxylic acid; and an antioxidant as described in West German Patent (OLS) No. 2,622,950, if desired.

For the development of reversal color photographic materials, the material is, in general, first subjected to black-and-white development and then to color development. As the black-and-white developer, known black-and-white developing agents, for example, dihydroxybenzenes such as hydroquinone, 3-pyrazolidones such as 1-phenyl-3-pyrazolidone, or aminophenols such as N-methyl-p-aminophenol, etc., can be used singly or in combination.

After color development, the photographic emulsion layers are generally bleached. The bleaching can be carried out simultaneously with fixation or separately therefrom. In order to accelerate the rapid processing, the photographic materials can be subjected to bleach-fixation (blix) after color development. As the bleaching agent, for. example, compounds of polyvalent metals such as iron (III), cobalt (III), chromium (VI), copper (II), etc., peracids, quinones, nitroso compounds, etc., can be used. Typical bleaching agents are ferricyanides; bichromates; organic complexes of iron (III) or cobalt (III) with an aminopolycarboxylic acid such as ethylenediamine-tetraacetic acid, diethylenetriamine-pentaacetic acid, nitrilo-triacetic acid or 1,3-diamino-2-propanol-tetraacetic acid or with an organic acid such as citric acid, tartaric acid or malic acid; persulfates; manganates; nitrosophenols, etc. In particular, ethylenediamine-tetraacetic acid/iron (III) complex, diethylenetriaminepentaacetic acid/iron (III) complex and persulfates are especially preferred among them, in view of rapid processability and environmental protection. Fur ther, ethylenediamine-tetraacetic acid/iron (III) complex can be used in an independent bleaching bath or in a combined bleaching and fixing bath, and is therefore especially advantageous.

The bleaching bath or bleach-fixing bath and the pre-bath can optionally contain a bleaching accelerator, if desired. Specific examples of useful bleaching accelerators mercapto group- or disulfide group-containing compounds as described in U.S. Pat. No. 3,893,858, German Patents 1,290,812 and 3,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, Research Disclosure, No. 17129 (July, 1978), etc.; thiazolidine derivatives as described in Japanese Patent Application (OPI) No. 140129/75; thiourea derivatives as described in Japanese Patent Publication No. 8506/70, Japanese Patent Application (OPI)- Nos. 20832/77 and 32735/78 and U.S. Pat. No. 3,706,561; iodides as described in West German Patent 1,127,715 and Japanese Patent Application (OPI) No. 16235/83; polyethylene oxides as described in West German Patents 966,410 and 2,748,430; polyamine compounds as described in Japanese Patent Publication No. 8836/70; and compounds as described in Japanese Patent Application (OPI) Nos. 42434/74, 59644/74, 94927/78, 35727/79, 26506/80 and 163940/83, and iodide or bromide ion, etc. In particular, mercapto group- or disulfide group-containing compounds are preferred, as having a high acceleration effect, among them; and especially, compounds as described in U.S. Pat. No. 3,893,858, West German Patent 1,290,812 and Japanese Patent Application (OpI}No. 95630/78 are more preferred. Further, compounds as described in U.S. Pat. No. 4,552,834 are also preferred. These bleaching accelerators can be incorporated into the photographic light-sensitive materials. These bleaching accelerators are especially effective for bleach-fixation of color photographic light-sensitive materials for picture-taking.

As the fixing agent, although the use of thiosulfates, thiocyanates, thioether series compounds, thioureas, and a large amount of iodides are known, the use of thiosulfates is most typical. As a preservative for the bleach-fixing solution or fixing solution, sulfites, bisulfites or carbonyl-bisulfate adducts are preferred.

After bleach-fixation or fixation, the photographic materials are, in general, rinsed with water or stabilized.

In the rinsing step or stabilization step, various kinds of known compounds can be used for the purpose of prevention of precipitation or of economization of water. For instance, a water-softener such as inorganic phosphoric acids, amino-polycarboxylic acids, organic amino-polyphosphonic acids, organic phosphoric acids, etc.; a germicide or fungicide for prevention of propagation of various bacteria, algae or fungi; a metal salt such as magnesium salts, aluminium salts or bismuth salts; a surfactant for prevention of drying load or unevenness; and a hardener, etc. can be used for preventing the precipitation of the rinsing solution or stabilization solution, if desired. As the case may be, the compounds as described in L. E. West, *Phot. Sci. Eng.*, Vol. 6, pp. 344–359 (1965) can also be added. In particular, the use the addition of a chelating agent or a germicide is effective.

The rinsing step is generally performed by counter-current system, using two or more rinsing tanks, for economization of water. Further, a multi-stage counter-current stabilization step as described in Japanese Patent Application (OPI) No. 8543/72 can be performed in place of the rinsing step. In such stabilization step, 2 to 9 counter-current tanks are necessary. To the stabilization bath are added various kinds of compounds for the purpose of stabilizing the images formed, in addition to the above-mentioned additives. For instance, various kinds of buffers for adjusting the film pH (for example, to pH of from 3 to 9), such as borates, metaborates, borax, phosphates,.carbonates, potassium hydroxide, sodium hydroxide, aqueous ammonia, monocarboxylic acids, dicarboxylic acids and polycarboxylic acids, which can be used in mixture, as well as aldehydes such as formaldehyde can typically be used. In addition, chelating agents (such as inorganic phosphoric acids, aminopolycarboxylic acids, organic phosphoric acids, organic phosphonic acids, aminopolyphosphonic acids, phosphonocarboxylic acids, etc.), germicides (such as benzisothiazoliones, isothiazolones, 4-thiazoline-benzimidazoles, halogenated phenols, sulfamylamides, benzotriazoles, etc.), surfactants, brightening agents, hardeners and other various kinds of additives can also be used, if desired, and two or more compounds having the same or different objects can be used in combination.

As the film pH-adjusting agent for the materials finished, it is preferred to add various kinds of ammonium salts such as ammonium chloride, ammonium nitrate, ammonium sulfate, ammonium phosphate, ammonium sulfite, ammonium thiosulfate, etc.

For processing color photographic materials for picture-taking, the general rinsing-stabilization step after fixation can be replaced by the above-mentioned stabilization step and rinsing step (with water-economization). In this case, when the magenta coupler used is 2-equivalent, the formalin in the stabilization bath can be omitted.

The time for the rinsing or stabilization of the photographic materials of the present invention is, although varying in accordance with the kind of the material and the processing condition, generally from 20 seconds to 10 minutes, and preferably from 20 seconds to 5 minutes.

In the silver halide color photographic materials of the present invention, a color developing agent can be incorporated so as to simplify and accelerate the processing of the materials. For the incorporation, various kinds of precursors of color developing agents are preferably used. For instance, indoaniline series compounds as described in U.S. Pat. No. 3,342,597; Shiff base type compounds as described in U.S. Pat. No. 3,342,599 and Research Disclosure, RD Nos. 14850 (August, 1976) and 15159 (November, 1976); aldole compounds as described in Research Disclosure, RD No. 13924 (November, 1975): metal complexes as described in U.S. Pat. No. 3,719,492; urethane series compounds as described in Japanese Patent Application (OPI) No. 135628/78; and other various kinds of salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82, etc., can be used.

In the silver halide color photographic materials of the present invention, various kinds of 1-phenyl-3-pyrazolidones can be incorporated for the purpose of accelerating the color development, if desired, and specific compounds therefor are described, for example, in Japanese Patent Application (OPI) Nos. 64339/81, 144547/82, 211147/82, 50532/83, 50536/83, 50533/83, 50534/83, 50535/83 and 115438/83, etc.

The processing solutions for use for the materials of the present invention are used at a temperature of from 10° C. to 50° C. Although the processing temperature of from 33° C. to 38° C. is standard, it is possible to elevate the processing temperature to a higher temperature so as to accelerate the processing procedure to reduce the processing time to 60 seconds or less, or on the contrary, to lower the processing temperature to a lower temperature so as to improve the image quality formed and the processing solutions used. Further, the process with cobalt-intensification or hydrogen peroxide-intensification, as described in West German Patent 2,226,770 or U.S. Pat. No. 3,674,499, can be applied so as to economize the silver in the light-sensitive materials.

Each processing bath may be provided with a heater, a temperature sensor, a liquid surface level sensor, a circulation pump, a filter, a floating lid, a squeegee, etc., if desired.

In continuous processing, a replenisher for each processing solution is used so as to prevent variations of the composition of the processing solutions, whereby a constant finish can be attained in the materials processed. The amount of the replenisher to be used can be reduced to a half or less of the standard amount so as to decrease the manufacture cost.

The photographic light-sensitive materials of the present invention can be developed in a mini-laboratory system.

The following example is intended to illustrate the present invention but not to limit it in any way.

EXAMPLE

Preparation of Sample No. 1

A multilayer color photographic paper (Sample No. 1) was prepared by forming the layers having the compositions shown below on a cellulose triacetate film support with a subbing cost.

Compositions of Photographic Layers

Regarding the amoutn coated, the silver halide and colloidal silver are indicated by the amount of the silver therein in units of g/m$^2$; the coupler additive and gelatin are indicated in units of g/m$^2$; and the sensitizing dye was represented by the number of mols per mole of the silver halide in the same layer.

| | |
|---|---|
| First Layer: Anti-halation Layer | |
| Black Colloidal Silver | 0.2 |
| Gelatin | 1.3 |
| Colored Coupler, Cpd-7 | 0.06 |
| Ultraviolet Absorbent, UV-1 | 0.1 |
| Ultraviolet Absorbent, UV-2 | 0.2 |
| Dispersion Oil, Oil-1 | 0.01 |
| Dispersion Oil, Oil-2 | 0.01 |
| Second Layer: Interlayer | |
| Fine Silver Bromide Grains (mean grain size: 0.07 μm) | 0.15 |
| Gelatin | 1.0 |
| Colored Coupler, Cpd-27 | 0.02 |
| Dispersion Oil, Oil-1 | 0.1 |
| Third Layer: First Red-Sensitive Emulsion Layer | |
| Silver Iodobromide Emulsion (silver iodide: 4 mol %, variation coefficient of grain size (s/r) = 0.12, mean grain size (r) = 0.7 μm) (The emulsion of this kind is designated as follows, hereinafter) | 0.6 |
| ($I^-$ 4 mol, s/r = 0.12, 0.7 μm) | 0.6 |
| Silver Iodobromide Emulsion ($I^-$ 3 mol, s/r = 0.11, 0.3 μm) | 0.3 |
| Gelatin | 0.6 |
| Sensitizing Dye I | $4 \times 10^{-4}$ |
| Sensitizing Dye II | $5 \times 10^{-5}$ |
| Cpd-9 | 0.010 |
| Cpd-10 | 0.010 |
| Cpd-21 | 0.50 |
| Cpd-27 | 0.04 |
| Oil-1 | 0.15 |
| Oil-3 | 0.02 |
| Fourth Layer: Second Red-Sensitive Emulsion Layer | |
| Silver Iodobromide Emulsion ($I^-$ 6 mol, s/r = 0.15, 1.0 μm) | 0.7 |
| Gelatin | 1.0 |
| Sensitizing Dye I | $4 \times 10^{-4}$ |
| Sensitizing Dye II | $5 \times 10^{-5}$ |
| Cpd-24 | 0.1 |
| Cpd-28 | 0.1 |
| Oil-1 | 0.01 |
| Oil-4 | 0.05 |
| Fifth Layer: Interlayer | |
| Gelatin | 0.5 |
| Cpd-6 | 0.10 |
| Oil-1 | 0.05 |
| Sixth Layer: First Green-Sensitive Emulsion Layer | |
| Silver Iodobromide Emulsion ($I^-$ 4 mol, s/r = 0.11, 0.6 μm) | 0.35 |
| Silver Iodobromide Emulsion ($I^-$ 3 mol, s/r = 0.15, 0.3 μm) | 0.20 |
| Gelatin | 1.0 |
| Sensitizing Dye III | $5 \times 10^{-4}$ |
| Sensitizing Dye IV | $1 \times 10^{-4}$ |
| Cpd-5 | 0.3 |
| Cpd-7 | 0.07 |
| Cpd-13 | 0.03 |
| Oil-1 | 0.3 |
| Oil-4 | 0.01 |
| Seventh Layer: Second Green-Sensitive Emulsion Layer | |
| Silver Iodobromide Emulsion ($I^-$ 6 mol, s/r = 0.18, 0.8 μm) | 0.8 |
| Gelatin | 0.5 |
| Sensitizing Dye III | $5 \times 10^{-4}$ |
| Sensitizing Dye IV | $1 \times 10^{-4}$ |
| Gelatin | 0.5 |
| Cpd-5 | 0.1 |
| Cpd-15 | 0.1 |
| Cpd-8 | 0.01 |
| Cpd-7 | 0.02 |
| Oil-1 | 0.2 |
| Oil-4 | 0.05 |
| Eighth Layer: Interlayer | |
| Gelatin | 0.5 |
| Cpd-6 | 0.05 |
| Oil-1 | 0.03 |
| Ninth Layer: Interlayer Effect-donor Layer | |
| Silver Iodobromide Emulsion (silver iodide: 2 mol %; tabular grains with aspect ratio of 6.0 and mean grain diameter of 1.0 μm) | 0.35 |

-continued

| | |
|---|---|
| (The emulsion of this kind is designated as follows, hereinafter: | |
| ($I^-$ 2 mol, A/R = 6.0, 1.0 μm) 0.35 | |
| Silver Iodobromide Emulsion | 0.20 |
| ($I^-$ 2 mol, A/R = 6.5, 0.5 μm) | |
| Gelatin | 0.7 |
| Sensitizing Dye III | $8 \times 10^{-4}$ |
| Cpd-3 | 0.18 |
| Cpd-4 | 0.05 |
| Cpd-5 | 0.13 |
| Oil-1 | 0.20 |
| Tenth Layer: Yellow Filter Layer | |
| Gelatin | 0.5 |
| Cpd-2 | 0.25 |
| Cpd-6 | 0.10 |
| Eleventh Layer: First Blue-Sensitive Emulsion Layer | |
| Silver Iodobromide Emulsion | 0.3 |
| ($I^-$ 3 mol, A/R = 7.5, 1.0 μm) | |
| Silver Iodobromide Emulsion | 0.15 |
| ($I^-$ 3 mol, A/R = 7.5, 0.5 μm) | |
| Gelatin | 1.0 |
| Sensitizing Dye V | $2 \times 10^{-4}$ |
| Cpd-1 | 0.05 |
| Cpd-8 | 0.10 |
| Cpd-29 | 0.80 |
| Oil-1 | 0.20 |
| Twelfth Layer: Second Blue-Sensitive Emulsion Layer | |
| Silver Iodobromide Emulsion | 0.5 |

-continued

| | |
|---|---|
| ($I^-$ 10 mol, $s/\bar{r}$ = 0.11, 1.2 μm) | |
| Gelatin | 0.5 |
| Sensitizing Dye V | $1 \times 10^{-4}$ |
| Cpd-29 | 0.20 |
| Cpd-3 | 0.02 |
| Oil-1 | 0.10 |
| Thirteenth Layer: First Protective Layer | |
| Gelatin | 0.8 |
| UV-1 | 0.1 |
| UV-2 | 0.2 |
| Oil-1 | 0.01 |
| Oil-2 | 0.01 |
| Fourteenth Layer: Second Protective Layer | |
| Fine Silver Bromide Grain Emulsion | 0.5 |
| ($I^-$ 2 mol, $s/\bar{r}$ = 0.2, 0.07 μm) | |
| Gelatin | 0.45 |
| Polymethyl methacrylate grains (diameter: 1.5 μm) | 0.2 |
| Hardener, H-1 | 0.4 |
| Formaldehyde Scavenger, S-1 | 0.5 |
| Formaldehyde Scavenger, S-2 | 0.5 |

Cpd-26 as an emulsion stabilizer and a surfactant as a coating assistant were added to each layer, in addition to the above-mentioned composition.

The compounds used for the preparation of the sample are noted below.

Cpd-1

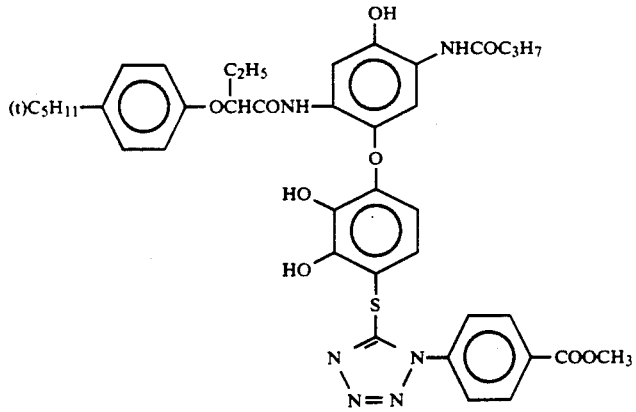

Cpd-2

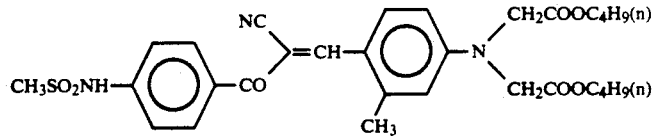

Cpd-3

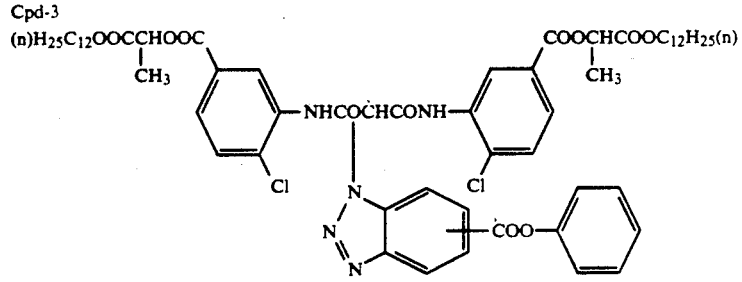

Cpd-4

-continued
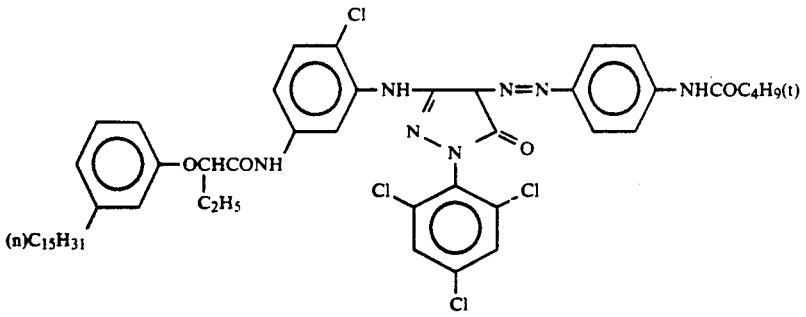
Cpd-5
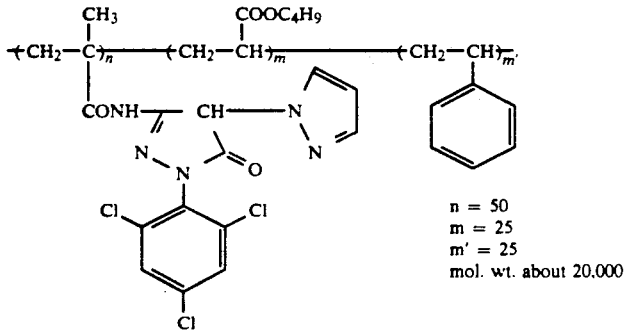
Cpd-6
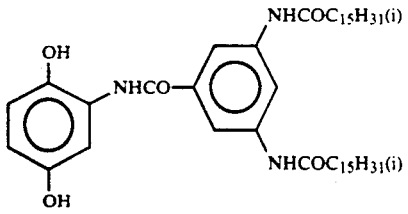
Cpd-7
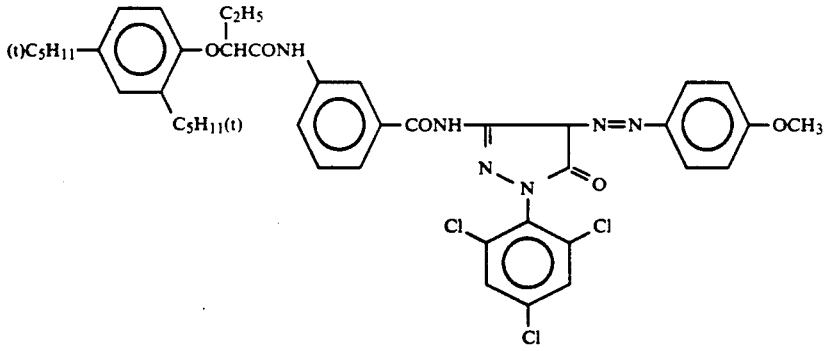
Cpd-8
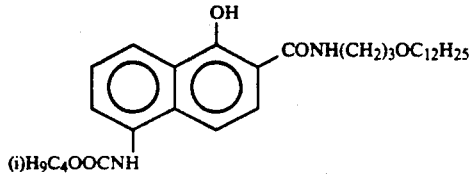
Cpd-9

-continued
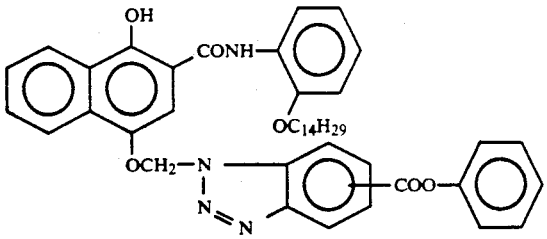
Cpd-10
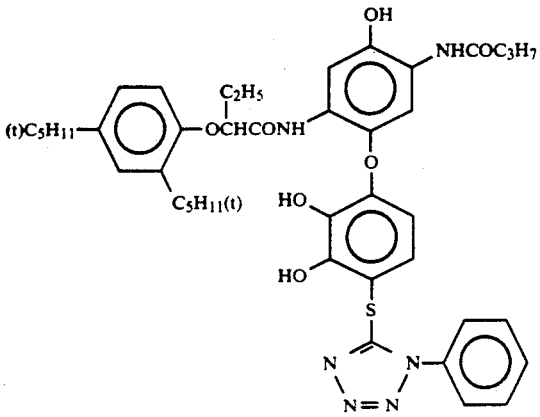
Cpd-11
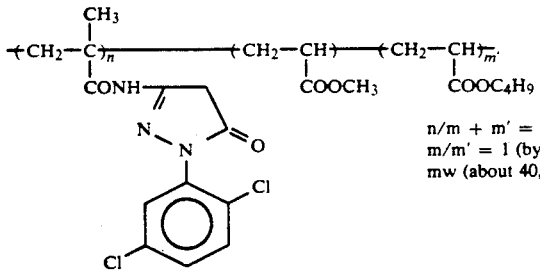
n/m + m' = 1
m/m' = 1 (by weight)
mw (about 40,000)
Cpd-12
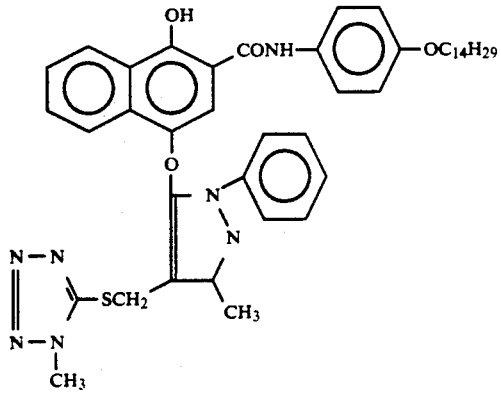
Cpd-13

-continued
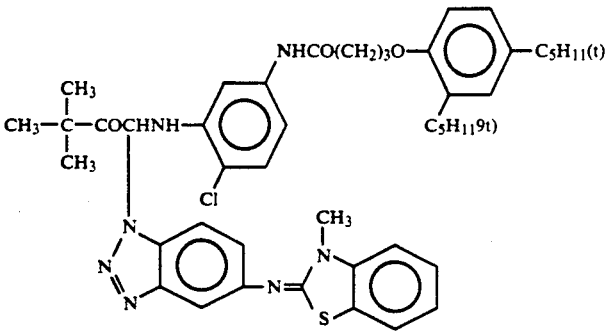
Cpd-14
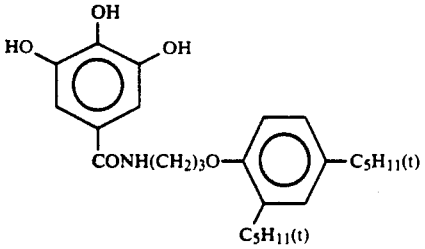
Cpd-15
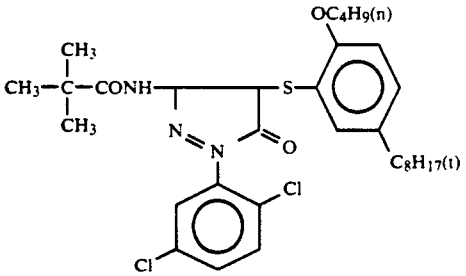
Cpd-16
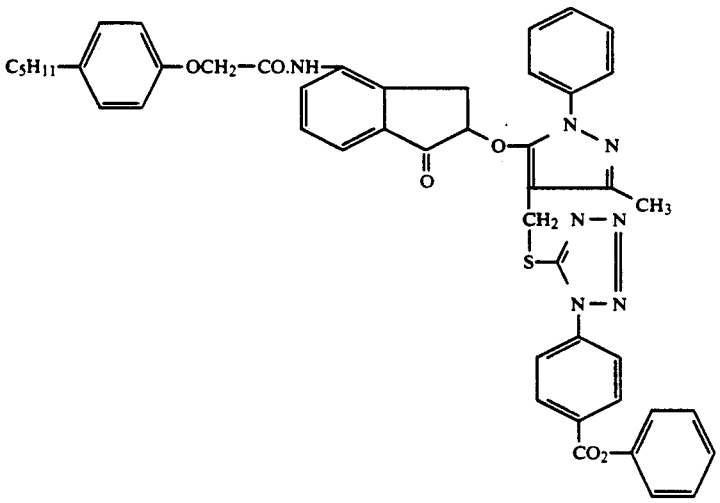
Cpd-17

-continued
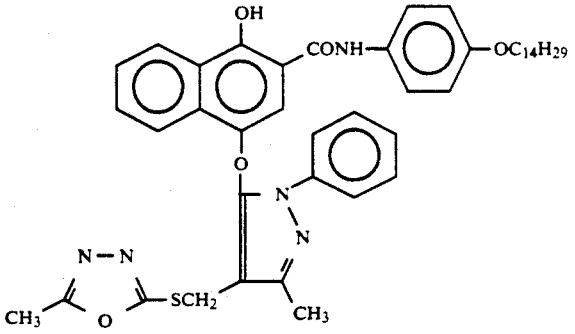
Cpd-18
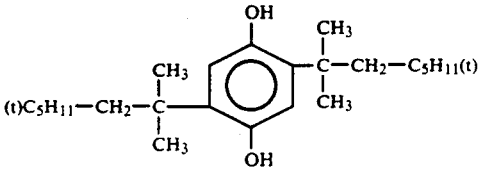
Cpd-19
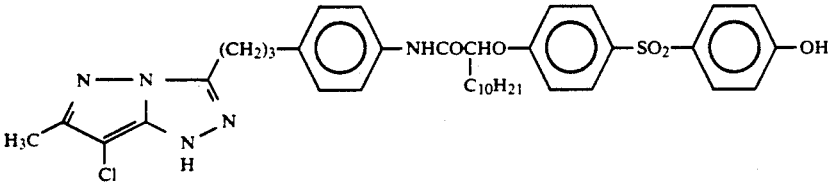
Cpd-20
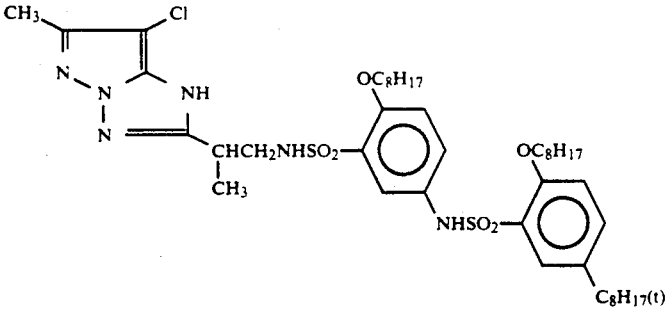
Cpd-21
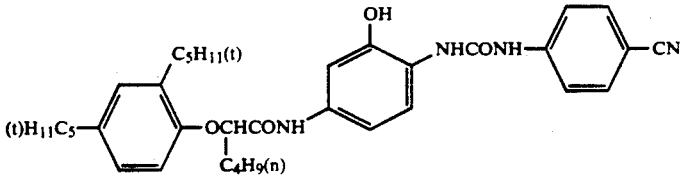
Cpd-22
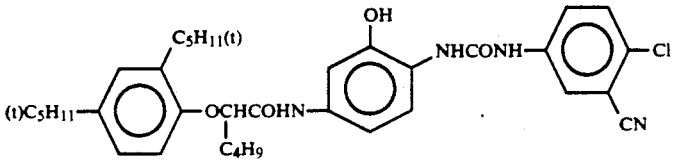
Cpd-23

-continued
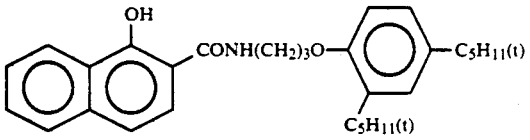
Cpd-24
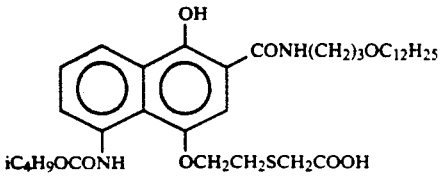
Cpd-25
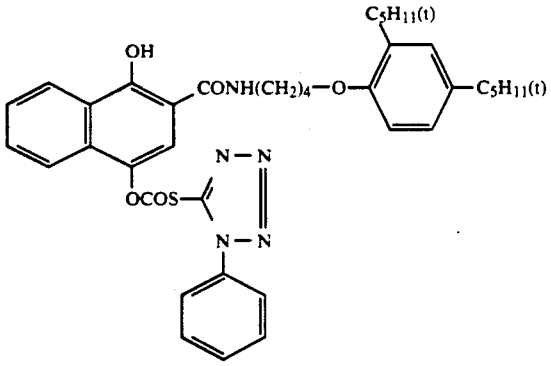
Cpd-26
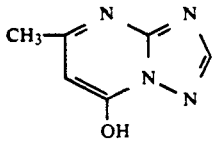
Cpd-27
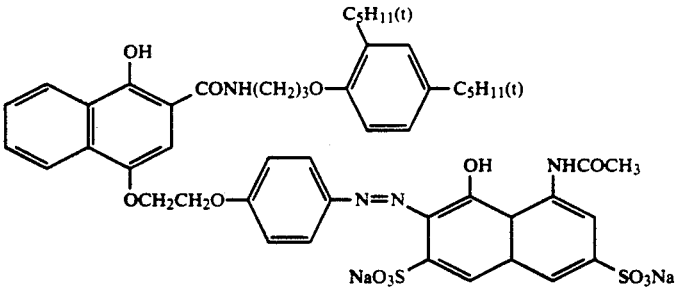
Cpd-28
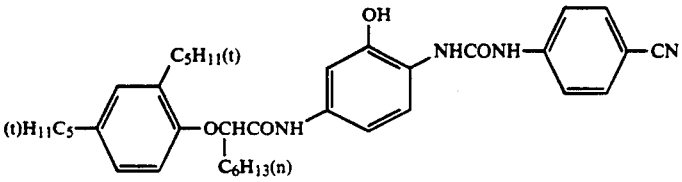
Cpd-29

-continued
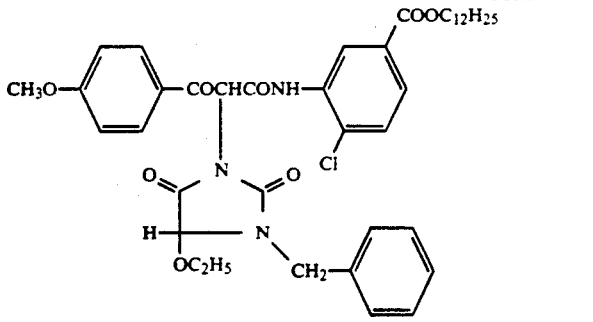
Sensitizing Dye I:
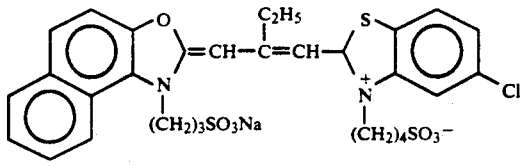
Sensitizing Dye II:
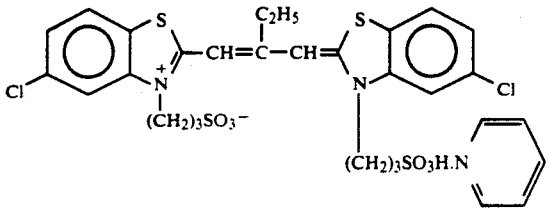
Sensitizing Dye III:
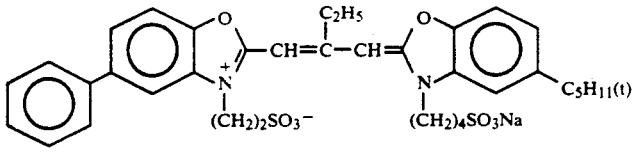
Sensitizing Dye IV:
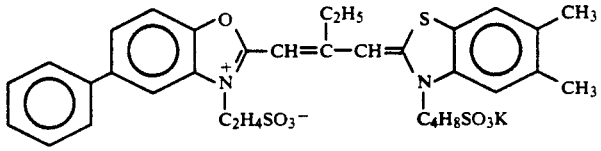
Sensitizing Dye V:
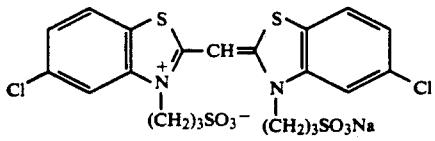
UV-1
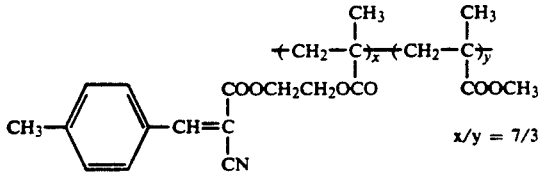
x/y = 7/3 (by weight)
UV-2
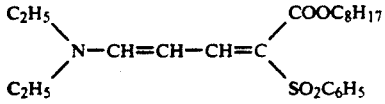

-continued

Oil-1: Tricresyl Phosphate
Oil-2: Dibutyl phthalate
Oil-3: Bis(2-ethylhexyl) Phthalate

H-1

$$\begin{array}{l} CH_2{=}CH{-}SO_2{-}CH_2{-}CONH{-}CH_2 \\ \qquad\qquad\qquad\qquad\qquad\qquad\quad | \\ CH_2{=}CH{-}SO_2{-}CH_2{-}CONH \quad CH_2 \end{array}$$

S-1

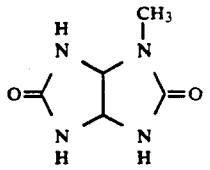

The sample prepared as above was called Sample No. 1.

Next, other Sample Nos. 2 to 21 were prepared in the same manner as the preparation of the Sample No. 1, except that the composition as shown in the following Table 1 were used.

In addition, the Table 2 shows the combinations of the conditions (a), (b), (c) and (d), as well as (i), (ii), (iii), (iv), (v), (vi) and (vii) of the present invention, and the presence (or absence) of the 2-equivalent magneta coupler, where the mark "○" means "incorporated" and the mark "—" means "not incorporated".

Using the samples thus obtained, the objects of a chart for MTF-measurement, a color standard paper and a female model with flowers were simultaneously photographed with a tungsten lamp light source under the illumination condition as regulated to have a color temperature of 4800° K. with a filter. On the other hand, the samples were wedge-wise exposed and then developed by the following processing procedure at 38° C. and used for sensitometry measurement.

| Processing Steps: | |
|---|---|
| Color Development | 3 min 15 sec |
| Bleaching | 6 min 30 sec |
| Rinsing | 2 min 10 sec |
| Fixation | 4 min 20 sec |
| Rinsing | 3 min 15 sec |
| Stabilization | 1 min 05 sec |

The compositions of the processing solutions used in the respective steps are as follows:

| Color Developer: | |
|---|---|
| Diethylenetriamine-pentaacetic Acid | 1.0 g |
| 1-Hydroxyethylidene-1,1-dixphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 2-(N-ethyl-N-β-hydroxyethylamino)-2-methylaniline Sulfate | 4.5 g |
| Water to make | 1.0 liter pH = 10.0 |
| **Bleaching Agent:** | |
| Ammonium Ferric Ethylenediamine-tetraacetate | 100.0g |
| Disodium Ethylenediamine-tetraacetate | 10.0 g |
| Ammonium Bromide | 150.0g |
| Ammonium Nitrate | 10.0 g |
| Water to make | 1.0 liter pH = 6.0 |
| **Fixing Solution:** | |
| Disodium Ethylenediamine-tetraacetate | 1.0 g |
| Sodium Sulfite | 4.0 g |

-continued

| | |
|---|---|
| Ammonium Thiosulfate Aqueous Solution (70 wt %) | 175.0ml |
| Sodium Bisulfite | 4.6 g |
| Water to make | 1.0 liter pH = 6.6 |
| **Stabilizer Solution:** | |
| Formalin (40 wt % formaldehyde solution) | 2.0 ml |
| Poloxyethylene-p-monononylphenylether (mean polymerization degree: 10) | 0.3 g |
| Water to make | 1.0 liter |

Next, the negative films obtained were enlarged and printed on color photographic papers (enlargement: 6.7 times) to obtain photographs. The photographs of the color photographic papers from the negative films obtained by the present invention were excellent in the image quality, having excellent hue and high chroma. The image quality of each negative film obtained was represented in the Table 2 by the MTF-value of RL, as the MTF-value of RL was poorest among those of BL, GL, and RL. The graininess was represented by RMS on the basis of visual observation. The RMS was measured by means of a well known method, for example, as described in *Photographic Science and Engineering*, Vol. 19, No. 4 (1975), pp. 235-238, "RMS Granularity: Determination of Just Noticeable Difference", whereupon the aperture for the measurement was 10 μm.

Using the Sample Nos. 14 to 21 of the present invention, disposable camera units with an exposure mechanism, which correspond to "Utsurundesu"*RTM* (by Fuji Photo Film Co.), were manufactured, and these were exposed for picture-taking on a fine day at a horizontal position of about 3.6 m, and then processed. Afterwards, the negative films obtained were enlarged and printed on E-size (82.5 mm×120 mm) photographic papers in accordance with conventional photo-processing means. The enlargement on printing was about 6.7 times. Thus, excellent photographs were obtained, having a resolving power of 4 to 5 lines/mm or more, with an acceptable sharpness standard of MTF density attenuation rate 0.5.

From the results of the example, it is understood that the color photographic light-sensitive materials of the present invention have excellent color-reproducibility, image-sharpnesss and graininess.

Accordingly, the characteristic feature of the present invention is to provide color photographic light-sensitive materials which may form color images with an extremely improved color-reproducibility, and excellent image sharpness and graininess.

TABLE 1

| Sample No. | 3rd Layer Emulsion | 3rd Layer Coupler, etc. | 4th Layer Emulsion | 4th Layer Coupler, etc. | 5th Layer Emulsion | 5th Layer Coupler, etc. |
|---|---|---|---|---|---|---|
| 1 (The Inv.) | (I−4, s/r̄ 0.12, 0.7μ) 0.6<br>(I−3, s/r̄ 0.11, 0.3μ) 0.3 | Cpd 9 0.010<br>Cpd 10 0.010<br>Cpd 21 0.5 | (I−6, s/r̄ 0.15, 1.0μ) 0.7 | Cpd 24 0.1<br>Cpd 28 0.1 | Aforementioned | Aforementioned |
| 2 (The Inv.) | ↑ | Cpd 9 0.020<br>Cpd 10 0<br>Cpd 21 0.51 | ↑ | ↑ | ↑ | ↑ |
| 3 | ↑ | ↑ | ↑ | ↑ | ↑ | ↑ |
| 4 | ↑ | ↑ | ↑ | ↑ | ↑ | ↑ |
| 5 | ↑ | ↑ | ↑ | ↑ | ↑ | ↑ |
| 6 | ↑ | ↑ | ↑ | ↑ | ↑ | ↑ |
| 7 | ↑ | Cpd 21 0.60 | ↑ | ↑ | ↑ | ↑ |
| 8 | ↑ | Cpd 9 0.010<br>Cpd 10 0.010<br>Cpd 21 0.5 | ↑ | ↑ | ↑ | ↑ |
| 9 | ↑ | Cpd 9 0.020<br>Cpd 10 0<br>Cpd 21 0.51 | ↑ | ↑ | ↑ | ↑ |
| 10 | ↑ | ↑ | ↑ | ↑ | ↑ | ↑ |
| 11 | ↑ | ↑ | ↑ | ↑ | ↑ | ↑ |
| 12 | ↑ | ↑ | ↑ | ↑ | ↑ | ↑ |
| 13 | ↑ | Cpd 9 0.010<br>Cpd 10 0.010<br>Cpd 21 0.5 | ↑ | ↑ | ↑ | ↑ |
| 14 | ↑ | ↑ | ↑ | ↑ | ↑ | ↑ |
| 15 | ↑ | ↑ | ↑ | ↑ | ↑ | ↑ |
| 16 | ↑ | ↑ | ↑ | ↑ | ↑ | ↑ |
| 17 | ↑ | ↑ | ↑ | ↑ | ↑ | ↑ |
| 18 | ↑ | ↑ | ↑ | ↑ | ↑ | ↑ |
| 19 | ↑ | ↑ | ↑ | ↑ | ↑ | ↑ |
| 20 | ↑ | ↑ | ↑ | ↑ | ↑ | ↑ |
| 21 | ↑ | ↑ | ↑ | Cpd 3 0.01<br>Cpd 24 0.05<br>Cpd 25 0.05<br>Cpd 28 oil | ↑ | ↑ |

| Sample No. | 6th Layer Emulsion | 6th Layer Coupler, etc. | 7th Layer Emulsion | 7th Layer Coupler, etc. | 8th Layer Emulsion | 8th Layer Coupler, etc. |
|---|---|---|---|---|---|---|
| 1 (The Inv.) | (I−4, s/r̄ 0.11, 0.6μ) 0.35<br>(I−3, s/r̄ 0.15, 0.3μ) 0.20 | Cpd 5 0.3<br>Cpd 7 0.07<br>Cpd 13 0.03 | (I−6, s/r̄ 0.15, 0.8μ) 0.8 | Cpd 15 0.10<br>Cpd 5 0.10<br>Cpd 7 0.03<br>Cpd 14 0.01 | — | Cpd 5 0.05 |
| 2 | ↑ | ↑ | ↑ | ↑ | ↑ | ↑ |
| 3 | (I−4, s/r̄ 0.11, 0.5μ) 0.28<br>(I−3, s/r̄ 0.15, 0.3μ) 0.15 | Cpd 5 0.3<br>Cpd 7 0.07<br>Cpd 13 0 | (I−6, s/r̄ 0.18, 0.8μ) 0.7 | ↑ | ↑ | ↑ |
| 4 | ↑ | ↑ | (I−6, s/r̄ 0.18, 0.8μ) 0.6 | Cpd 15 0.10<br>Cpd 5 0.10<br>Cpd 7 0.03<br>Cpd 14 0 | ↑ | ↑ |
| 5 | ↑ | ↑ | ↑ | Cpd 11 0.10<br>Cpd 5 0.10<br>Cpd 7 0.03<br>Cpd 14 0 | ↑ | ↑ |
| 6 | (I−4, s/r̄ 0.11, 0.65μ) 0.35<br>(I−3, s/r̄ 0.15, 0.35μ) 0.20 | ↑ | (I−6, s/r̄ 0.18, 1.0μ) 0.7 | ↑ | ↑ | ↑ |
| 7 | (I−4, s/r̄ 0.30, 0.58μ) 0.4<br>(I−3, s/r̄ 0.32, 0.3μ) 0.25 | ↑ | (I−6, s/r̄ 0.35, 0.8μ) 0.8 | ↑ | ↑ | ↑ |
| 8 | ↑ | ↑ | ↑ | ↑ | ↑ | ↑ |
| 9 | (I−4, s/r̄ 0.30, 0.65μ) 0.45<br>(I−3, s/r̄ 0.32, 0.4μ) 0.3 | Cpd 5 0.3<br>Cpd 7 0.07<br>Cpd 13 0.03 | ↑ | ↑ | ↑ | ↑ |
| 10 | ↑ | ↑ | (I−6, s/r̄ 0.35, 0.8μ) 0.9 | Cpd 15 0.10<br>Cpd 5 0.10<br>Cpd 7 0.03<br>Cpd 14 0.01 | ↑ | ↑ |
| 11 | (I−4, s/r̄ 0.30, 0.60 μm) 0.4<br>(I−3, s/r̄ 0.11, 0.35μ) 0.25 | ↑ | (I−6, s/r̄ 0.35, 0.7μ) 0.8 | ↑ | ↑ | ↑ |
| 12 | (I−4, s/r̄ 0.11, 0.65 μm) 0.35<br>(I−3, s/r̄ 0.15, 0.35μ) 0.20 | ↑ | (I−6, s/r̄ 0.18, 1.0μ) 0.7 | ↑ | ↑ | ↑ |
| 13 | (I−4, s/r̄ 0.11, 0.6 μm) 0.35<br>(I−4, s/r̄ 0.15, 0.3μ) 0.20 | Cpd 11 0.7<br>Cpd 7 0.07<br>Cpd 13 0.03 | (I−6, s/r̄ 0.18, 0.8μ) 0.8 | Cpd 11 0.30<br>Cpd 5 0<br>Cpd 7 0.03<br>Cpd 14 0 | ↑ | ↑ |
| 14 | ↑ | Cpd 5 0.3<br>Cod 7 0.07<br>Cpd 13 0.03 | ↑ | Cpd 11 0.10<br>Cpd 5 0.10<br>Cpd 7 0.03<br>Cpd 14 0 | ↑ | ↑ |

TABLE 1-continued

| | | | | | | |
|---|---|---|---|---|---|---|
| 15 | ↑ | ↑ | ↑ | Cpd 15 0.10<br>Cpd 5 0.10<br>Cpd 7 0.03<br>Cpd 14 0.01 | ↑ | ↑ |
| 16 | ↑ | ↑ | ↑ | ↑ | ↑ | ↑ |
| 17 | ↑ | ↑ | ↑ | ↑ | ↑ | ↑ |
| 18 | ↑ | ↑ | ↑ | ↑ | ↑ | ↑ |
| 19 | ↑ | Cpd 19 0.4<br>Cpd 7 0.07<br>Cpd 13 0.03 | ↑ | ↑ | ↑ | ↑ |
| 20 | ↑ | Cpd 20 0.4<br>Cod 7 0.07<br>Cpd 13 0.03 | ↑ | ↑ | ↑ | ↑ |
| 21 | ↑ | ↑ | ↑ | ↑ | ↑ | ↑ |

| Sample No. | 9th Layer Emulsion | 9th Layer Coupler, etc. | 10th Layer Emulsion | 10th Layer Coupler, etc. | 11th Layer Emulsion | 11th Layer Coupler, etc. |
|---|---|---|---|---|---|---|
| 1 | (I−2, AR 6, 1.0μ) 0.35 μm<br>(I−3, AR 6.5 0.5μ) 0.20 μm | Cpd 3 0.18<br>Cpd 4 0.05<br>Cpd 21 0.5 | — | Cpd 2 0.25<br>Cpd 6 0.10<br>Gelatin 0.5 | (I−3, AR 7.5, 1.0μ) 0.3<br>(I−3, AR 7.5, 0.5μ) 0.15 | Cpd 1 0.05<br>Cpd 8 0.10<br>Cpd 29 0.80 |
| 2 | ↑ | ↑ | ↑ | ↑ | ↑ | Cpd 9 0.<br>Cpd 8 0.<br>Cpd 29 0.80 |
| 3 | ↑ | ↑ | ↑ | ↑ | ↑ | ↑ |
| 4 | ↑ | ↑ | ↑ | ↑ | ↑ | ↑ |
| 5 | ↑ | ↑ | ↑ | ↑ | ↑ | ↑ |
| 6 | (I−2, AR 6, 1.4μ) 0.45 μm<br>(I−3, AR 6.5 0.5μ) 0.3 μm | | Yellow Colloidal Silver 0.12 g/m² | Cpd 2 0<br>Cpd 6 0.10<br>Gelatin 0.5 | ↑ | ↑ |
| 7 | (I−6, s/r̄ 0.35, 0.8μ) 0.5<br>(I−4, s/r 0.32, 0.3μ) 0.25 | ↑ | ↑ | ↑ | (I−4, s/r̄ 0.33, 0.4 μm) 0.5 | Cpd 13 0.05<br>Cpd 29 0.90 |
| 8 | ↑ | ↑ | ↑ | ↑ | ↑ | Cpd 1 0.05<br>Cpd 8 0.<br>Cpd 29 0. |
| 9 | ↑ | ↑ | ↑ | ↑ | ↑ | Cpd 9 0.05<br>Cpd 8 0.10<br>Cpd 29 0.80 |
| 10 | ↑ | ↑ | ↑ | ↑ | ↑ | ↑ |
| 11 | (I−6, s/r̄ 0.35, 0.7 μm) 0.4<br>(I−4, s/r 0.32, 025 μm) 0.2 | ↑ | — | Cpd 2 0.25<br>Cpd 6 0.10<br>Gelatin 0.5 | ↑ | ↑ |
| 12 | (I−2, AR 6, 1.4 μm) 0.45<br>(I−2, AR 6.5, 0.7 μm) 0.3 | ↑ | Yellow Colloidal Silver 0.12 g/m² | Cpd 2 0<br>Cpd 6 0.10<br>Gelatin 0.5 | (I−3, AR 7.5, 1.0 μm) 0.3<br>(I−3, AR 7.5, 0.5 μm) 0.15 | ↑ |
| 13 | (I−2, AR 6, 1.0 μm) 0.35<br>(I−2, AR 6.5, 0.5 μm) 0.20 | ↑ | — | Cpd 2 0.25<br>Cpd 6 0.10<br>Gelatin 0.5 | ↑ | ↑ |
| 14 | ↑ | ↑ | ↑ | ↑ | ↑ | ↑ |
| 15 | ↑ | ↑ | ↑ | ↑ | (I−4, s/r̄ 0.1, 0.7 μm) 0.3<br>(I−4, s/r 0.15, 0.3 μm) 0.2 | ↑ |
| 16 | (I−6, s/r̄ 0.12, 0.7 μm) 0.4<br>(I−4, s/r 0.15, 0.3 μm) 0.2 | ↑ | ↑ | ↑ | (I−3, AR 7.5, 1.0 μm) 0.3<br>(I−3, AR 7.5, 0.5 μm) 0.15 | ↑ |
| 17 | ↑ | ↑ | ↑ | ↑ | ↑ | Cpd 13 0.05<br>Cpd 29 0.80 |
| 18 | ↑ | ↑ | ↑ | ↑ | ↑ | Cpd 17 0.05<br>Cpd 8 0.10<br>Cpd 29 0. |
| 19 | ↑ | ↑ | ↑ | ↑ | ↑ | Cpd 1 0.05<br>Cpd 8 0.10<br>Cpd 29 0.80 |
| 20 | ↑ | ↑ | ↑ | ↑ | ↑ | |
| 21 | ↑ | Sensitiving Dye IV<br>Cpd 13 0.18<br>Cpd 4 0.05<br>Cpd 16 0.03 | ↑ | ↑ | ↑ | ↑ |

| Sample No. | 12th Layer Emulsion | 12th Layer Coupler, etc. | 13th Layer Emulsion | 13th Layer Coupler, etc. | 14th Layer Emulsion | 14th Layer Coupler, etc. |
|---|---|---|---|---|---|---|
| 1 | (I−10, s/r̄ 0.11, 1.2 μm) 0.5 | Cpd 29 0.20<br>Cpd 3 0.02 | Aforementioned | Aforementioned | (I−2, s/r̄ 0.2, 0.07 μm) 0.5 | Aforementioned |
| 2 | ↑ | ↑ | ↑ | ↑ | ↑ | ↑ |
| 3 | ↑ | ↑ | ↑ | ↑ | ↑ | ↑ |
| 4 | ↑ | ↑ | ↑ | ↑ | ↑ | ↑ |
| 5 | ↑ | ↑ | ↑ | ↑ | ↑ | ↑ |
| 6 | ↑ | ↑ | ↑ | ↑ | ↑ | ↑ |
| 7 | (I−10, s/r̄ 0.3, 1.0 μm) 0.5 | Cpd 29 0.20<br>Cpd 13 0.02 | ↑ | ↑ | ↑ | ↑ |
| 8 | ↑ | Cpd 29 0.20<br>Cpd 3 0.02 | ↑ | ↑ | ↑ | ↑ |

TABLE 1-continued

| | | | | | | |
|---|---|---|---|---|---|---|
| 9 | ↑ | ↑ | ↑ | ↑ | ↑ | ↑ |
| 10 | ↑ | ↑ | ↑ | ↑ | ↑ | ↑ |
| 11 | ↑ | ↑ | ↑ | ↑ | ↑ | ↑ |
| 12 | (I⁻10, s/r̄ 0.11, 1.2 μm) 0.5 | ↑ | ↑ | ↑ | ↑ | ↑ |
| 13 | ↑ | ↑ | ↑ | ↑ | ↑ | ↑ |
| 14 | ↑ | ↑ | ↑ | ↑ | ↑ | ↑ |
| 15 | ↑ | ↑ | ↑ | ↑ | ↑ | ↑ |
| 16 | ↑ | ↑ | ↑ | ↑ | ↑ | ↑ |
| 17 | ↑ | Cpd 29 0.20<br>Cpd 3 0 | ↑ | ↑ | ↑ | ↑ |
| 18 | ↑ | ↑ | ↑ | ↑ | ↑ | ↑ |
| 19 | ↑ | Cpd 29 0.20<br>Cpd 3 0 | ↑ | ↑ | ↑ | ↑ |
| 20 | ↑ | ↑ | ↑ | ↑ | ↑ | ↑ |
| 21 | ↑ | ↑ | ↑ | ↑ | ↑ | ↑ |

TABLE 2

| | Constitutional Element of The Invention | | | | | | | | | | | | Results | | |
|---|---|---|---|---|---|---|---|---|---|---|---|---|---|---|---|
| | | | | | | | | | | | | 2-equivalent | MTF of RL | | RMS × 100 |
| Sample No. | (a) | (b) | (c) | (d) | (i) | (ii) | (iii) | (iv) | (v) | (vi) | (vii) | MCp | 10/mm | 20/mm | (Visual) |
| 1 (The Invention) | O | O | O | O | O | O | O | O | O | O | O | O | 1.00 | 0.86 | 1.50 |
| 2 (The Invention) | O | O | O | O | O | — | O | O | O | O | O | O | 0.96 | 0.79 | 1.51 |
| 3 (The Invention) | O | O | O | O | O | — | — | O | O | O | O | O | 0.96 | 0.78 | 1.59 |
| 4 (The Invention) | O | O | O | O | O | — | — | — | O | O | O | O | 0.95 | 0.77 | 1.70 |
| 5 (The Invention) | O | O | O | O | O | — | — | — | — | O | O | O | 0.95 | 0.77 | 1.80 |
| 6 (The Invention) | O | O | O | O | O | — | — | — | — | — | O | O | 0.95 | 0.77 | 1.98 |
| 7 (Comparison) | O | — | O | — | — | — | — | — | — | — | — | O | 0.90 | 0.70 | 1.98 |
| 8 (The Invention) | O | O | O | O | O | O | — | — | — | — | — | O | 0.96 | 0.80 | 1.96 |
| 9 (The Invention) | O | O | O | O | O | — | O | — | — | — | — | O | 0.91 | 0.72 | 1.87 |
| 10 (The Invention) | O | O | O | O | O | — | O | O | O | — | — | O | 0.93 | 0.73 | 1.85 |
| 11 (The Invention) | O | O | O | O | O | — | O | O | O | O | — | O | 0.92 | 0.71 | 1.80 |
| 12 (The Invention) | O | O | O | O | O | — | O | O | O | — | O | O | 0.99 | 0.81 | 1.94 |
| 13 (The Invention) | O | O | O | O | O | O | O | — | — | O | O | — | 0.95 | 0.82 | 1.51 |
| 14 (The Invention) | O | O | O | O | O | O | O | — | — | O | O | O | 1.00 | 0.86 | 1.59 |
| 15 (The Invention) | O | O | O | O | O | O | O | O | O | O | O | O | 0.96 | 0.81 | 1.50 |
| 16 (The Invention) | O | O | O | O | O | O | O | O | O | O | O | O | 1.02 | 0.84 | 1.46 |
| 17 (The Invention) | O | O | O | — | O | O | O | O | O | O | O | O | 0.95 | 0.77 | 1.46 |
| 18 (The Invention) | O | O | O | O | O | O | O | O | O | O | O | O | 0.98 | 0.83 | 1.50 |
| 19 (The Invention) | O | O | O | O | O | O | O | O | O | O | O | O | 0.97 | 0.83 | 1.43 |
| 20 (The Invention) | O | O | O | O | O | O | O | O | O | O | O | O | 0.97 | 0.84 | 1.45 |
| 21 (The Invention) | O | O | O | O | O | O | O | O | O | O | O | O | 1.00 | 0.86 | 1.40 |

While the invention has been described in detail and with reference to specific embodiments. thereof, it will be apparent to one skilled in the art that various changes and modifications can be made therein without departing from the spirit and scop thereof.

What is claimed is:

1. A silver halide color photographic material comprising at least one yellow coupler-containing silver halide emulsion layer (BL) spectrally sensitized such that the specific spectral sensitivity range falls within the scope of from 400 nm to 520 nm, at least one magenta coupler-contianing silver halide emulsion layer (GL) spectrally sensitized such that the specific spectral sensitivity range falls within the scope of from 470 nm to 620 nm, and at least one cyan coupler-containing silver halide emulsion layer (RL) spectrally sensitized such that the specific spectral sensitivity range falls within the scope of from 540 nm to 700 nm, wherein the center of gravity of the sensitivity wavelength of the GL's spectral sensitivity distribution ($\lambda_G$) falls within the range of from about 520 nm to about 580 nm, the center of gravity of the sensitivity wavelength of the RL's spectral sensitivity distribution ($\lambda_R$) falls within the range of from about 590 nm to about 650 nm, and the center of gravity of the sensitivity wavelength of the BL's spectral sensitivity distribution ($\lambda_B$) falls within the range of from about 430 nm to about 480 nm, and that the material satisfies the following conditions (a), (b) and (c):

(a) the center of gravity of the sensitivity wavelength of the negative interlayer effect relative to the RL ($\lambda_{-R}^{max}$) falls within the range of from about 490 nm to about 560 nm;

(b) the center of gravity of the sensitivity wavelength of the negative interlayer effect relative to the GL ($\lambda_{-G}^{max}$) falls within the range of at least one of from about 400 nm to about 500 nm and from about 570 nm to about 670 nm; and (c) the center of gravity of the sensitivity wavelength of the negative interlayer effect relative to the BL ($\lambda_{-B}^{max}$) falls within the range of from about 520 nm to about 590 nm;

and the material further satisfies the following conditions (i), (ii) and (iii) and the GL of the material satisfies at least one of the following conditions (iv) and (v), and further satisfies the following condition (vi):

(i) at least one of the BL and RL contains a DIR-coupler capable of reacting with the oxidation produce of a developing agent during development to release a development inhibitor having a diffusible degree of from 0.4 to 0.95 or a percursor thereof;

(ii) at least one of the BL and RL and interlayer contains a compound capable of reacting with the oxidation product of a developing agent during development to release a compound which can react with another oxidation product of the developing agent to release a development inhibitor;

(iii) the GL contains a DIR-coupler capable of releasing a development inhibitor having a diffusible degree of 0.4 or less;

(iv) the GL contains a colorless competing coupler for improving the graininess;

(v) the GL contains a nondiffusible coupler capable of forming a diffusible dye which can smear;

(vi) the GL contains at least one two-equivalent magenta coupler represented by formula (Cp-3), (Cp-4) or (Cp-5)

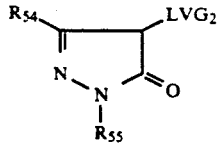

($C_p$-3)

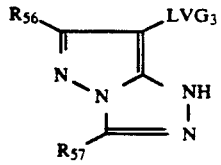

($C_p$-4)

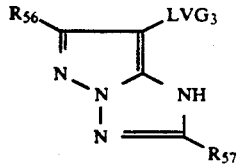

($C_p$-5)

in which $R_{54}$ and $R_{55}$ each represents an aliphatic group, an aromatic group, or a heterocyclic group; $R_{56}$ and $R_{57}$ each represents a hydrogen atom, an aliphatic group, an aromatic group, or a heterocyclic group; and $LVG_2$ and $LVG_3$ each represents a coupling-releasable group.

2. A silver halide color photographic material as in claim 1, wherein the maximum wavelength of the BL's spectral sensitivity falls with the range of from 420 nm to 460 nm, the maximum wavelength of the GL's spectral sensitivity falls within the range of from 530 nm to 550 nm, and the maximum wavelength of the RL's spectral sensitivity falls within the range of from 605 nm to 640 nm.

3. A silver halide color photographic material as in claim 1, wherein the layer which satisfies at least one of the conditions (a), (b), (c), and (d) contains a DIR-coupler represented by formula (I)

$$A\text{-}(L_1)_a\text{-}Z \quad (I)$$

in which A represents a coupler component; Z represents a development inhibiting moiety having a development inhibiting action; and a represents 0 or 1.

4. A silver halide color photographic material as in claim 1, wherein the colorless competing coupler for the condition (iv) is a coupler of formula (V), (VI), or (VII)

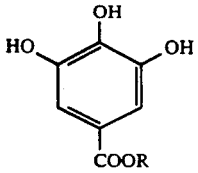

(V)

in which R represents a linear or branched alkyl group having from 1 to 18 carbon atoms;

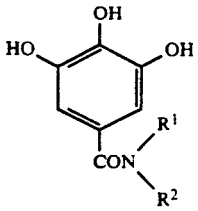

(VI)

in which $R^1$ and $R^2$ each represents a hydrogen atom, a substituted or unsubstituted aliphatic group, a substituted or uns.ubstituted aromatic group, or a substituted or unsubstituted heterocyclic group, or $R^1$ and $R^2$ together form a ring, provided that $R^1$ and $R^2$ are not both hydrogen atoms;

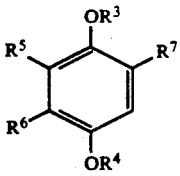

(VII)

in which $R^3$ and $R^4$ each represents a hydrogen atom or a group capable of being hydrolyzed with an alkali; and $R^5$, $R^6$, and $R^7$ each represents a hydrogen atom, a sulfo group, a carboxyl group, a sulfoalkyl group, a carboxyalkyl group or an alkyl group, provided that at least one of $R^5$, $R^6$, and $R^7$ represents a group selected from a sulfo group, a carboxyl group, a sulfoalkyl group, and a carboxyalkyl group, and at least one thereof represents an alkyl group.

5. A silver halide color photographic material as in claim 1, wherein the material has one or more emulsions containing tabular silver halide grains having an aspect ratio of five or more or monodispersed multilayer structural silver halide grains.

* * * * *